US009400443B2

(12) United States Patent
Suhara

(10) Patent No.: US 9,400,443 B2
(45) Date of Patent: Jul. 26, 2016

(54) IMAGE FORMING METHOD AND IMAGE FORMING APPARATUS FOR FORMING AN ELECTROSTATIC LATENT IMAGE CORRESPONDING TO AN IMAGE PATTERN INCLUDING AN IMAGE PORTION AND A NON-IMAGE PORTION

(71) Applicant: Hiroyuki Suhara, Kanagawa (JP)

(72) Inventor: Hiroyuki Suhara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/564,466

(22) Filed: Dec. 9, 2014

(65) Prior Publication Data

US 2015/0177638 A1 Jun. 25, 2015

(30) Foreign Application Priority Data

Dec. 25, 2013 (JP) ..... 2013-267958

(51) Int. Cl.
*G03G 15/04* (2006.01)
*G03G 15/043* (2006.01)

(52) U.S. Cl.
CPC ..... *G03G 15/043* (2013.01); *G03G 2215/0431* (2013.01)

(58) Field of Classification Search
CPC ..... G03G 15/043; G03G 15/0435; G03G 15/326; G03G 15/04; G03G 15/04045; G03G 21/1666; G03G 15/0415; G03G 2215/04; G06K 15/1209
USPC ..... 347/118, 131, 132, 135, 143, 144, 236, 347/237, 240, 246, 247, 251–254
See application file for complete search history.

(56) References Cited

U.S. PATENT DOCUMENTS 5,887,222 A * 3/1999 Sako ..... G03G 15/326 399/26
6,057,866 A 5/2000 Haneda et al.
6,498,617 B1 12/2002 Ishida et al.
8,982,422 B2 * 3/2015 Iwata ..... H04N 1/40037 347/135
2001/0028383 A1 10/2001 Mutou et al.
2002/0130944 A1 9/2002 Ema et al.
2003/0025785 A1 2/2003 Nihei et al.

(Continued)

FOREIGN PATENT DOCUMENTS

DE 102007002211 A1 * 8/2007 ..... B41C 1/05
JP 02-201467 8/1990

(Continued)

OTHER PUBLICATIONS

U.S. Appl. No. 14/082,628, filed Nov. 18, 2013.

(Continued)

*Primary Examiner* — Thinh Nguyen
(74) *Attorney, Agent, or Firm* — Oblon, McClelland, Maier & Neustadt, L.L.P.

(57) ABSTRACT

In an image forming method for forming an electrostatic latent image corresponding to an image pattern including an image portion and a non-image portion by exposing a surface of an image bearer with light based on the image pattern, the image portion has a plurality of pixels, the pixels constituting the image portion but not adjacent to at least a non-image portion are exposed with a first optical output that is higher than a given optical output obtained when the entire pixels corresponding to the image portion are exposed over a given time period.

15 Claims, 50 Drawing Sheets

(56) References Cited

U.S. PATENT DOCUMENTS

| | | | |
|---|---|---|---|
| 2003/0067533 | A1 | 4/2003 | Omori et al. |
| 2007/0132828 | A1 | 6/2007 | Ishida et al. |
| 2008/0088893 | A1 | 4/2008 | Ishida et al. |
| 2008/0123160 | A1 | 5/2008 | Omori et al. |
| 2008/0218813 | A1 | 9/2008 | Tanabe et al. |
| 2008/0225106 | A1 | 9/2008 | Omori et al. |
| 2008/0239336 | A1 | 10/2008 | Tanabe et al. |
| 2008/0291259 | A1 | 11/2008 | Nihei et al. |
| 2009/0091805 | A1 | 4/2009 | Tanabe et al. |
| 2009/0174915 | A1 | 7/2009 | Nihei et al. |
| 2009/0195635 | A1 | 8/2009 | Ishida et al. |
| 2009/0220256 | A1 | 9/2009 | Suhara et al. |
| 2009/0302218 | A1 | 12/2009 | Suhara |
| 2010/0196052 | A1 | 8/2010 | Suhara |
| 2011/0199657 | A1 | 8/2011 | Ishida et al. |
| 2011/0228037 | A1 | 9/2011 | Omori et al. |
| 2012/0059612 | A1 | 3/2012 | Suhara et al. |
| 2012/0099165 | A1 | 4/2012 | Omori et al. |
| 2012/0189328 | A1 | 7/2012 | Suzuki et al. |
| 2012/0293783 | A1 | 11/2012 | Ishida et al. |
| 2013/0243459 | A1 | 9/2013 | Omori et al. |
| 2013/0302052 | A1 | 11/2013 | Iwata et al. |
| 2014/0125752 | A1* | 5/2014 | Miyadera ..... G03G 15/0189 347/118 |
| 2014/0139603 | A1 | 5/2014 | Fujita et al. |
| 2014/0176656 | A1 | 6/2014 | Omori et al. |
| 2014/0253658 | A1 | 9/2014 | Suhara et al. |
| 2014/0268186 | A1 | 9/2014 | Iwata et al. |
| 2014/0327938 | A1 | 11/2014 | Ishida et al. |
| 2014/0333940 | A1 | 11/2014 | Iwata et al. |
| 2014/0333941 | A1 | 11/2014 | Iwata et al. |

FOREIGN PATENT DOCUMENTS

| | | |
|---|---|---|
| JP | 10-153899 | 6/1998 |
| JP | 2001-287402 | 10/2001 |
| JP | 2003-251853 | 9/2003 |
| JP | 2005-193540 | 7/2005 |
| JP | 2006-344436 | 12/2006 |
| JP | 2007-190787 | 8/2007 |
| JP | 2009-222754 | 10/2009 |

OTHER PUBLICATIONS

U.S. Appl. No. 14/451,815, filed Aug. 5, 2014.

* cited by examiner

TWO-ISOLATED DOT PATTERN

TWO-BY-TWO PATTERN

TWO-DOT LINE PATTERN

|Vacc|≥|Vp|

|Vacc|<|Vp|

IMAGE FORMING METHOD AND IMAGE FORMING APPARATUS FOR FORMING AN ELECTROSTATIC LATENT IMAGE CORRESPONDING TO AN IMAGE PATTERN INCLUDING AN IMAGE PORTION AND A NON-IMAGE PORTION

CROSS-REFERENCE TO RELATED APPLICATIONS

The present application claims priority to and incorporates by reference the entire contents of Japanese Patent Application No. 2013-267958 filed in Japan on Dec. 25, 2013.

BACKGROUND OF THE INVENTION

1. Field of the Invention

The present invention relates to an image forming method and an image forming apparatus.

2. Description of the Related Art

There have recently been increased demands for high image quality and high stability in the electrophotography process for image forming.

Exemplary ways to improve the image quality in the electrophotography process include a method for reducing the exposure beam diameter. A smaller exposure beam diameter allows smaller electrostatic latent images to be formed, so that a higher resolving power can be achieved.

When an electrostatic latent image is formed with a smaller exposure beam diameter, however, not only the image height can be controlled less easily, but also the costs for forming images are increased.

The cost for controlling the image height of electrostatic latent images formed with a smaller exposure beam diameter comes to occupy a higher proportion of the entire costs of the image forming apparatus.

Thus, in the electrophotography process, an alternative for forming very small electrostatic latent images without reducing the exposure beam diameter has been sought for.

Furthermore, in the conventional image forming method, the height of attached toner on a line image, that is, the pile height of a line image is different from that on a solid image. Such a difference in the pile heights is caused by a difference in the sizes of the electrostatic latent images of these images.

In consideration of the demand for improved image quality and the demand for reduction in the environmental burden, the pile height needs to be controlled to an appropriate level.

The pile heights of line images and solid images may be controlled by performing some process in the developing process.

To control the pile height in the developing process, however, the latent images of a line image and a solid image need to be developed at different sensitivities because the electrostatic latent images of a line image and a solid image are different in size.

This method for controlling the pile height by developing the latent images of a line image and a solid image at different sensitivities is not preferable, because such a method causes some defects, e.g., lost faithfulness, in the resultant latent images.

In image forming, controlling the pile height without performing any process in the developing process is therefore desirable. Desired in an image forming method is a way in which an electrostatic latent image is formed in such a manner that any variation resulting from the electrophotography process, without limitation to the pile height, is compensated.

In the technology disclosed in Japanese Patent Application Laid-open No. 2005-193540, for example, when the area of an input image is smaller than a predetermined size in image forming, the exposure energy per unit pixels is increased from a level used when written is a solid image.

Another exemplary technology disclosed in Japanese Patent Application Laid-open No. 2007-190787 corrects the image data by removing some pixels from or adding some pixels to the image to be exposed so that the optical energy output from each light source becomes uniform.

In image forming, there is also a demand for output images allowing very small characters, particularly outlined character images, that is, outline characters, in a size of two or three points to be recognized at a high dot density, e.g., at 1200 dpi.

While some improvements have been made in the developing, the transfer, and the fixing processes of the image forming to allow high quality images to be output at a high dot density, such outputting of high-quality image has still been difficult.

While micron-order measurements of electrostatic latent images have been conventionally difficult, such measurements can now be conducted highly precisely. Such measurements have uncovered that a latent image, which is an image before development, was a cause of image quality deterioration in the image forming process.

In other words, uncovered by the measurements was that, when output as an image pattern was an outlined image, the electric field vector in the latent image in the vertical direction of the sample was not exactly the reverse of the electric field vector in the latent image of the ordinary image, and the vector in the outlined image was smaller than that intended in the image pattern.

In other words, when a very small image is to be output at a high dot density in the image forming, a latent image resulting from an image pattern signal supplied from the controller does not match the image pattern affected by the beam size or the electric charge diffusion. As a result, high-quality image outputs are still difficult even if any improvements in the developing, transferring, and fixing processes are made in an image forming method.

An effective way to output images of outlined characters, in particular, at high image quality is to increase the electric field vector in the latent image in the sample vertical direction toward the side not causing the toner to be attached. From the view point of electromagnetism, the simplest way to increase the electric field vectors in a white part of an image is to increase the amount of electric charge in the white part, but it is difficult to increase a local amount of electric charging.

Therefore, it is desirable to provide an image forming method capable of forming high-quality images of image patterns including image portions that include very small pixels and non-image portions.

SUMMARY OF THE INVENTION

It is an object of the present invention to at least partially solve the problems in the conventional technology.

According to an aspect of the present invention, there is provided an image forming method for forming an electrostatic latent image corresponding to an image pattern including an image portion and a non-image portion, the image forming method including: exposing a surface of an image bearer with light based on the image pattern, the image portion having a plurality of pixels, and the pixels constituting the image portion but not adjacent to at least the non-image portion are exposed with a first optical output that is higher than a given optical output obtained when the entire pixels corresponding to the image portion are exposed over a given time period.

According to another aspect of the present invention, there is provided an image forming apparatus for forming an electrostatic latent image corresponding to an image pattern including an image portion and a non-image portion by exposing a surface of an image bearer with light based on the image pattern, the image forming apparatus including: a light source that outputs the light; a light source driving unit that generates a light source driving current for driving the light source; and an optical system that guides the light output from the light source to the image bearer, wherein the image portion has a plurality of pixels, and the light source driving unit exposes the pixels constituting the image portion but not adjacent to at least the non-image portion with a first optical output that is higher than a given optical output obtained when the entire pixels corresponding to the image portion are exposed over a given time period.

According to still another aspect of the present invention, there is provided a method for manufacturing a printed matter, the method including: forming an electrostatic latent image corresponding to an image pattern including an image portion and a non-image portion by exposing a surface of an image bearer with light based on the image pattern, wherein the image portion has a plurality of pixels, and at the forming the electrostatic latent image, the pixels constituting the image portion but not adjacent to at least the non-image portion are exposed with a first optical output that is higher than a given optical output obtained when the entire pixels corresponding to the image portion are exposed over a given time period.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Some embodiments of an image forming method according to the present invention and an image forming apparatus according to the present invention will now be described with reference to some drawings.

Image Forming Apparatus

To begin with, the image forming apparatus according to the present invention will be explained.

Figure 1:
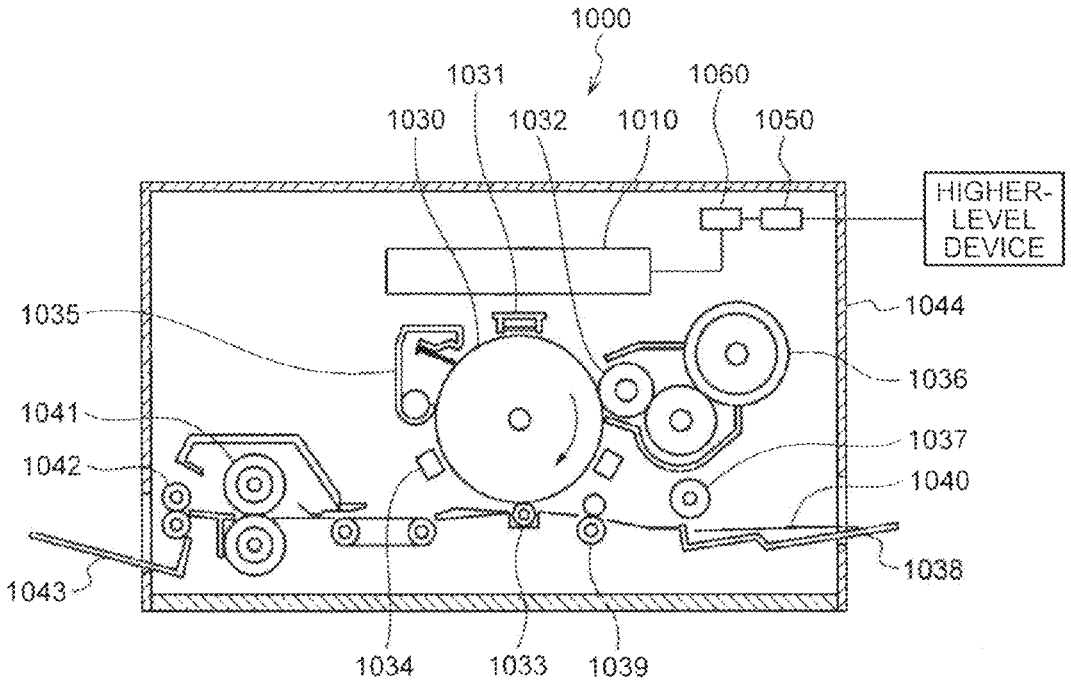
FIG. 1 is a cross-sectional view across the center of an embodiment of an image forming apparatus according to the present invention.

FIG. 1 is a cross-sectional view across the center of the embodiment of the image forming apparatus according to the present invention. Illustrated in FIG. 1 is a general structure of a laser printer 1000 serving as the image forming apparatus according to the present invention.

The laser printer 1000 includes an optical scanning device 1010, a photoconductor 1030, a charging device 1031, a developing device 1032, a transfer device 1033, a neutralization unit 1034, a cleaning unit 1035, and a toner cartridge 1036.

The laser printer 1000 also includes a sheet feeding roller 1037, a sheet feeding tray 1038, a fixing device 1041, a sheet discharge roller 1042, a sheet discharge tray 1043, a communication controlling device 1050, and a printer controlling device 1060.

These elements of the laser printer 1000 described above are housed in a printer housing 1044, at their predetermined positions.

The communication controlling device 1050 controls bidirectional communications with a higher-level device (e.g., an information processing apparatus such as a personal computer) over a network or the like.

The printer controlling device 1060 includes a central processing unit (CPU) and a read-only memory (ROM) not illustrated. The printer controlling device 1060 also includes a random access memory (RAM) and an analog-to-digital (A/D) converter. The printer controlling device 1060 controls these elements comprehensively in response to a request from the higher-level device, and transmits image information received from the higher-level device to the optical scanning device 1010.

The ROM stores therein computer programs described in codes readable by the CPU, and various types of data used when these computer programs are executed.

The RAM is a working memory for the CPU and is enabled for temporary writing.

The A/D converter converts analog signals into digital signals.

The photoconductor 1030 is a latent image bearer made from a cylindrical member, and on the surface of which a photosensitive layer is formed. In other words, the surface of the photoconductor 1030 is a surface to be scanned. The photoconductor 1030 is rotated in the direction of the arrow in FIG. 1, by a driving mechanism not illustrated.

The charging device 1031 uniformly charges the surface of the photoconductor 1030. As the charging device 1031, a contact-based charging roller that produces less ozone, or a corona charger taking advantage of corona discharge may be used, for example.

Figure 2:
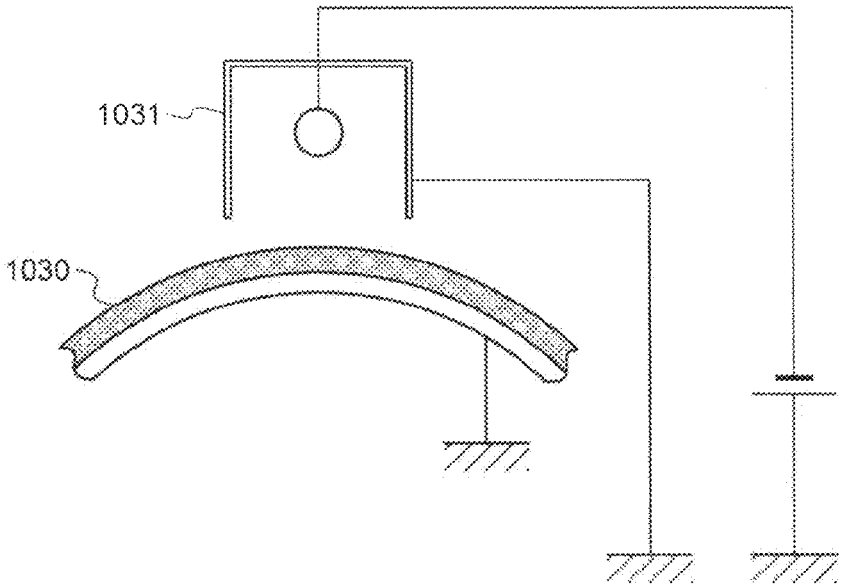
FIG. 2 is a schematic illustrating a corotron charger for the image forming apparatus.
Figure 3:
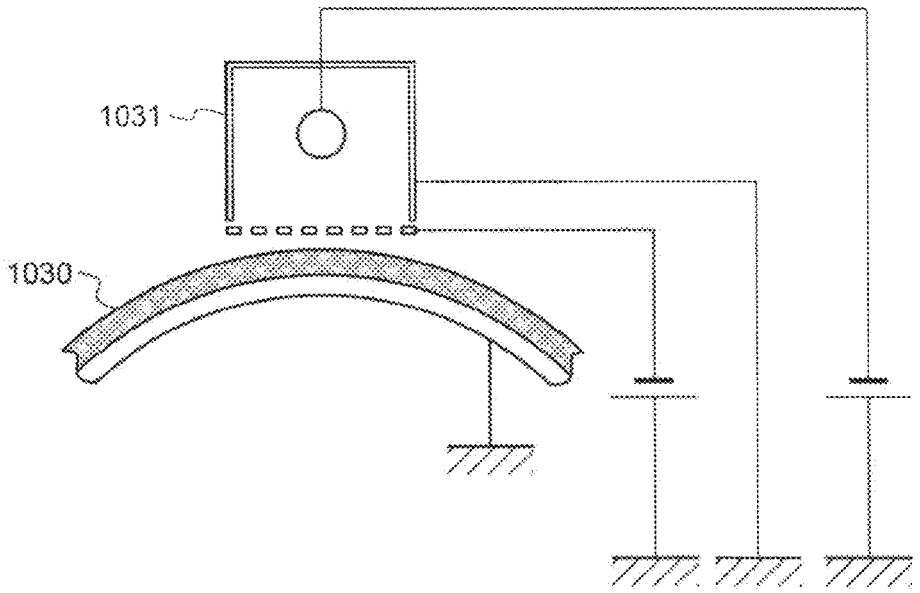
FIG. 3 is a schematic illustrating a scorotron charger for an image forming apparatus.

FIG. 2 is a schematic illustrating a corotron charger for the image forming apparatus. FIG. 3 is a schematic illustrating a scorotron charger for the image forming apparatus. The charging device 1031 may be any of the corotron charger illustrated in FIG. 2, the scorotron charger illustrated in FIG. 3, or a roller charger not illustrated.

The optical scanning device 1010 scans to expose the surface of the photoconductor 1030 charged by the charging device 1031, with a light beam having modulated based on image information received from the printer controlling device 1060, thereby forming an electrostatic latent image corresponding to the image information on the surface of the photoconductor 1030.

The electrostatic latent image formed by the optical scanning device 1010 moves toward the developing device 1032 as the photoconductor 1030 is rotated. The optical scanning device 1010 will be described later in detail.

The toner cartridge 1036 stores therein a toner (developer). The toner is supplied from the toner cartridge 1036 into the developing device 1032.

The developing device 1032 attaches the toner supplied from the toner cartridge 1036 onto the latent image formed on the surface of the photoconductor 1030, visualizing the electrostatic latent image thereby. The image on which the toner is attached (hereinafter, sometimes referred to as a "toner image") moves toward the transfer device 1033 as the photoconductor 1030 is rotated.

The sheet feeding tray 1038 stores therein recording sheets 1040. The sheet feeding roller 1037 is provided near the sheet feeding tray 1038.

The sheet feeding roller 1037 takes out a recording sheet 1040 at a time from the sheet feeding tray 1038. The recording sheet 1040 is fed into the nip between the photoconductor 1030 and the transfer device 1033 from the sheet feeding tray 1038, in synchronization with the rotation of the photoconductor 1030.

Applied to the transfer device 1033 is a voltage with an opposite polarity to that of the toner so that the toner on the surface of the photoconductor 1030 is electrically attracted to the recording sheet 1040. This voltage causes the toner image on the surface of the photoconductor 1030 to transfer onto the recording sheet 1040. The recording sheet 1040 having the toner image transferred is sent to the fixing device 1041.

The fixing device 1041 applies heat and pressure to the recording sheet 1040, thereby fixing the toner on the recording sheet 1040. The recording sheet 1040 having the toner fixed is then sent to the sheet discharge tray 1043 via the sheet discharge roller 1042, and is sequentially stacked on the sheet discharge tray 1043, whereby a printed matter is manufactured.

The neutralization unit 1034 neutralizes the surface of the photoconductor 1030.

The cleaning unit 1035 removes the toner remaining on the surface of the photoconductor 1030 (residual toner). The surface of the photoconductor 1030 from which the remaining toner is removed is returned to the position facing the charging device 1031.

In the image forming apparatus according to the present invention, an electrostatic latent image is formed by the charging device, the optical scanning device serving as an exposing device, the photoconductor, and an image processor that converts an image pattern into an optical output.

The process of outputting an image in the electrophotography such as in a copier or a laser printer is as follows. In other words, in the electrophotography, the photoconductor, which is a latent image bearer, is uniformly charged in the charging process. In the electrophotography, the charge is partly discharged by irradiating the photoconductor with a light beam in the exposure process. In this manner, an electrostatic latent image is formed on the photoconductor in the electrophotography.

Structure of Optical Scanning Device

The following describes a structure of the optical scanning device 1010 constituting the image forming apparatus.

Figure 4:
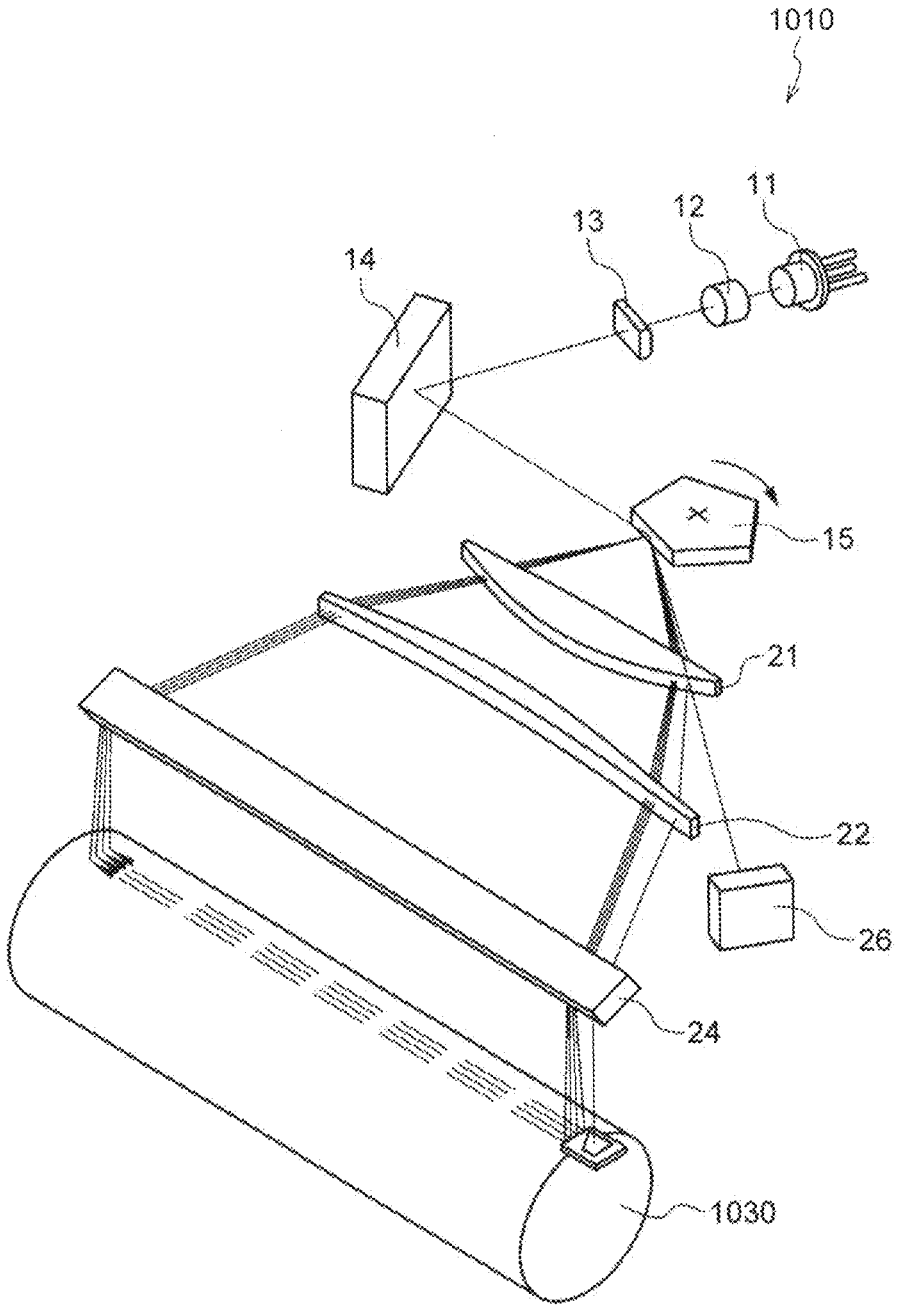
FIG. 4 is a schematic illustrating an optical scanning device constituting the image forming apparatus.

FIG. 4 is a schematic illustrating the optical scanning device 1010. As illustrated in FIG. 4, the optical scanning device 1010 includes a light source 11, a collimator lens 12, a cylindrical lens 13, a folding mirror 14, a polygon mirror 15, and a first scanning lens 21. The optical scanning device 1010 also includes a second scanning lens 22, a folding mirror 24, a synchronization detection sensor 26, and a scanning control device (not illustrated).

The optical scanning device 1010 is assembled to a predetermined position in an optical housing (not illustrated).

In the description hereunder, the longitudinal direction of the photoconductor 1030 (rotating shaft direction) is referred to as the Y-axial direction in an X-Y-Z three-dimensional Cartesian coordinate system, and the direction extending along the rotating shaft of the polygon mirror 15 is referred to as the Z-axial direction, and the direction perpendicular to the Y axis and to the Z axis is referred to as the X-axial direction.

In the explanation hereunder, the direction corresponding to the main-scanning direction of the optical members is referred to as a "main-scanning corresponding direction", and the direction corresponding to the sub-scanning direction is referred to as a "sub-scanning corresponding direction".

The light source 11 includes a plurality of light-emitting elements (not illustrated) that are arranged two dimensionally, for example. The light-emitting elements are arranged in such a manner that the light-emitting elements are spaced at equal intervals when all of the light-emitting elements are orthographically projected onto a virtual line extending in the sub-scanning corresponding direction.

As the light source 11, semiconductor lasers (laser diodes (LDs)) or light emitting diodes (LEDs) may be used.

Figure 5:
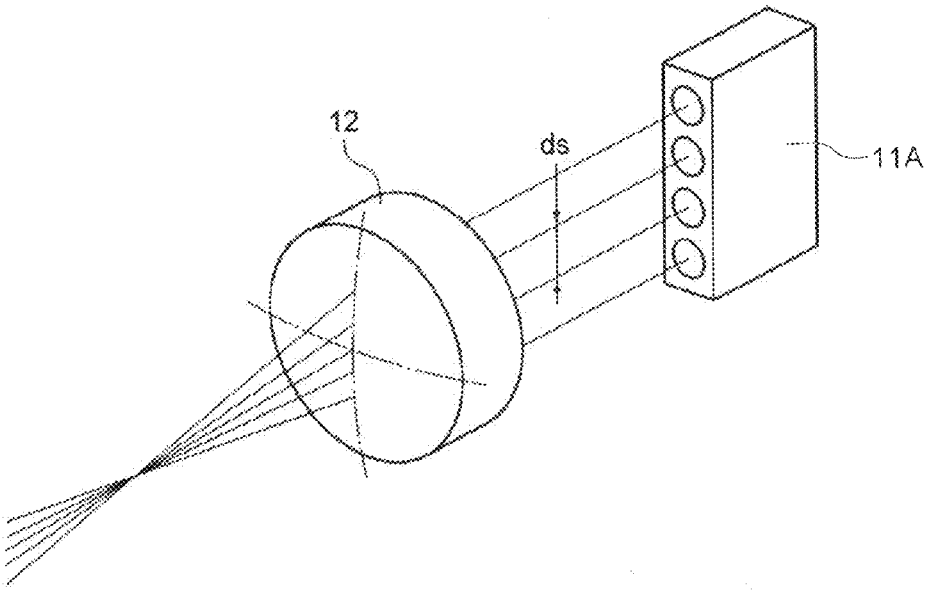
FIG. 5 is a schematic illustrating an exemplary light source in an optical scanning device.

FIG. 5 is a schematic illustrating an exemplary light source in the optical scanning device 1010. In FIG. 5, a light source 11A is a multi-beam light source implemented as a semiconductor laser array consisting of four semiconductor lasers. The light source 11A is positioned perpendicularly to the optical axis of the collimator lens 12.

Figure 6:
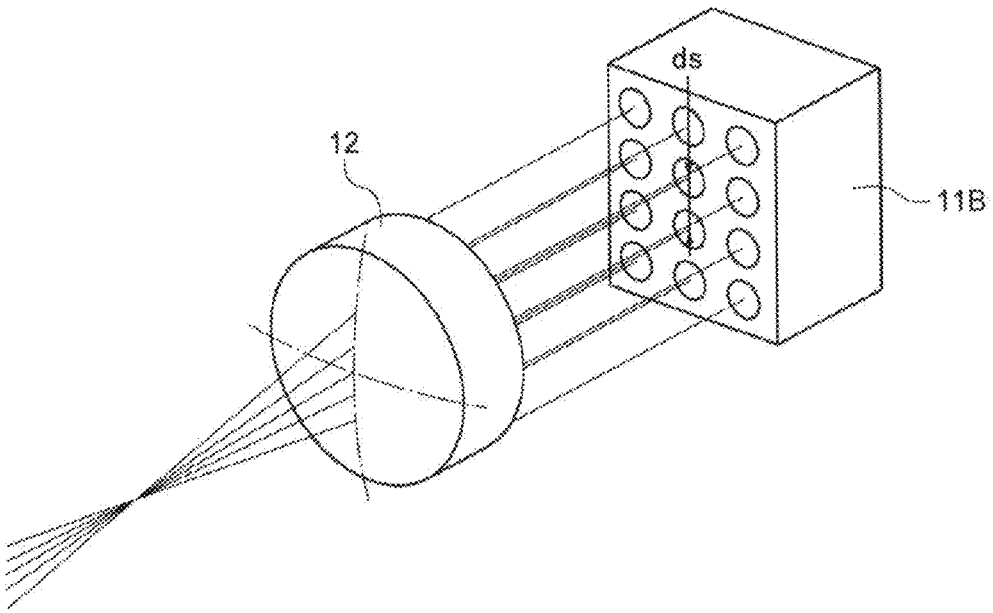
FIG. 6 is a schematic illustrating another exemplary light source in the optical scanning device.

FIG. 6 is a schematic illustrating another exemplary light source in the optical scanning device 1010. In FIG. 6, a light source 11B is a vertical cavity surface emitting laser (VC- SEL) of which wavelength is 780 nanometers (nm) and of which light-emitting points are positioned on a plane including the Y-axial and Z-axial directions.

The light source 11B has three light-emitting points in the horizontal direction (main-scanning direction, Y-axial direction) and four light-emitting elements in the vertical direction (sub-scanning direction, Z-axial direction), resulting in twelve in total, as an example.

When the light source 11B is used in the optical scanning device 1010, four scan lines in the vertical direction can be scanned simultaneously by scanning one scan line with three light-emitting points that are horizontally provided per scan line.

Hereinafter, the "interval between the light-emitting elements" represents a distance between the centers of two light-emitting elements.

Referring back to FIG. 4, the collimator lens 12 is positioned on the optical path of the light output from the light source 11, and controls to collimate the light into parallel rays or approximately parallel rays.

The cylindrical lens 13 converges the light passed through the collimator lens 12 at a point near the deflecting reflective surface of the polygon mirror 15 only in the Z-axial direction (sub-scanning direction).

The cylindrical lens 13 forms an image of the light output from the light source 11 near the reflecting surface of the folding mirror 14, as a line image extending in the main-scanning direction (Y-axial direction).

The folding mirror 14 folds the light the image of which is formed by the cylindrical lens 13 to the polygon mirror 15.

The optical system positioned on the optical path between the light source 11 and the polygon mirror 15 is also referred to as a pre-deflector optical system.

The polygon mirror 15 is a polygon mirror rotating about a rotating shaft perpendicularly intersecting with the longitudinal direction (rotating shaft direction) of the photoconductor 1030. Each of the mirror surfaces of the polygon mirror 15 severs as a deflecting reflective surface.

The polygon mirror 15 is caused to be rotated by a motor at a desired constant speed by causing a driving integrated circuit (IC) not illustrated to feed an appropriate clock to the motor unit.

When the polygon mirror 15 is rotated by the motor unit at a constant speed in the direction of the arrow, each of the light beams reflected on the deflecting reflective surface is deflected as a deflected beam with a constant angular velocity.

The first scanning lens 21, the second scanning lens 22, the folding mirror 24, and the synchronization detection sensor 26 make up a scanning optical system. The scanning optical system is positioned on the optical path of the light deflected on the polygon mirror 15.

The first scanning lens 21 is positioned on the optical path of the light deflected on the polygon mirror 15.

The second scanning lens 22 is positioned on the optical path of the light passed through the first scanning lens 21.

The folding mirror 24 is a long flat mirror, and folds the optical path of the light passed through the second scanning lens 22 toward the photoconductor 1030.

In other words, the light deflected on the polygon mirror 15 passes through the first scanning lens 21 and the second scanning lens 22, and the photoconductor 1030 is irradiated with the light, so that light spots are formed on the surface of the photoconductor 1030.

The light spots on the surface of the photoconductor 1030 are carried in the longitudinal direction of the photoconductor 1030 as the polygon mirror 15 is rotated. The direction in which the light spots on the surface of the photoconductor 1030 move (Y-axial direction) represents the "main-scanning direction", and the rotating direction of the photoconductor 1030 (Z-axial direction) represents the "sub-scanning direction".

The synchronization detection sensor 26 receives the light from the polygon mirror 15, and outputs a signal corresponding to the amount of received light (photoelectric conversion signal) to the scanning control device. The signal output from the synchronization detection sensor 26 is also referred to as a "synchronization detection signal".

As illustrated in FIG. 4, in the optical scanning device 1010, a plurality of lines on the scanned surface of the photoconductor 1030 are simultaneously scanned by the scanning via one deflecting reflective surface of the polygon mirror 15. A piece of print data for one line corresponding to one light-emitting point is stored in a buffer memory in the image processor for controlling the light-emitting signals for the respective light-emitting points.

The print data is read for each of the deflecting reflective surfaces of the polygon mirror 15. The light beams are turned ON or OFF based on the print data across a scan line on the latent image bearer, so that an electrostatic latent image is formed by the scan line.

Figure 7:
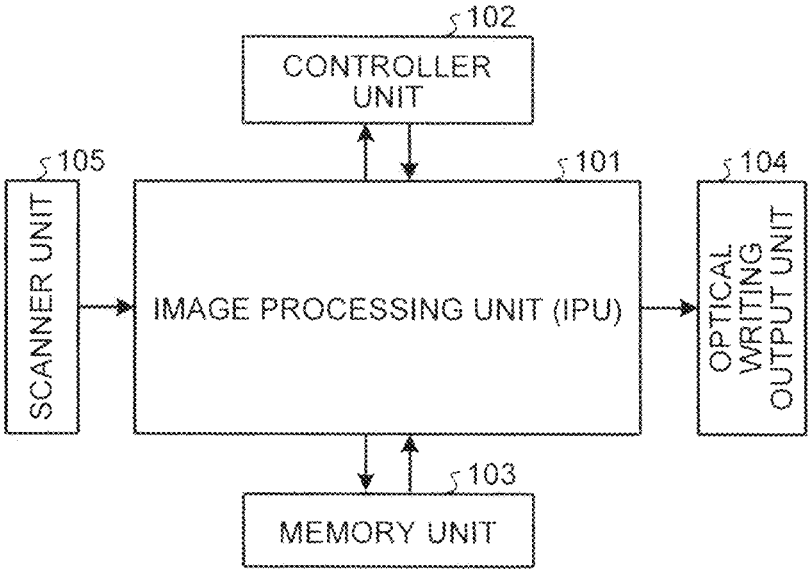
FIG. 7 is a block diagram illustrating an image processor in the image forming apparatus.

FIG. 7 is a block diagram illustrating the image processor in the image forming apparatus. As illustrated in FIG. 7, the image processor includes an image processing unit (IPU) 101, a controller unit 102, a memory unit 103, an optical writing output unit 104, and a scanner unit 105.

After performing rotation, repetition, aggregation, and decompression, the controller unit 102 outputs again to the IPU.

A lookup table for storing therein various types of data is prepared in the memory unit 103.

The optical writing output unit 104 causes a control driver to modulate the light source 11 based on ON data, thereby forming an electrostatic latent image on the photoconductor 1030. The optical writing output unit 104 forms an image on a recording sheet based on an input signal received from a gradation processing unit described later.

The scanner unit 105 reads an image, and generates image data such as red-green-blue (RGB) data based on the image.

Figure 8:
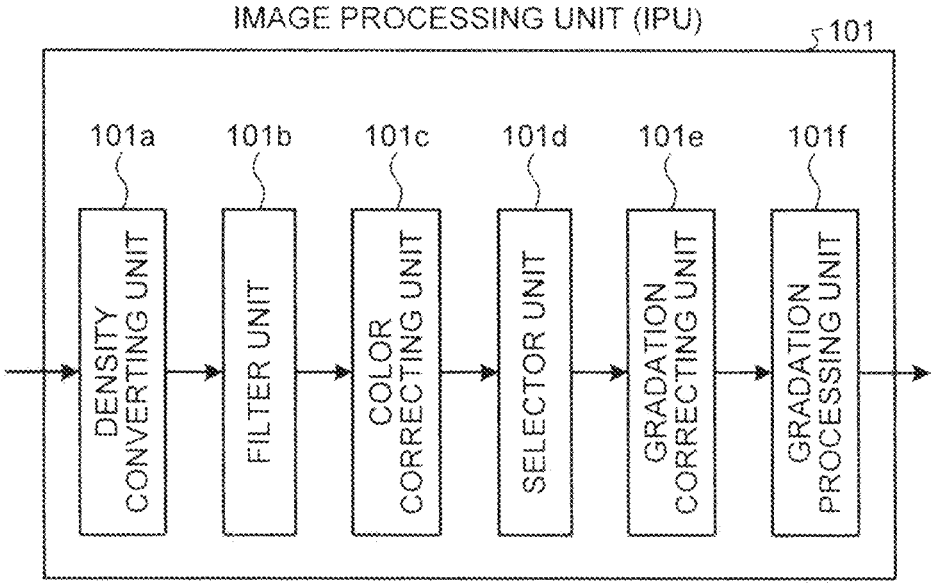
FIG. 8 is a block diagram illustrating an image processing unit in the image processor.

FIG. 8 is a block diagram illustrating the image processing unit 101 in the image processor. As illustrated in FIG. 8, the image processing unit 101 includes a density converting unit 101*a*, a filter unit 101*b*, a color correcting unit 101*c*, a selector unit 101*d*, a gradation correcting unit 101*e*, and a gradation processing unit 101*f*.

The density converting unit 101*a* converts the RGB image data received from the scanner unit 105 into density data using the lookup table, and outputs the density data to the filter unit 101*b*.

The filter unit 101*b* performs image correcting processing such as smoothing and edge enhancement to the density data received from the density converting unit 101*a*, and outputs the corrected data to the color correcting unit 101*c*.

The color correcting unit 101*c* performs a color correction (masking) process.

The selector unit 101*d* selects one of C (cyan), M (magenta), Y (yellow), and K (key plate) for the image data received from the color correcting unit 101*c* under the control of the image processing unit 101. The selector unit 101*d* outputs the data of the selected one of C, M, Y, and K to the gradation correcting unit 101*e*.

The gradation correcting unit 101*e* stores in advance C, M, Y, and K data received from the selector unit 101*d*. The gradation correcting unit 101*e* is specified with a γ curve allowing linear characteristics to be acquired for a piece of input data.

The gradation processing unit 101*f* performs gradation processes such as dithering to the image data received from the gradation correcting unit 101*e*, and outputs the signal to the optical writing output unit 104.

Image Forming Method (1)

The following describes some approaches to the exposure in the image forming method according to the embodiment.

In the image forming method according to the present embodiment, an optical output for forming a latent image has such a waveform that the photoconductor is exposed with an optical output required to achieve a target image density on an image portion including a line image or a solid image, over a predetermined time period.

The image portion is a portion of an image pattern consisting of a plurality of pixels, and for which an image is to be formed by attaching toner. A non-image portion is a portion of the image pattern for which no image is to be formed and on which no toner is attached.

In the explanation hereunder, an image density to be achieved will be referred to as a "target image density". In the explanation hereunder, a predetermined level of an optical output required to achieve the target image density is referred to as a "target exposure optical output". In the explanation hereunder, a predetermined time period over which the entire pixels in the image portion are exposed with the target exposure optical output to achieve the target image density is achieved referred to as a "target exposure time".

In the explanation hereunder, the exposure with the target exposure optical output over the target exposure time is referred to as a "standard exposure". In the embodiment, solid images are image portions of which area is larger than line images.

Figure 9:
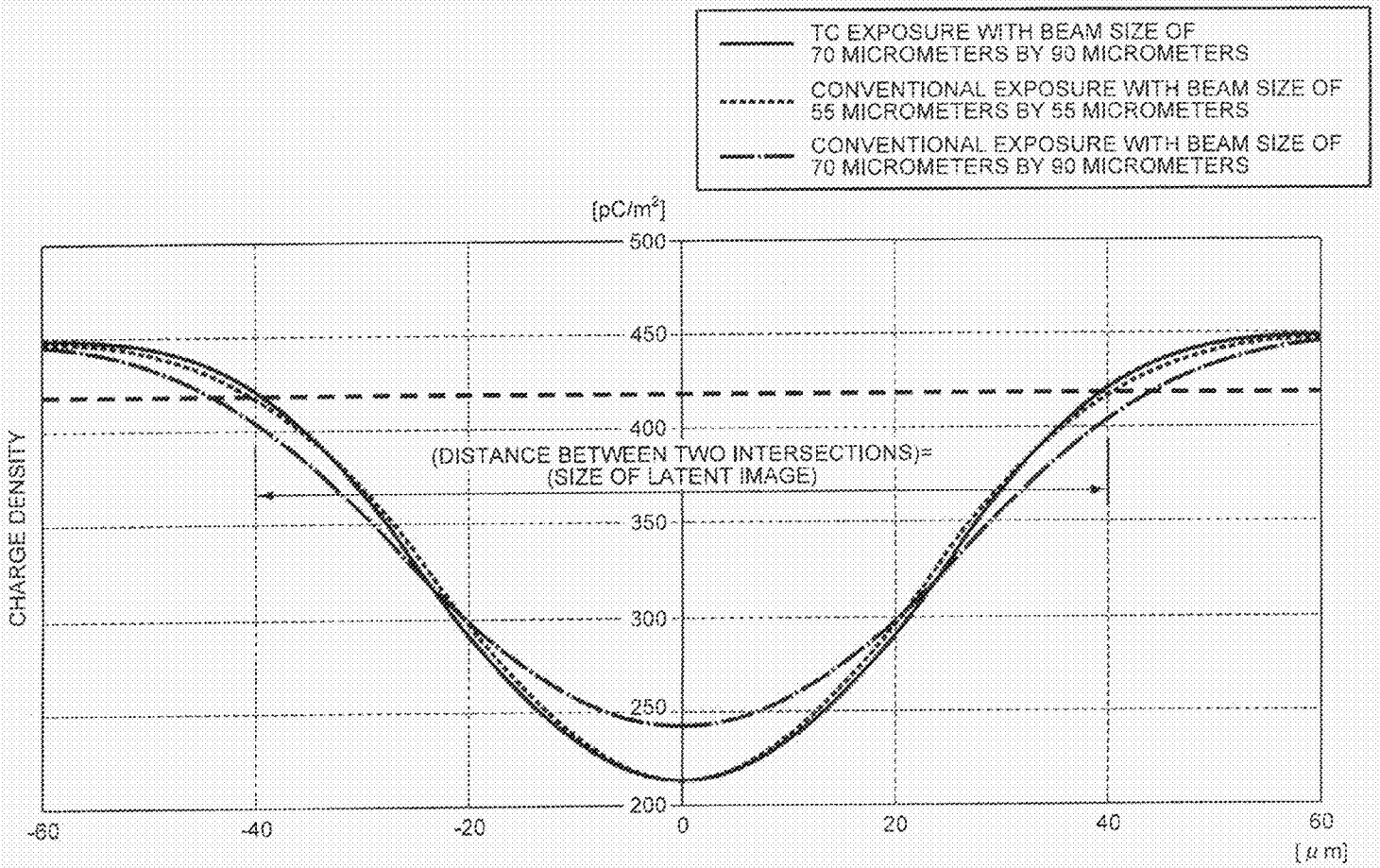
FIG. 9 is a schematic diagram illustrating a latent image diameter formed with an image forming method according to the reference example, and a latent image diameter formed with an image forming method according to an embodiment of the present invention.

FIG. 9 is a schematic diagram illustrating a latent image diameter formed with the image forming method according to the reference example, and a latent image diameter formed with the image forming method according to the embodiment of the present invention. FIG. 9 illustrates a simulation result of electric charge distributions of two-dot latent images when the dot density is 1200 dpi, the latent images formed with the standard exposure according to reference example and with the concentrated exposure according to the present embodiment. In the concentrated exposure, the optical output for the image pixels was set to 400 percent of the target exposure optical output.

The latent image charge distribution illustrated in FIG. 9 indicates that the latent image diameter achieved by the concentrated exposure with a beam spot size of 70 micrometers (μm) by 90 micrometers is equivalent to that achieved by the standard exposure with a beam spot size of 55 micrometers by 55 micrometers. In other words, according to the embodiment, the advantageous effects achieved with the standard exposure using a smaller beam spot size can be achieved with the concentrated exposure.

Figure 10:
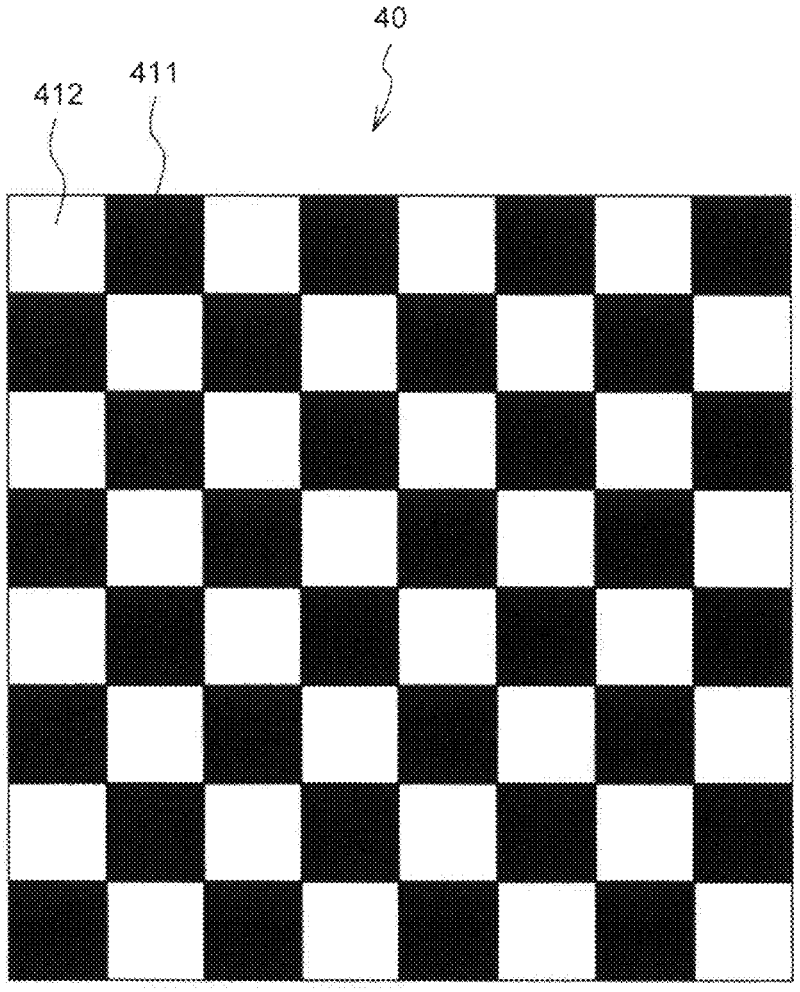
FIG. 10 is a schematic diagram illustrating an example of an ideal target output image formed with the image forming method according to the above-described embodiment.

FIG. 10 is a schematic diagram illustrating an example of a target output image formed with the image forming method according to the embodiment of the present invention. As illustrated in FIG. 10, the target in the embodiment is to output a lattice pattern image including image portions 411 represented with black (tinted) portions and non-image portions 412 represented with white (untinted) portions and the area ratio of the image portions is 50 percent of the entire image. In the embodiment, the target image to be output is referred to as a target output image 40.

The screen density of the target output image 40 is 212 lpi. That is, the target output image 40 is a two-dot image when the dot density is 600 dpi, and the image portion 411 and the non-image portion 412 have a side of 85 micrometers.

In the target output image 40, the image portion 411 and the non-image portion 412 include a plurality of pixels and have a certain amount of area, respectively. The image portion 411 is a group of the pixels where toner is attached after being exposed. The non-image portion 412 is a group of the pixels where toner is not attached after the exposure.

Figure 11:
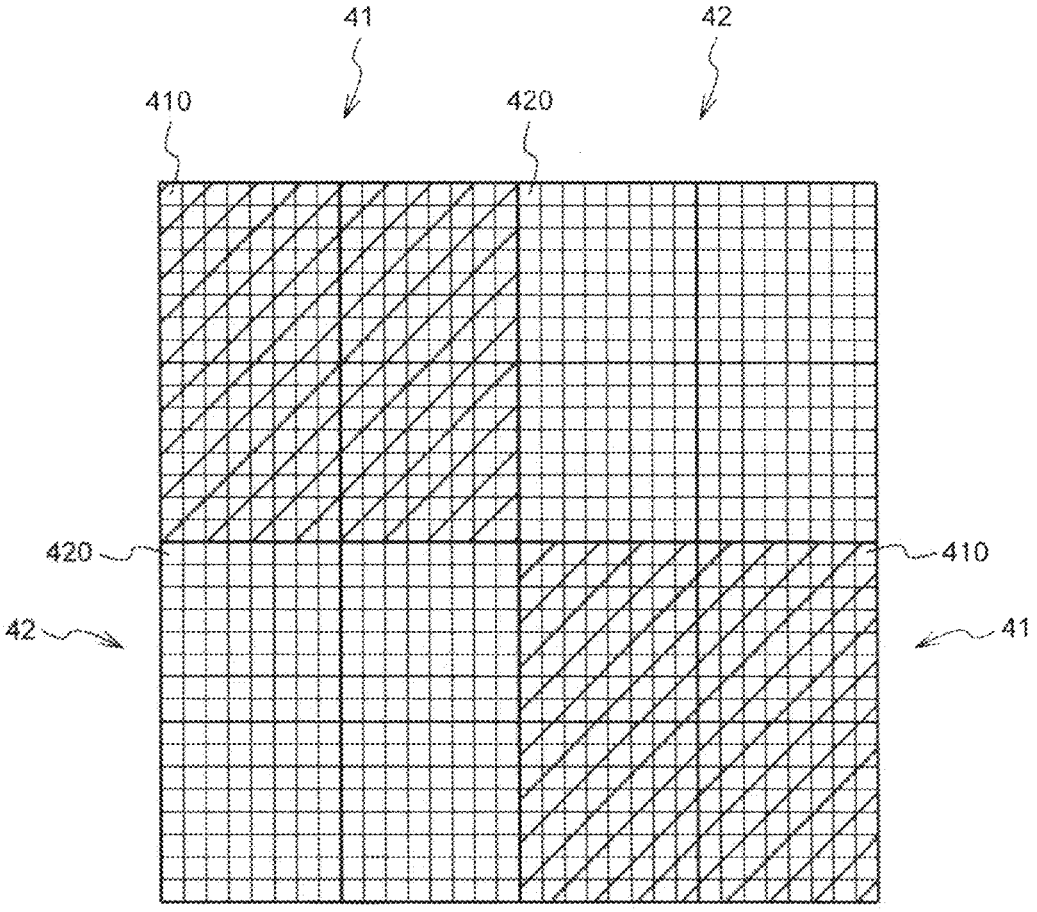
FIG. 11 is a schematic diagram illustrating a partial enlarged view of an example of image patterns according to the reference example.

FIG. 11 is a schematic diagram illustrating a partial enlarged view of an example of image patterns according to the reference example. In FIG. 11, only two pairs of the image portion and the non-image portion are illustrated in an enlarged view out of the combinations of the image portion and the non-image portion included in the target output image obtained from the image pattern used for forming the target output image 40 illustrated in FIG. 10.

In FIG. 11, the exposed portions 41 are exposed to form the image portions in the target output image for all of the pixels 410 making up the image portions with the target exposure optical output over the target exposure time. By contrast, the non-exposed portions 42 are not exposed to form the non-image portions in the target output image for all of the pixels 420 making up the non-image portions.

Figure 12:
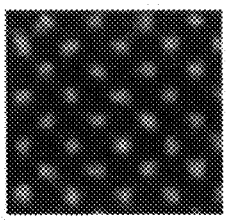
FIG. 12 is an output image of the image pattern illustrated in FIG. 11.

FIG. 12 is an output image of the image pattern illustrated in FIG. 11. As illustrated in FIG. 12, in an output image including very small dots having a size of 100 micrometers or smaller, if all of the pixels making up the image portions in the target output image are exposed with the target exposure optical output over the target exposure time, the actual output image has smears from the image portions to the non-image portions. That is, in an output image including very small dots having a size of 100 micrometers or smaller, if all of the pixels making up the image portions are exposed with the target exposure optical output over the target exposure time, with the target exposure optical output over the target exposure time, the target output image cannot be truly reproduced.

Figure 13:
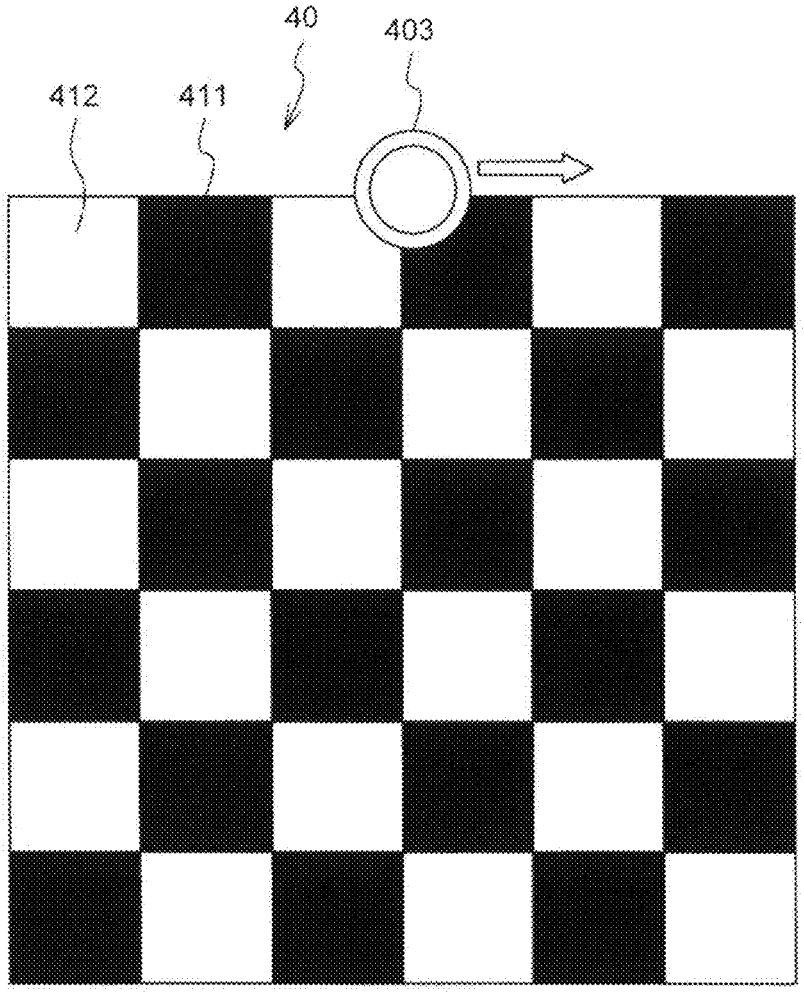
FIG. 13 is a schematic diagram illustrating the relation between the target output image illustrated in FIG. 10 and the beam size.

FIG. 13 is a schematic diagram illustrating the relation between the target output image 40 illustrated in FIG. 10 and the beam size. As illustrated in FIG. 13, the target output image 40 including very small dots having a size of 100 micrometers or smaller is affected by the size of a beam 403 (about 40 to 80 micrometers, usually) used for the exposure.

In addition, in the target output image 40 including very small dots having a size of 100 micrometers or smaller, the latent image charge diffusion in the process of forming latent images enlarges the latent images.

Figure 14:
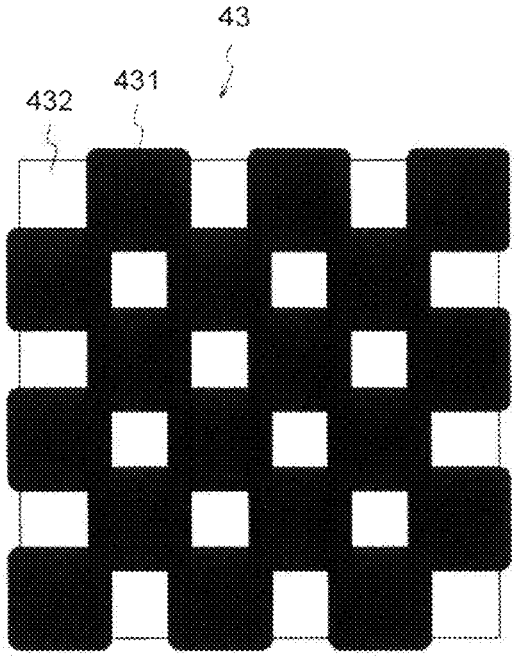
FIG. 14 is a schematic diagram illustrating an output image of the image pattern illustrated in FIG. 11.

FIG. 14 is an output image of the image pattern illustrated in FIG. 11. As illustrated in FIG. 14, if all of the pixels making up the image portions in the target output image are exposed with the target exposure optical output over the target exposure time, the area of image portions 431 of the output image 43 increases and the area of non-image portions 432 decreases because of the effects of the beam size and the latent image charge diffusion.

Figure 15:
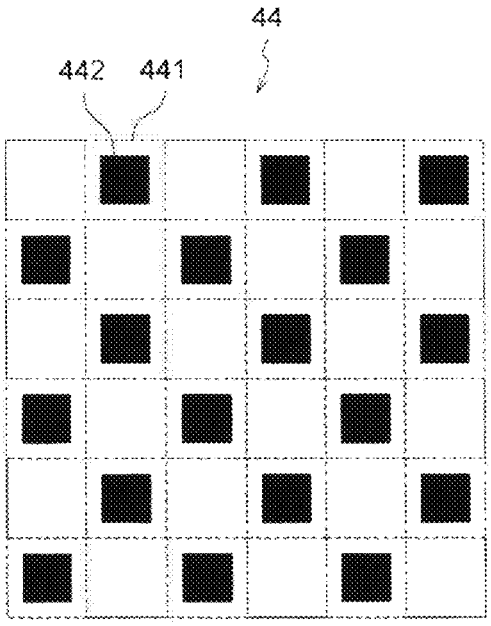
FIG. 15 is a schematic illustrating an image pattern in another reference example.

FIG. 15 is a schematic diagram illustrating an image pattern according to another reference example. As illustrated in FIG. 15, to prevent the area of the image portions in the output image from increasing on the basis of that in the target output image 40, the pixels adjacent to both an image portion and a non-image portion can be converted into non-exposed portions 441 by using the thinning processing in which binary images are converted into line images.

The optical output used for exposing the exposed portions 442 are controlled through the power modulation (PM) or the pulse-width modulation (PWM), while the level of the target exposure optical output is maintained at 100 percent output.

Figure 16:
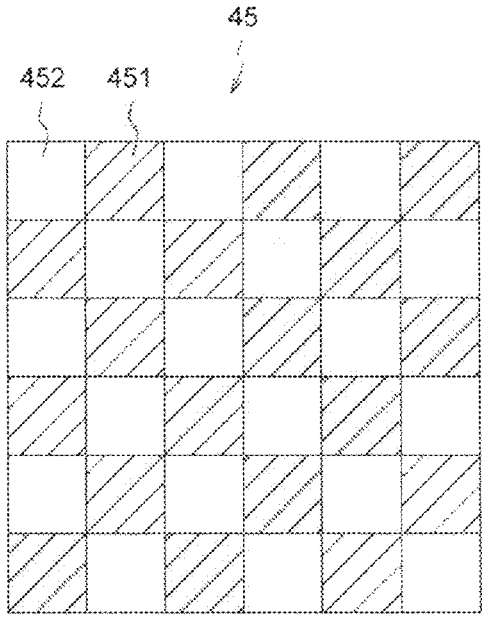
FIG. 16 is a schematic illustrating an output image of the image pattern illustrated in FIG. 15.

FIG. 16 is an output image of the image pattern illustrated in FIG. 15. As illustrated in FIG. 16, by using the above-described method in which the area of the exposed portions is reduced in comparison to the area corresponding to the image portions, the area of the image portions 451 decreases and the area of the non-image portions 452 increases in the output image 45.

If the area of the exposed portions are reduced in comparison to the area corresponding to the image portions and the exposed portions are exposed through the PWM modulation, while the level of the target exposure optical output is maintained at 100 percent output, the integral amount of light for exposing the exposed portions decreases because the area of the exposed portions is simply reduced without changing the optical output or the exposure time. As a result, the image portions 451 in the output image 45 have a low image density.

That is, if the area of the exposed portions are reduced in comparison to the area corresponding to the image portions and the exposed portions are exposed with the target exposure optical output over the target exposure time, and even if the developing processing and the transfer processing are executed ideally, a black-and-white image pattern having the 50 percent area ratio of the image portions cannot be truly output.

In the embodiment, to achieve an image with the target image density in image portions including a line image or a solid image, a latent image is formed with an optical output having a waveform causing the photoconductor to be exposed with an optical output at a level higher than that of the target exposure optical output over an exposure time that is shorter than the target exposure time. In the present embodiment, the waveform of the optical output to expose the photoconductor at a level higher than that of the target exposure optical output over an exposure time that is shorter than the target exposure time is referred to as a time-concentration exposure (TC exposure) waveform.

In the embodiment, an optical output waveform used in forming a latent image may have intermittent OFF sections across the image portion. In other words, in this embodiment, the optical output may be an output having a pulse-like waveform in the image portion.

In the explanation hereunder, exposure of the photoconductor with an optical output at a level higher than the target exposure optical output (first optical output) over an exposure time that is shorter than the target exposure time is referred to as a "concentrated exposure".

In the concentrated exposure according to this embodiment, when the dot density is 1200 dpi, for example, the optical output is set to 200 percent of the target exposure optical output for every pixel in the image portion, and the exposure time is determined by 50 percent of the duty ratio for the target exposure time. For the time of the remaining 50 percent of the duty ratio, the light source is set to OFF in the image portion.

In the concentrated exposure according to the embodiment, when the dot density is 2400 dpi, as another specific example, the optical output is set to 200 percent of the target exposure optical output for one of two adjacent pixels, and the exposure time is set equal to the target exposure time in the image portion. In this case, the remaining pixels are not exposed. This setting is a substantially equivalent of exposing with an optical output of 200 percent of the target exposure optical output over a time period corresponding to a 50-percent duty ratio of the target exposure time when the dot density is 1200 dpi.

Figure 17:
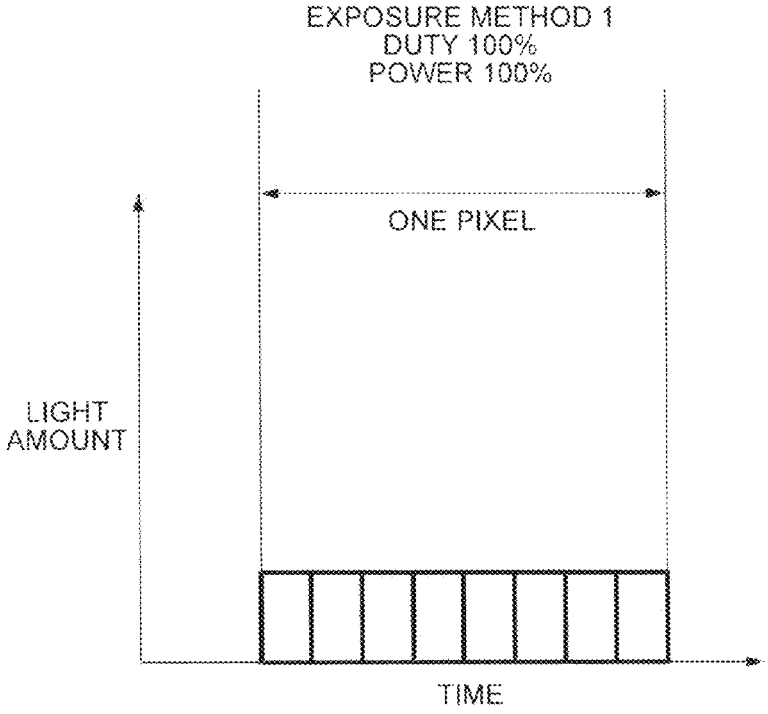
FIG. 17 is a schematic illustrating an exposure method in the reference example.

FIG. 17 is a schematic illustrating the exposure method in the reference example. As illustrated in FIG. 17, the standard exposure in the reference example (hereinafter, referred to as an "exposure method 1") uses a waveform in which the one-dot image portion of a line image or a solid image is exposed with the target exposure optical output over the target exposure time. The target exposure represents an optical output of 100 percent, and the target exposure time represents a duty ratio of 100 percent.

Figure 18:
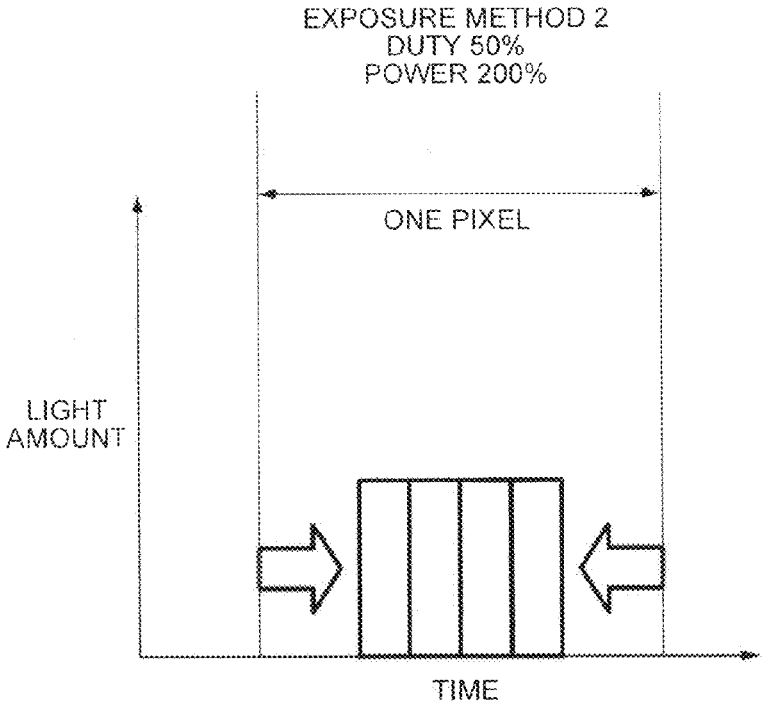
FIG. 18 is a schematic illustrating an example of the image forming method.

FIG. 18 is a schematic illustrating an exemplary image forming method according to the present invention. As illustrated in FIG. 18, in the concentrated exposure used in the embodiment (hereinafter, referred to as "exposure method 2"), the photoconductor is exposed with an optical output of 200 percent of the target exposure optical output at 50 percent of the duty ratio for the target exposure time. Assuming the width of the image portion is one, the width of the exposed section is four-eighth pixels.

Figure 19:
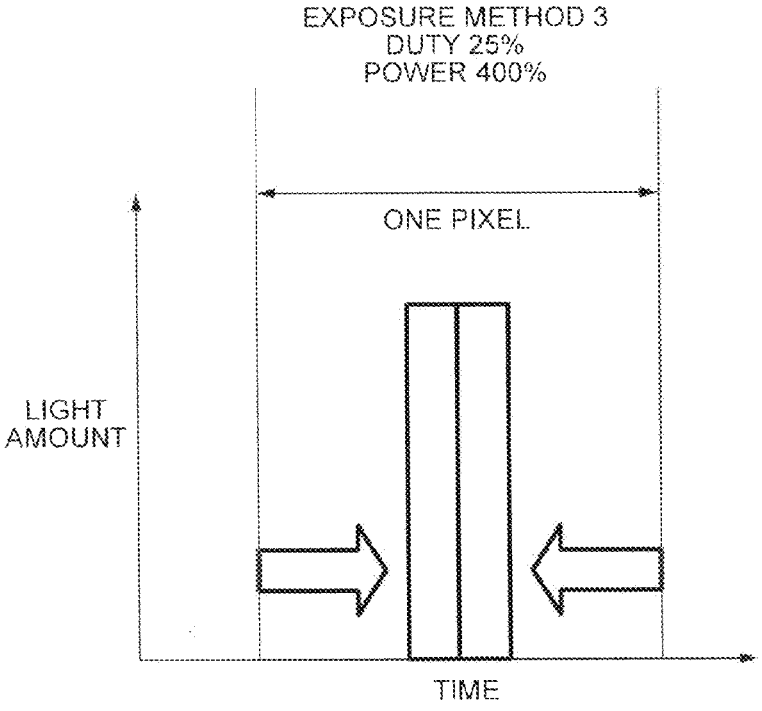
FIG. 19 is a schematic illustrating another example of the image forming method.

FIG. 19 is a schematic illustrating another exemplary image forming method according to the present invention. As illustrated in FIG. 19, in this other concentrated exposure used in the embodiment (hereinafter, referred to as "exposure method 3"), the photoconductor is exposed with an optical output of 400 percent of the target exposure optical output at 25 percent of the duty ratio for the target exposure time. Assuming the width of the image portion is one, the width of the exposed section is two-eighth pixels.

Figure 20:
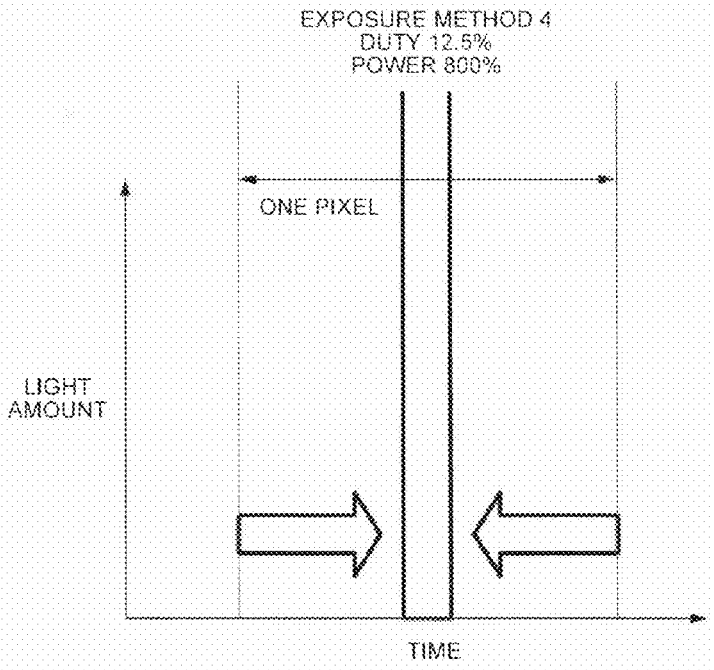
FIG. 20 is a schematic illustrating still another example of the image forming method.

FIG. 20 is a schematic illustrating still another exemplary image forming method according to the present invention. As illustrated in FIG. 20, in the other concentrated exposure used in the embodiment (hereinafter, referred to as "exposure method 4"), the photoconductor is exposed with an optical output of 800 percent of the target exposure optical output at 12.5 percent of the duty ratio for the target exposure time. Assuming the width of the image portion is one, the width of the exposed section is one-eighth pixels.

The exposure methods 2 to 4 explained above use smaller pulse widths than that in the exposure method 1. In the exposure methods 2 to 4, if the image portion is exposed with the same amount of light as that in the exposure method 1, the resultant latent image will be smaller. The amount of light is therefore controlled with the pulse width so that the integral amount of light for forming the latent image becomes equal to that in the standard exposure.

In other words, in the exposure methods 2 to 4 using the concentrated exposure, the image portion is exposed with a larger amount of light at a smaller pulse width, compared with those in the exposure method 1 in which the standard exposure is used.

In the explanation above, in the exposure methods 2 to 4, the optical output is set in such a manner that the integral amount of light remains constant, but the optical output in the image forming method according to the present invention is not limited to these exposure methods.

In the embodiment, the latent image formation capability is evaluated using an evaluation method described later, under the assumptions that the spot size is 70 micrometers in the main-scanning direction by 90 micrometers in the sub-scanning direction, and the photoconductor is exposed with the exposure beam at a pulse width smaller than one pixel. Investigated in this embodiment through this evaluation are ways of exposure allowing the latent image resolving power to be improved without changing the spot size of the exposure beam.

Figure 21:
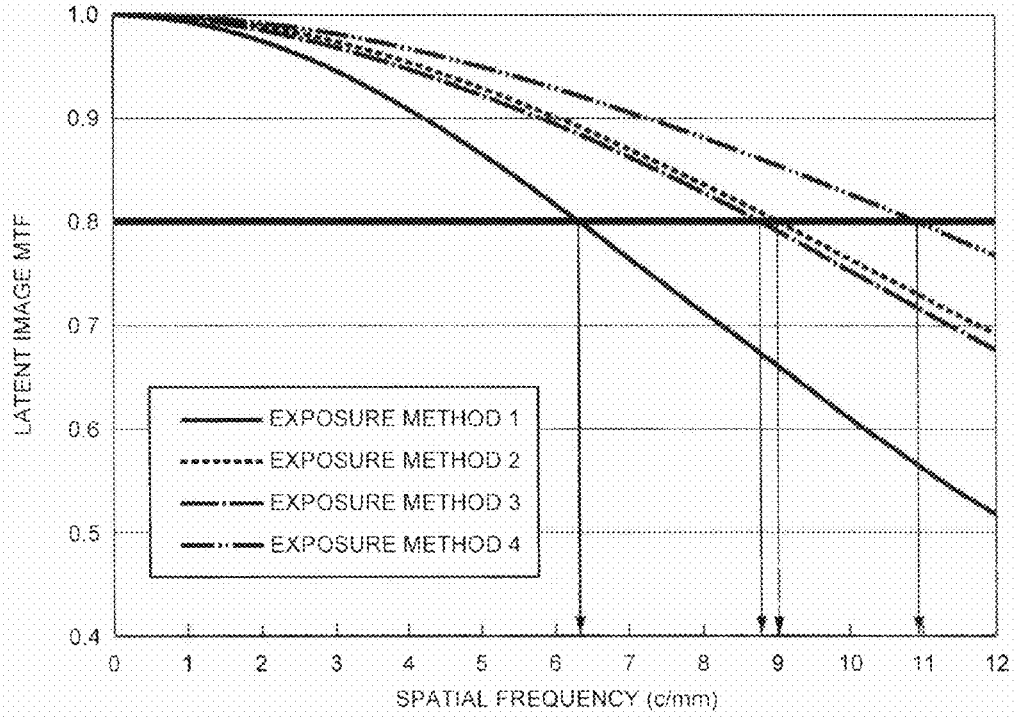
FIG. 21 is a graph indicating spatial frequency characteristics of the different exposure methods.

FIG. 21 is a graph indicating spatial frequency characteristics of the different exposure methods. As illustrated in FIG. 21, the exposure methods 2 to 4 indicate higher modulation transfer function (MTF) up to the high-frequency bandwidth range, compared with the exposure method 1.

The graph of FIG. 21 illustrates that the exposure methods 2 to 4 are capable of forming latent images of smaller sizes stably, compared those achieved with the exposure method 1. Among the exposure methods 2 to 4, FIG. 21 indicates that the exposure method 4 using the shortest pulse width is particularly suitable for stable formations of small-sized latent images.

The graph of FIG. 21 illustrates that the latent image resolving power is improved in the exposure methods 2 to 4 because the photoconductor is exposed with a larger amount of light with a shorter pulse width, compared with the exposure method 1. In other words, with the exposure methods 2 to 4 that are used in the image forming method according to the present invention, smaller latent images can be formed stably, compared with the exposure method 1 used in the conventional image forming method.

Figure 22:
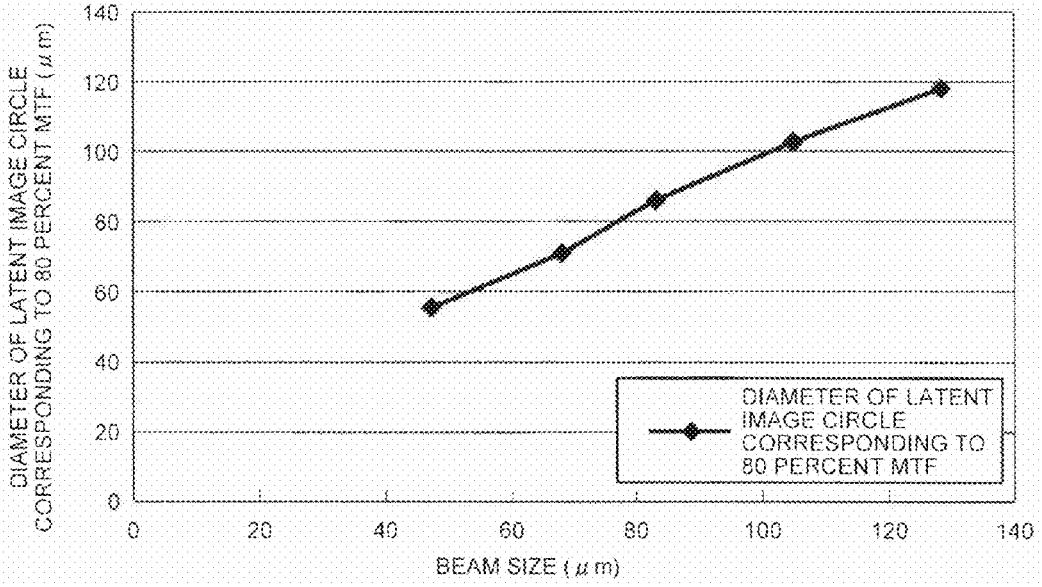
FIG. 22 is a graph indicating a relation between a latent image diameter and a beam spot size.

FIG. 22 is a graph indicating a relation between a latent image diameter and a beam spot size. FIG. 22 indicates a relation between the diameter of a latent image circle corresponding to a latent image MTF of 80 percent, the MTF indicating a latent image dot density, and a beam spot diameter. As indicated in FIG. 22, the latent image resolving power transits almost proportionally to the beam spot size.

In a high-frequency range, that is, when priority is placed on the stability of small-sized latent images, the concentrated exposure method used in the image forming method according to the present invention has an advantage over the conventional exposure method using a smaller beam spot. The optimal beam spot size that is dependent on the output image is determined by the latent image MTF corresponding to the maximum spatial frequency required in the output image.

A characteristic of the concentrated exposure requiring a particular attention is a smaller width of the latent image electric field vector, which means that the resolving power is improved, while the electric field vector in the latent image is increased.

Furthermore, in the image forming method according to the present invention, the integral amount of light remains the same as that of the target exposure optical output, unlike when the exposing light source is controlled with the power modulation or the pulse-width modulation. In the image forming method according to the present invention, the amount of attached toner and the overall image density remain substantially the same as those resulting from the exposure using the target exposure optical output.

Figure 23:
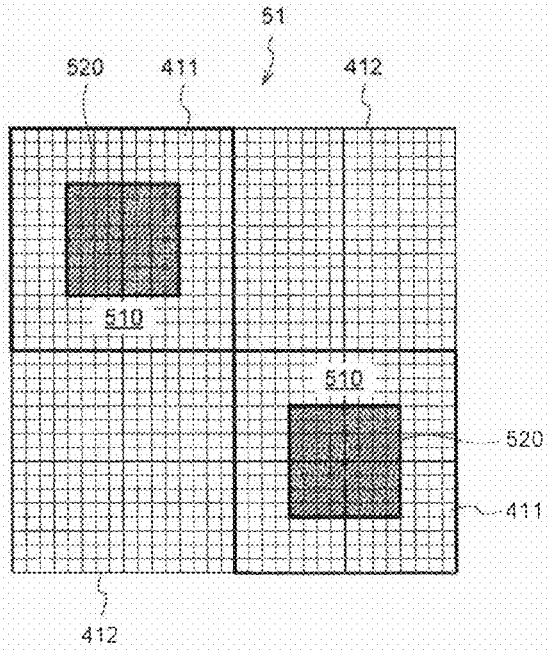
FIG. 23 is a schematic diagram illustrating a partial enlarged view of an example of image patterns used in an image forming method according to the present invention.

FIG. 23 is a schematic diagram illustrating a partial enlarged view of an example of image patterns used in an image forming method according to the present invention. As illustrated in FIG. 23, an image pattern 51 is an image pattern for forming the target output image 40 illustrated in FIG. 10 in the exposure method used in the image forming method according to the present invention. In FIG. 23, only two pairs of an image portion 411 and a non-image portion 412 are illustrated in an enlarged view out of the combinations of the image portion 411 and the non-image portion 412 making up the target output image after the exposure.

In FIG. 23, a group of pixels that are not adjacent to at least the non-image portion 412 and includes the central part of the image portion 411 out of the pixels making up the image portion 411 is referred to as an exposed portion 520. The exposed portion 520 is a group of pixels that are intensively exposed with an optical output at a level higher than that of the target exposure optical output (a first optical output). The first optical output is 400 percent of the target exposure optical output and the number of dots of the exposed portion 520 is eight-by-eight when the dot density is 4800 dpi.

A group of the pixels that are adjacent to the non-image portion 412 that is not exposed with the first optical output out of the pixels making up the image portion 411 is referred to as a non-exposed portion 510. The non-exposed portion 510 is not exposed together with the area making up the non-image portions in the target output image.

The non-exposed portion 510 differs from the non-image portion 412 to which the toner is not attached after the exposure. The non-exposed portion 510 is a group of pixels surrounding the exposed portion 520. Although the non-exposed portion 510 is not exposed with an optical output, the electric charge on the exposed portion 520 diffuses after the exposure, whereby the toner is attached on the non-exposed portion 510. That is, the non-exposed portion 510 is a group of pixels making up the image portion 411.

When the exposed portion 520 is exposed, the electric charge diffuses from the central part of the exposed portion 520 to the non-exposed portion 510. After the exposure, the exposed portion 520 and the non-exposed portion 510 form the image portion 411. The position of the pixels of the exposed portion 520 in the image portion 411 is determined in consideration of (in anticipation of) the electric charge diffusion rate corresponding to the electric charge diffusion from the exposed pixels in the image pattern 51 so that the expansion of the image portions resulting from the electric charge diffusion from the exposed pixels can be suppressed in the output image.

Figure 24:
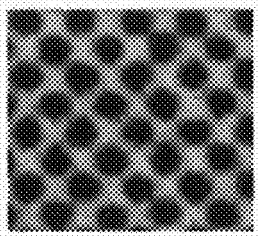
FIG. 24 is an output image of the image pattern illustrated in FIG. 23.

FIG. 24 is an output image of the image pattern illustrated in FIG. 23. As illustrated in FIG. 24, if the exposed portions having very small dots are intensively exposed with an optical output of 400 percent of the target exposure optical output, the actual output image has no smear from the image portions to the non-image portions resulting from the electric charge diffusion during the exposure. As a result, the target output image can be truly reproduced.

In the present embodiment, however, the electric charges may not reach the non-exposed portions in the area corresponding to the image portions because the amount of the electric charge diffusion is small depending on the beam size, the characteristics of the photoconductor such as the film thickness, or the moving speed of the beam. In this case, it is preferred that the output ratio of the first optical output to the target exposure optical output of the beam exposing the exposed portion is decreased so that the area of the exposed portion increases.

That is, in the present embodiment, the area of the exposed portions and the first optical output may take different values other than the above-described values.

Figure 25:
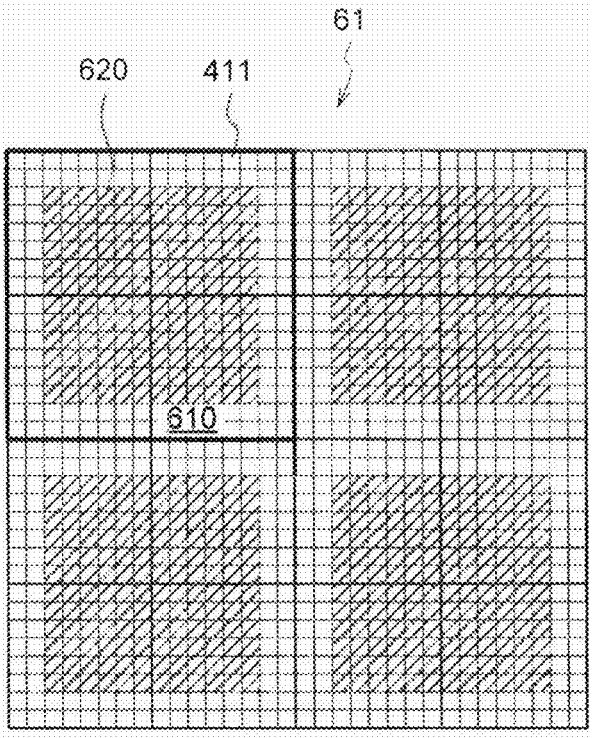
FIG. 25 is a schematic diagram illustrating a partial enlarged view of another example of image patterns used in the above-described image forming method.

FIG. 25 is a schematic diagram illustrating a partial enlarged view of another example of an image pattern 61 used in the image forming method according to the present invention. In FIG. 25, an exposed portion 620 is exposed with a first optical output of 178 percent of the target exposure optical output and the number of dots of the exposed portion 620 is 12-by-12 when the dot density is 4800 dpi.

Figure 26:
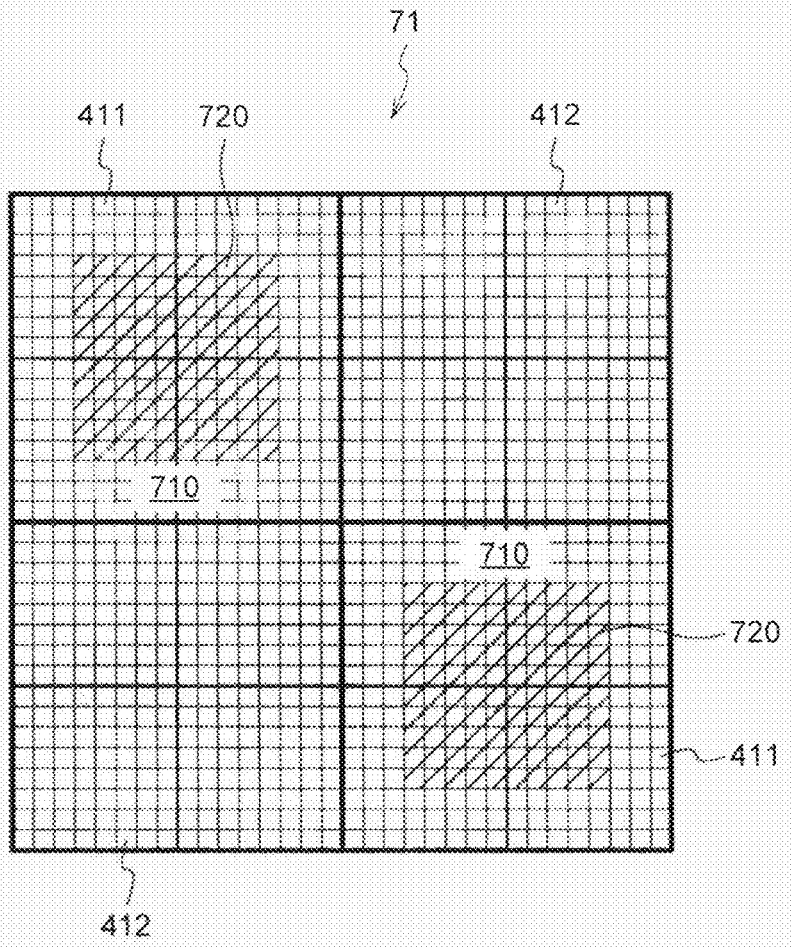
FIG. 26 is a schematic diagram illustrating a partial enlarged view of still another example of image patterns used in the above-described image forming method.

FIG. 26 is a schematic diagram illustrating a partial enlarged view of still another example of an image pattern 71 used in the image forming method according to the present invention. In FIG. 26, an exposed portion 720 is exposed with a first optical output of 256 percent of the target exposure optical output and the number of dots of the exposed portion 720 is 10-by-10 when the dot density is 4800 dpi.

Example of Forming Vertical Line Images

The following describes examples of forming vertical line images with the exposure method according to the present embodiment. In the descriptions below, the X-axial direction represents the lateral direction and the Y-axial direction represents the longitudinal direction in the drawings.

Figure 27A:
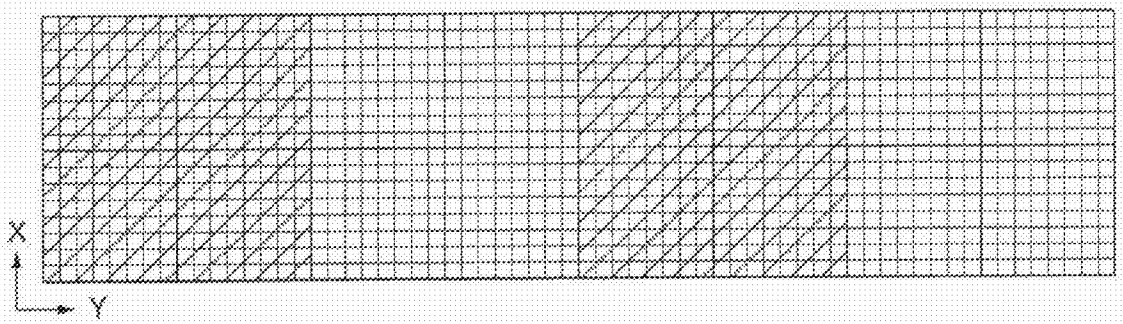
FIGS. 27A to 27C are schematic diagrams illustrating exemplary image patterns having vertical lines used in the above-described image forming method.
Figure 27B:
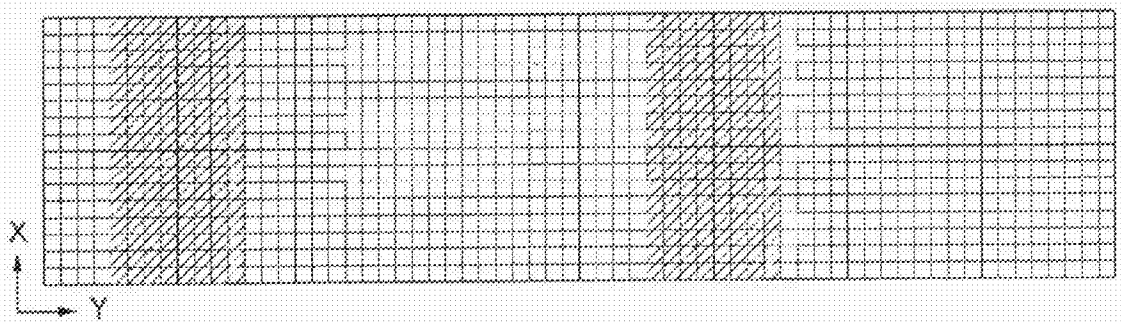
Figure 27C:
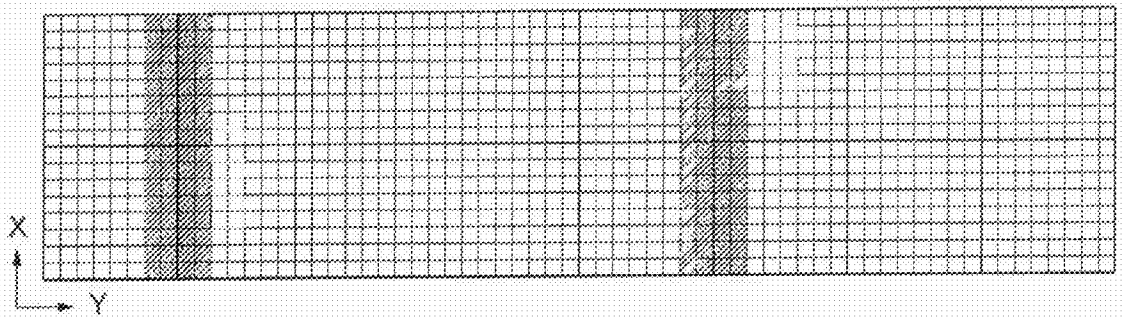

FIGS. 27A to 27C are schematic diagrams illustrating exemplary image patterns having vertical lines used in the image forming method according to the present embodiment. The image patterns illustrated in FIGS. 27A to 27C each have minimum pixel density of 4800 dpi, a spatial frequency of 6 c/mm, and a thick vertical line (a line in the Y-axial direction) every eight-by-eight dot (corresponding to 600 dpi). The size of one pixel is about five micrometers.

In the image pattern illustrated in FIG. 27A, the exposed portions exposed with the target exposure optical output over the target exposure time and the non-image portions are disposed repeatedly every two dots when the dot density is 600 dpi, that is, every 16 dots when the dot density is 4800 dpi in the X-axial direction.

In the image pattern illustrated in FIG. 27B, the non-exposed portion and the portion including the non-image portion are repeatedly disposed at intervals of 24-dot width of the exposed portion exposed with a first optical output of 200 percent of the target exposure optical output when the dot density is 4800 dpi in the X-axial direction. In this case, the width (the length in the X-axial direction) of the vertical line image pattern thus formed is about 43 micrometers, half the width of the vertical line image pattern illustrated in FIG. 27A.

In the image pattern illustrated in FIG. 27C, four-dot exposed portions exposed with a first optical output of 400 percent of the target exposure optical output are disposed repeatedly at intervals of the 28-dot width of the non-exposed portion and the portion including the non-image portion when the dot density is 4800 dpi in the X-axial direction. In this case, the width (the length in the X-axial direction) of the vertical line image pattern thus formed is about 20 micrometers, a quarter of the width of the vertical line image pattern illustrated in FIG. 27A.

Figure 28A:
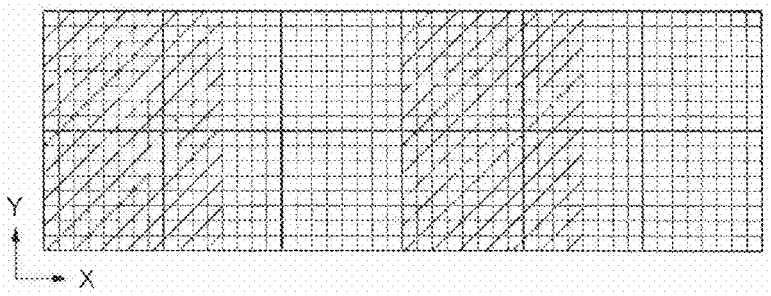
FIGS. 28A to 28C are schematic diagrams illustrating other exemplary image patterns having vertical lines used in the above-described image forming method.
Figure 28B:
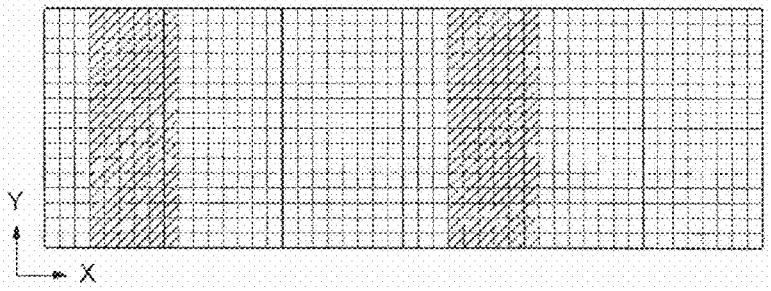
Figure 28C:
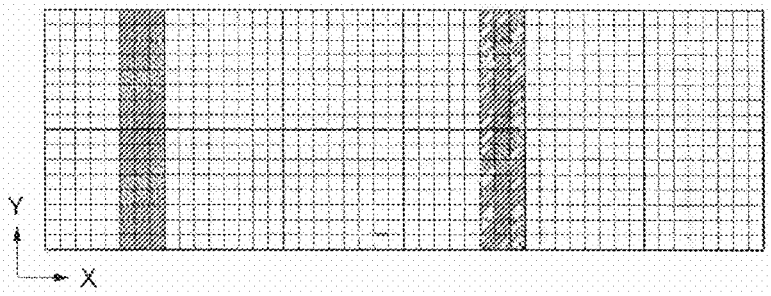

FIGS. 28A to 28C are schematic diagrams illustrating other exemplary image patterns having vertical lines according to the present embodiment. The image patterns illustrated in FIGS. 28A to 28C each have a minimum pixel density of 4800 dpi, a spatial frequency of 8 c/mm, and a thick vertical line (a line in the Y-axial direction) every 12 dots when the dot density is 4800 dpi.

In the image pattern illustrated in FIG. 28A, the exposed portions exposed with the target exposure optical output over the target exposure time and the non-image portions are disposed repeatedly every 12 dots when the dot density is 4800 dpi in the X-axial direction.

In the image pattern illustrated in FIG. 28B, the 18-dot width of the non-exposed portion and the portion including the non-image portion are repeatedly disposed at intervals of the 6-dot width of the exposed portion exposed with a first optical output of 200 percent of the target exposure optical output when the dot density is 4800 dpi in the X-axial direction. In this case, the width (the length in the X-axial direction) of the vertical line image pattern thus formed is half the width of the vertical line image pattern illustrated in FIG. 28A.

In the image pattern illustrated in FIG. 28C, three-dot exposed portions exposed with a first optical output of 400 percent of the target exposure optical output are disposed repeatedly at intervals of the 29-dot width of the non-exposed portion and the portion including the non-image portion when the dot density is 4800 dpi in the X-axial direction. In this case, the width (the length in the X-axial direction) of the vertical line image pattern thus formed is a quarter of the width of the vertical line image pattern illustrated in FIG. 28A.

Figure 29A:
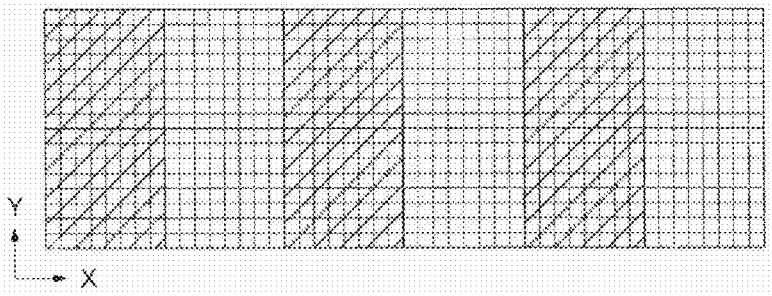
FIGS. 29A to 29C are schematic diagrams illustrating still other exemplary image patterns having vertical lines used in the above-described image forming method.
Figure 29B:
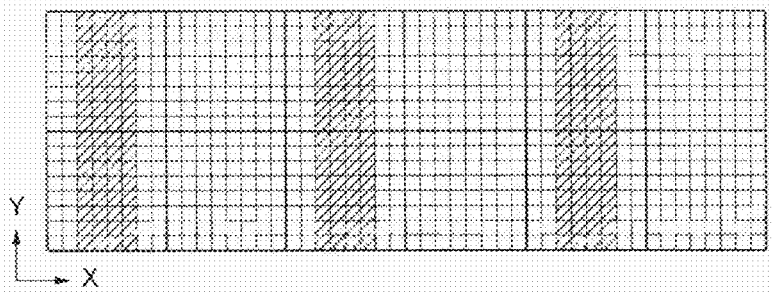
Figure 29C:
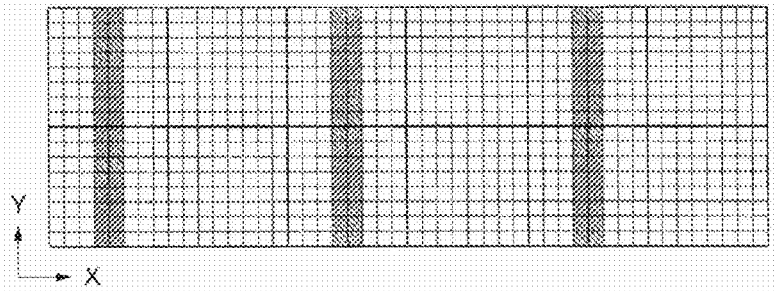

FIGS. 29A to 29C are schematic diagrams illustrating still other exemplary image patterns having vertical lines according to the present embodiment. The image patterns illustrated in FIGS. 29A to 29C each have a minimum pixel density of 4800 dpi, a spatial frequency of 12 c/mm, and a thick vertical line (a line in the Y-axial direction) every eight dots when the dot density is 4800 dpi.

In the image pattern illustrated in FIG. 29A, the exposed portions exposed with the target exposure optical output over the target exposure time and the non-image portions are disposed repeatedly every 8 dots when the dot density is 4800 dpi in the X-axial direction.

In the image pattern illustrated in FIG. 29B, the 12-dot width of the non-exposed portion and the portion including the non-image portion are repeatedly disposed at intervals of the 4-dot width of the exposed portion exposed with a first optical output of 200 percent of the target exposure optical output when the dot density is 4800 dpi in the X-axial direction. In this case, the width (the length in the X-axial direction) of the vertical line image pattern thus formed is half the width of the vertical line image pattern illustrated in FIG. 29A.

In the image pattern illustrated in FIG. 29C, two-dot exposed portions exposed with a first optical output of 400 percent of the target exposure optical output are disposed repeatedly at intervals of the 14-dot width of the non-exposed portion and the portion including the non-image portion when the dot density is 4800 dpi in the X-axial direction. In this case, the width (the length in the X-axial direction) of the vertical line image pattern thus formed is a quarter of the width of the vertical line image pattern illustrated in FIG. 29A.

Figure 30:
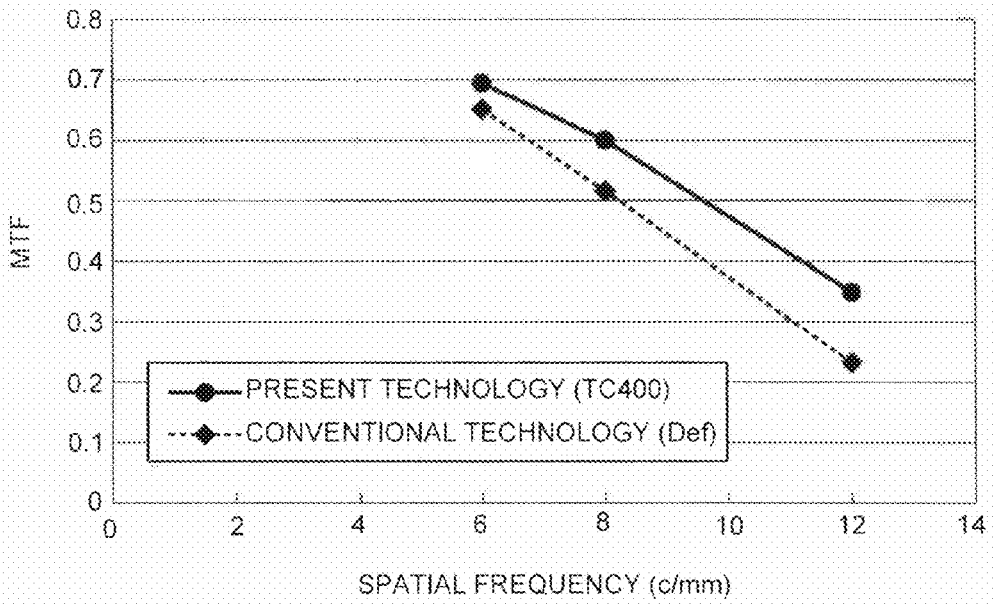
FIG. 30 is a graph indicating measurement results of modulation transfer function (MTF) in the longitudinal direction.

FIG. 30 is a graph indicating measurement results of a latent image modulation transfer function (MTF) in the longitudinal direction. FIG. 30 illustrates the resulting values of the MTF analysis on the respective output images on paper obtained by exposing the vertical line image pattern illustrated in FIGS. 27C, 28C, and 29C with a first optical output of 400 percent of the target exposure optical output, respectively. FIG. 30 illustrates that the MFT values are higher on the respective output images having different width of vertical lines obtained with the exposure method according to the present embodiment than the MFT values on the respective output images obtained with the exposure method according to the conventional technology.

FIG. 30 apparently illustrates the advantageous effect that the MTF value increases with increasing frequency.

In the PM modulation in which an optical output P1 larger than the target exposure optical output P0 for forming a solid image density can be used as described above, the ratio TCR of the optical output is determined as TCR=P1/P0.

In this case, in the exposure method according to the present embodiment, the width of the vertical line is reduced to 1/TCR and the exposure is executed with a higher optical output than the target exposure optical output used for forming a solid image density. As a result, with the exposure method according to the present embodiment, forming an image with a higher MTF resolution can be achieved.

Examples of Forming Horizontal Line Images

The following describes examples of forming horizontal line images with the exposure method according to the present embodiment.

Figure 31A:
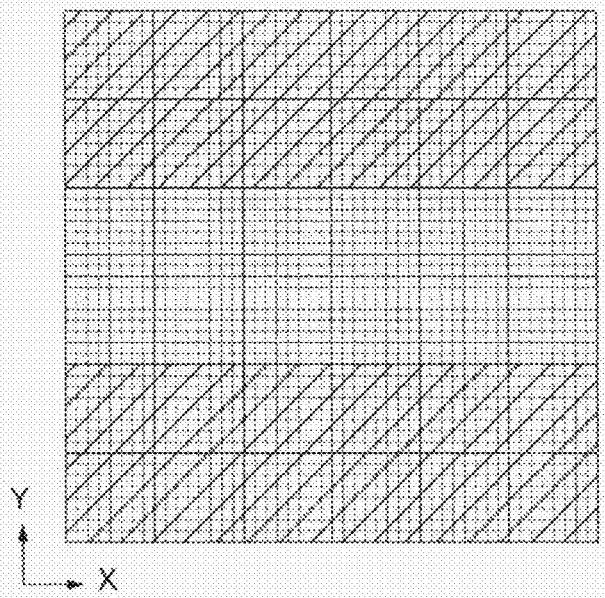
FIGS. 31A and 31B are schematic diagrams illustrating exemplary image patterns having horizontal lines used in the above-described image forming method.
Figure 31B:
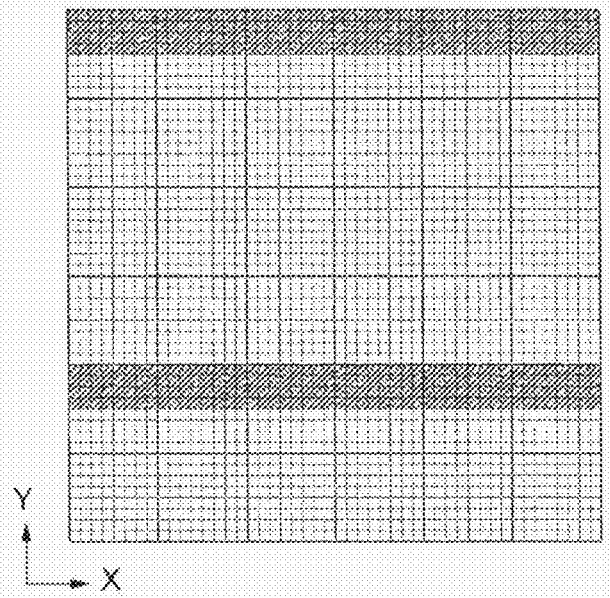

FIGS. 31A and 31B are schematic diagrams illustrating exemplary image patterns having horizontal lines used in the image forming method according to the present embodiment. The image patterns illustrated in FIGS. 31A and 31B each have a minimum pixel density of 4800 dpi, a spatial frequency of 6 c/mm, and a thick horizontal line (a line in the Y-axial direction) every 16 dots.

In the image pattern illustrated in FIG. 31A, the exposed portions exposed with the target exposure optical output over the target exposure time and the non-image portions are disposed repeatedly every 16 dots when the dot density is 4800 dpi in the Y-axial direction.

In the image pattern illustrated in FIG. 31B, the 28-dot width of the non-exposed portion and the portion including the non-image portion are repeatedly disposed at intervals of the exposed portion exposed with a first optical output of 400 percent of the target exposure optical output when the dot density is 4800 dpi in the Y-axial direction. In this case, the width of the horizontal line image pattern thus formed is a quarter of the width of the horizontal line image pattern illustrated in FIG. 31A.

Figure 32A:
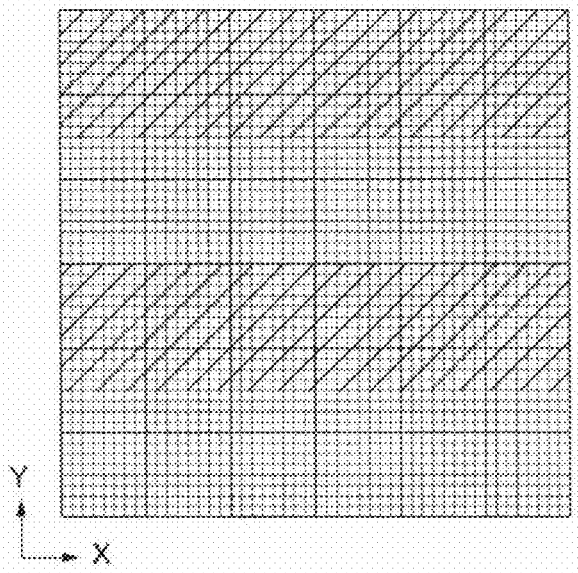
FIGS. 32A and 32B are schematic diagrams illustrating other exemplary image patterns having horizontal lines used in the above-described image forming method.
Figure 32B:
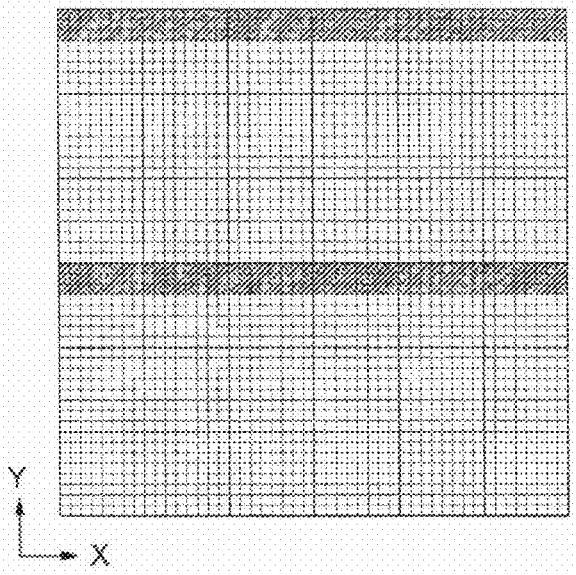

FIGS. 32A and 32B are schematic diagrams illustrating other exemplary image patterns having horizontal lines according to the present embodiment. The image patterns illustrated in FIGS. 32A and 32B each have a minimum pixel density of 4800 dpi, a spatial frequency of 8 c/mm, and a thick horizontal line (a line in the X-axial direction) every 12 dots when the dot density is 4800 dpi.

In the image pattern illustrated in FIG. 32A, the exposed portions exposed with the target exposure optical output over the target exposure time and the non-image portions are disposed repeatedly every 12 dots when the dot density is 4800 dpi in the Y-axial direction.

In the image pattern illustrated in FIG. 32B, the 21-dot width of the non-exposed portion and the portion including the non-image portion are repeatedly disposed at intervals of the exposed portion exposed with a first optical output of 400 percent of the target exposure optical output when the dot density is 4800 dpi in the Y-axial direction. In this case, the width (the length the Y-axial direction) of the horizontal line image pattern thus formed is a quarter of the width of the horizontal line image pattern illustrated in FIG. 32A.

Figure 33A:
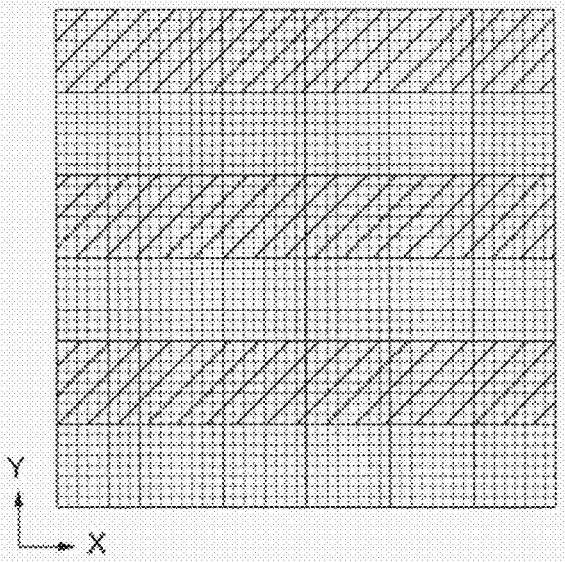
FIGS. 33A and 33B are schematic diagrams illustrating still other exemplary image patterns having horizontal lines used in the above-described image forming method.
Figure 33B:
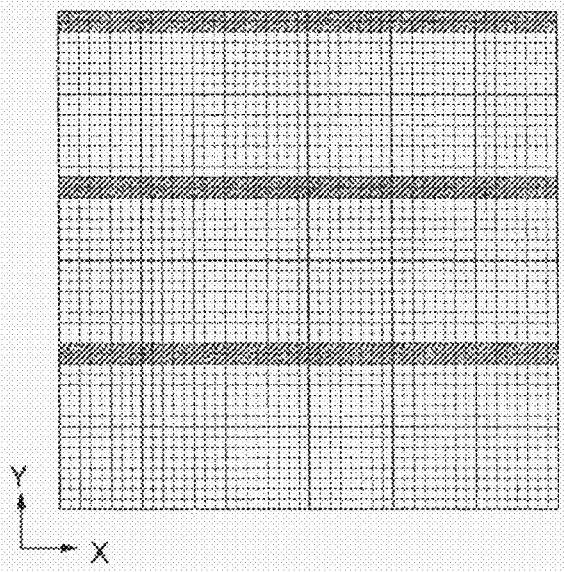

FIGS. 33A and 33B are schematic diagrams illustrating still other exemplary image patterns having horizontal lines according to the present embodiment. The image patterns illustrated in FIGS. 33A and 33B each have a minimum pixel density of 4800 dpi, a spatial frequency of 12 c/mm, and a thick horizontal line (a line in the Y-axial direction) every 8 dots.

In the image pattern illustrated in FIG. 33A, the exposed portions exposed with the target exposure optical output over the target exposure time and the non-image portions are disposed repeatedly every eight dots when the dot density is 4800 dpi in the Y-axial direction.

In the image pattern illustrated in FIG. 33B, the 14-dot width of the non-exposed portion and the portion including the non-image portion are repeatedly disposed at intervals of the exposed portion exposed with a first optical output of 400 percent of the target exposure optical output when the dot density is 4800 dpi in the Y-axial direction. In this case, the width (the length the Y-axial direction) of the horizontal line image pattern thus formed is a quarter of the width of the horizontal line image pattern illustrated in FIG. 33A.

If the beam used for the exposure in the image forming apparatus is a multi-beam laser such as a vertical cavity surface emitting laser (VCSEL), the writing can be achieved in high density also in the sub-scanning direction (the lateral direction). With the exposure method according to the present embodiment, therefore, forming an image with a higher resolution can be achieved by reducing the image pattern in the sub-scanning direction in the same manner as the main-scanning direction using the first optical output.

Figure 34:
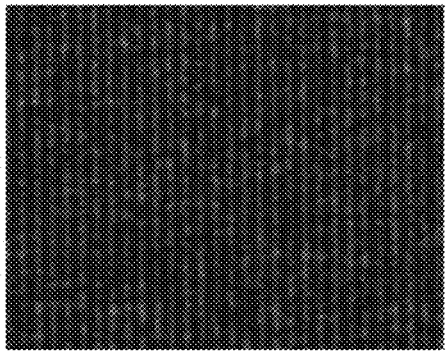
FIG. 34 is an output image of the image pattern illustrated in FIG. 33A.
Figure 35:
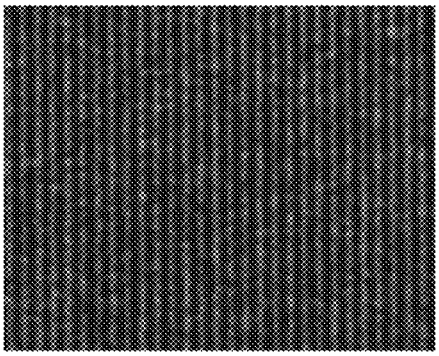
FIG. 35 is an output image of the image pattern illustrated in FIG. 33B.

FIG. 34 is an output image of the image pattern illustrated in FIG. 33A. FIG. 35 is an output image of the image pattern illustrated in FIG. 33B. It is apparent that the output image illustrated in FIG. 35 exposed with a first optical output of 400 percent of the target exposure optical output has a higher resolving power in comparison to the output image illustrated in FIG. 34 exposed with the target exposure optical output over the target exposure time.

Figure 36:
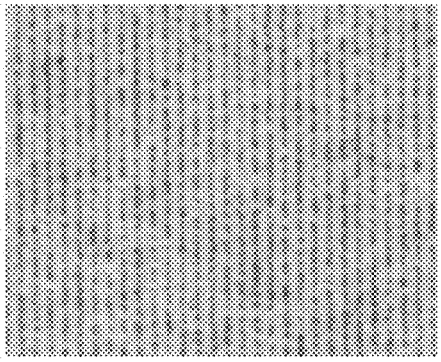
FIG. 36 is an output image of still another image pattern.

FIG. 36 is an output image of still another image pattern according to the reference example. The output image illustrated in FIG. 36 is obtained by exposing the same image pattern as FIG. 35 with a light controlled through the PWM modulation with the target exposure optical output over the target exposure time.

As illustrated in FIG. 36, if the width of the lines in the image pattern to be exposed is reduced without controlling the optical output, the latent image having the smaller depth of the latent image is formed because the amount of light is insufficient.

That is, if the width of the lines in the image pattern to be exposed is reduced without controlling the optical output, a faint line image having a low density is formed, whereby high-quality images cannot be achieved.

FIG. 35 illustrates that the exposure method according to the present embodiment is based on an ultimately different technical concept from the conventional image-improvement method for improving image patterns such as thinning processing and so on illustrated in FIGS. 34 and 36.

Figure 37:
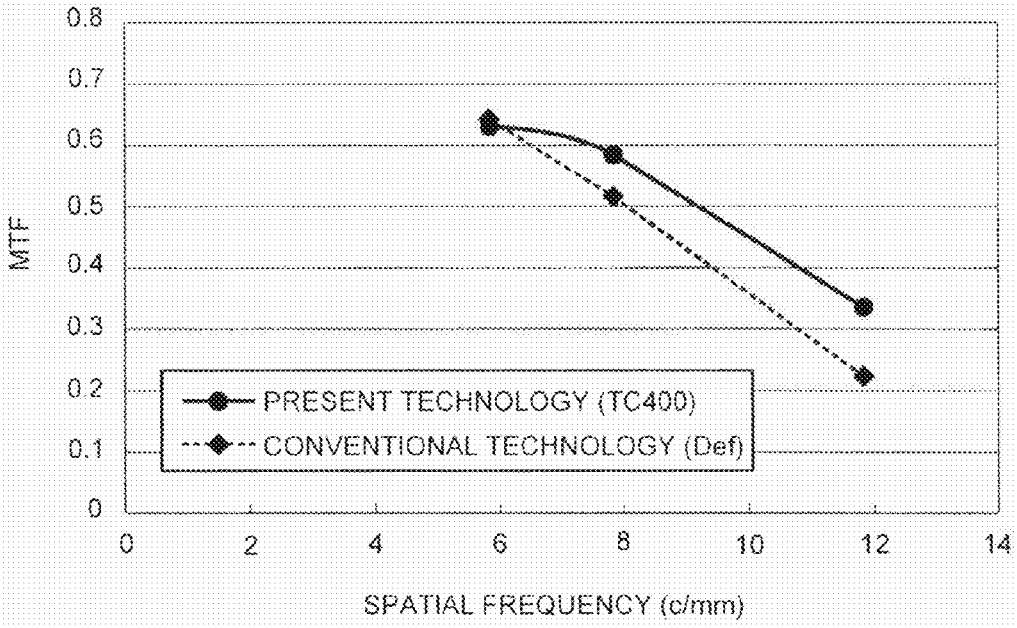
FIG. 37 is a graph indicating measurement results of MTF in the lateral direction.

FIG. 37 is a graph indicating measurement results of latent image MTF in the lateral direction. FIG. 37 illustrates the resulting values of the MTF analysis on the respective output images on paper obtained by exposing the horizontal line image patterns illustrated in FIGS. 31B, 32B, and 33B with a first optical output of 400 percent of the target exposure optical output, respectively. FIG. 37 illustrates that the MFT values are higher on the respective output images having different width of horizontal lines obtained with the exposure method according to the present embodiment than the MFT values on the respective output images obtained with the exposure method according to the conventional technology.

FIG. 37 apparently illustrates the advantageous effect that the MTF value increases with increasing frequency.

That is, FIGS. 36 and 37 illustrate that the characteristics of the MTF is superior both in the vertical line and the horizontal line in the output image formed with the exposure method according to the present embodiment than the output image formed with the conventional exposure method.

Conversion Setting on Image Signals

The following describes a setting in which an input image signal is converted into an image pattern with the exposure method according to the present embodiment using the image patterns having vertical lines illustrated in FIGS. 27A to 27C. In the descriptions below, the minimum pixel density is 2400 dpi.

In the image pattern illustrated in FIG. 27A has a spatial frequency of 6 c/mm in the longitudinal direction. In other words, the image pattern has two dots when the dot density is 600 dpi, which corresponds to eight dots when the dot density is 2400 dpi. In the image pattern therefore the exposed portion and the non-exposed portion are disposed repeatedly every eight dots. That is, the image pattern illustrated in FIG. 27A has an output signal represented by 11111111000000001111111100000000 . . . . The number "1" in the output signal represents that an output value equivalent to the target exposure optical output is used over the target exposure time. The number "0" in the output signal represents that the output value equals to 0 percent of the target exposure optical output.

In the image pattern illustrated in FIG. 27B, eight dots in the exposed portion are aggregated into four dots. That is, the image pattern illustrated in FIG. 27B has an output signal represented by 22220000000000002222000000000000 . . . . The number "2" in the output signal represents that the output value equals to 200 percent of the target exposure optical output.

In the image pattern illustrated in FIG. 27C, eight dots in the exposed portion are aggregated into two dots. That is, the image pattern illustrated in FIG. 27C has an output signal represented by 44000000000000004400000000000000 . . . . The number "4" in the output signal represents that the output value equals to 400 percent of the target exposure optical output.

In the image pattern illustrated in FIG. 27A, if the output value equals to 300 percent of the target exposure optical output, eight dots in the exposed portion are aggregated into three dots. That is, the image pattern illustrated in FIG. 27A may have an output signal represented by 33200000000000033200000000000000 . . . .

Maximum Width Setting on Exposed Portion

The following describes a setting on the maximum width of the exposed portion used in the exposure method according to the present embodiment.

In the exposure method according to the present embodiment, the width of the exposed portion has the upper limit. The reason is that if the exposed portion in an area larger than the upper limit is exposed with a high-value optical output, the electric charges do not fully diffuse to the exposed portion, causing the toner not to attach fully to the exposed portion, whereby the output image itself deforms.

To address this issue, in the exposure method according to the present embodiment, the maximum width of the exposed portion Wmax is set.

The maximum width Wmax serving as the upper limit of the width of the exposed portion depends on the diffusion of the electric charges resulting from the beam size or the film thickness of the photoconductor. The maximum width Wmax is preferably set to, for example, about two to three dots when the dot density is 600 dpi, that is, about 85 micrometers usually.

If the width of the line to be exposed is equal to or larger than the maximum width Wmax, the line may be exposed with a higher optical output value than the target exposure optical output with the exposure method according to the present embodiment for every maximum width Wmax in the line.

Specifically, if the line image has the four-dot width when the dot density is 600 dpi, the line image may be exposed with a high optical output value with the exposure method according to the present embodiment for every two-dot width of the line repeatedly.

If the exposed portion is set to 16 dots when the dot density is 2400 dpi, the output signal is represented by 1111111111111111000000000000000 with the conventional exposure method.

If the exposed portion is exposed with an output value equal to 400 percent of the target exposure optical output with the exposure method according to the present embodiment, the exposed portion is divided into groups of eight dots, then the output signal is converted into 44000000440000000000000000000000.

With the above-described exposure method according to the present embodiment, the image portion is formed by exposing the exposed portion with a higher optical output value than the target exposure optical output over a shorter time period than the target exposure time. As a result, higher-quality images with a higher-resolution can be achieved than the images formed with the conventional exposure method.

The density of writing is not limited to 4800 dpi in the exposure method according to the present embodiment. If the density of writing in sub-scanning is equal to or smaller than 2400 dpi, the exposure is executed within the restriction with the exposure method according to the present embodiment, thereby forming higher-quality images with a higher-resolution than images formed with the conventional method.

The direction of the line is not limited to the above-described longitudinal or lateral direction in the exposure method according to the present embodiment. For another example, a diagonal line may be exposed with the exposure method according to the present embodiment to form higher-quality images with a higher-resolution than images formed with the conventional method.

Furthermore, the position of the exposed portion is not limited to the above-described position (left-aligned) in the exposure method according to the present embodiment. For another example, the position of the exposed portion may be center-aligned in the exposure method according to the present embodiment.

With the above-described image forming method according to the present invention, the quality of outlined images can be improved without reducing the dot density, while maintaining the image density of the black background by exposing the exposed portions corresponding to the image portions with an optical output at a level higher than that of the target exposure optical output over an exposure time that is shorter than the target exposure time.

Furthermore, with the image forming method according to the present invention, a deep latent image electric field can be formed by exposing the exposed portions corresponding to the image portions with an optical output at a level higher than that of the target exposure optical output over an exposure time that is shorter than the target exposure time.

Furthermore, with the image forming method according to the present invention, because latent images with a smaller width can be formed, the latent image resolving power can be improved by exposing the exposed portions corresponding to the image portions with an optical output at a level higher than that of the target exposure optical output over an exposure time that is shorter than the target exposure time.

Furthermore, with the image forming method according to the present invention, because the integral amount of light remains constant through controlling the optical output for exposing the exposed portions, the same image density as that of the standard exposure can be achieved.

In the image forming method according to the present invention, the length of each OFF section (a section not exposed) in an image portion is 10 micrometers or so. In other words, because each OFF section in an image portion is sufficiently smaller than the beam spot size, the toner can be attached to the entire image portion, considering the spread of the electrical charges in the image portion.

With the image forming method according to the present invention, therefore, high quality solid image can be formed as well.

Furthermore, with the image forming method according to the present invention, the exposure time can be one pixel or less. In other words, with the image forming method according to the present invention, what is called droop, which is an image-dependent variation in the optical output in the conventional exposure method, can be removed. Furthermore, the image forming method according to the present embodiment uses partial pixels of the image portion as the image pixels for image forming, and performs the concentrated-exposure on the image pixels. Therefore, with the image forming method according to the present embodiment, the image resolving power can be improved while maintaining image density.

Image Forming Method (2)

The following describes some approaches to the exposure in the image forming method according to another embodiment of the present invention. The explanation will be mainly made of differences from the above-described embodiment.

In the exposure method according to the present embodiment, in the same manner as the above-described exposure method, the target output image 40 is output that is a lattice pattern image including image portions 411 represented with black portions and non-image portions 412 represented with white portions and the area ratio of the image portions is 50 percent of the entire image as illustrated in FIG. 10.

In the exposure method according to the present embodiment, the exposed portion is exposed with an optical output of 400 percent of the target exposure optical output at 25 percent of the duty ratio for the target exposure time. That is, in the exposure method according to the present embodiment, the integral amount of light exposing the exposed portion is the same as the integral amount of light when the target exposure optical output is used over the target exposure time.

Figure 38:
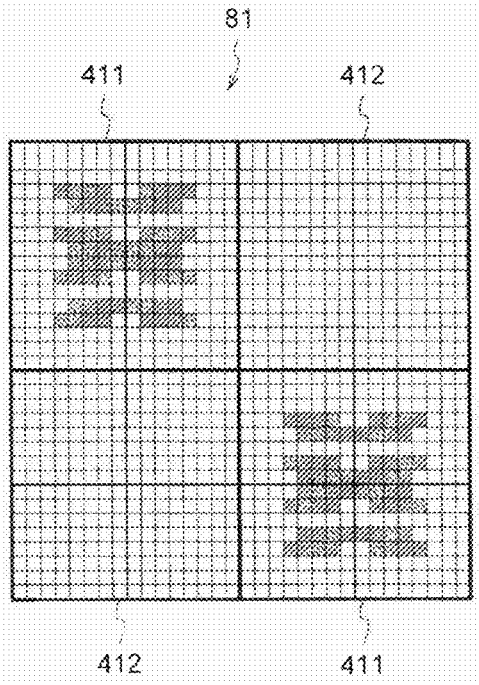
FIG. 38 is a schematic diagram illustrating a partial enlarged view of an example of image patterns used in the above-described image forming method.

FIG. 38 is a schematic diagram illustrating a partial enlarged view of an example of an image pattern 81 used in an image forming method according to the present invention. As illustrated in FIG. 38, in an image pattern 81, the pixels on the positions corresponding to the electric charge diffusion from the exposed pixels are exposed as the exposed portions (the hatched portions in the image portion 411) rather than all of the pixels in the range of 10-by-10 dot when the dot density is 4800 dpi out of the pixels making up the image portion 411.

Figure 39:
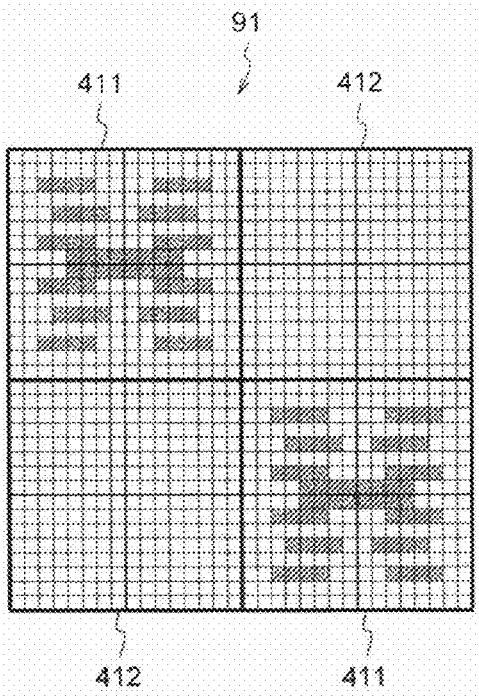
FIG. 39 is a schematic diagram illustrating a partial enlarged view of another example of image patterns used in the above-described image forming method.

FIG. 39 is a schematic diagram illustrating a partial enlarged view of another example of an image pattern 91 used in the image forming method according to the present invention. As illustrated in FIG. 39, in the image pattern 91, the pixels on the positions corresponding to the electric charge diffusion from the exposed pixels are exposed as the exposed portions (the hatched portions in the image portion 411) rather than all of the pixels in the range of 12-by-12 dot when the dot density is 4800 dpi out of the pixels making up the image portion 411.

Figure 40:
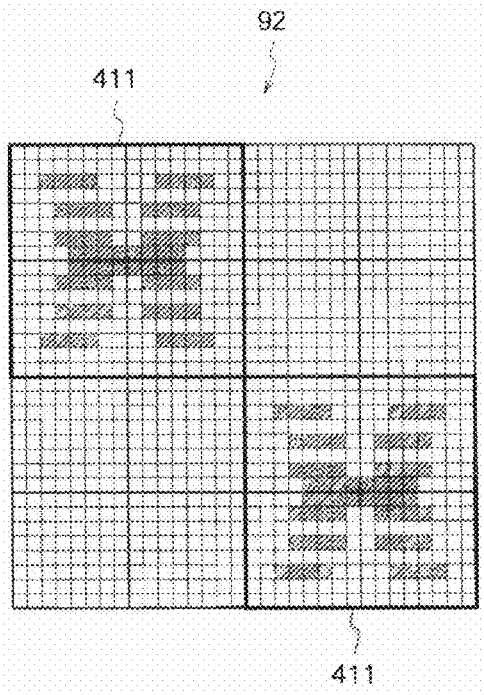
FIG. 40 is a schematic diagram illustrating a partial enlarged view of still another example of image patterns used in the above-described image forming method.

FIG. 40 is a schematic diagram illustrating a partial enlarged view of another example of an image pattern 92 used in the image forming method according to the present invention. As illustrated in FIG. 40, in the image pattern 92, the pixels on the positions corresponding to the electric charge diffusion from the exposed pixels are exposed as the exposed portions (the hatched portions in the image portion 411) rather than all of the pixels in the range of 12-by-12 dot when the dot density is 4800 dpi out of the pixels making up the image portion 411.

In FIGS. 38 to 40, the position of the pixels of the exposed portions (the hatched portions) is determined in consideration of (in anticipation of) the electric charge diffusion rate so that the expansion of the exposed portions 411 to the non-image portions 412 resulting from the electric charge diffusion from the exposed portions can be suppressed in the output image, in the same manner as the above-described exposure method.

Figure 41:
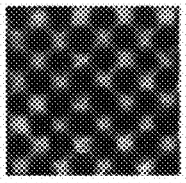
FIG. 41 is an output image of the image pattern illustrated in FIG. 40.

FIG. 41 is an output image of the image pattern illustrated in FIG. 40. As illustrated in FIG. 41, if the exposed portions 520 having very small dots are intensively exposed with an optical output of 400 percent of the target exposure optical output, the actual output image has no smear from the image portions to the non-image portions resulting from the electric charge diffusion during the exposure. As a result, the target output image can be truly reproduced.

Figure 42A:
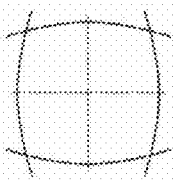
FIGS. 42A and 42B are schematic diagrams for explaining the shape of the periphery of the image pattern illustrated in FIG. 40.
Figure 42B:
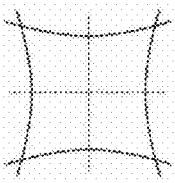

FIGS. 42A and 42B are schematic diagrams for explaining the shape of the periphery of the image pattern illustrated in FIG. 40.

In the exposure method according to the above-described embodiment, the exposed portion corresponding to the image portion that is an area having a rectangular periphery has a rectangular shape corresponding to the shape of the image portion. In this case, the electric charge diffusion during the exposure is likely to occur mainly in the central part of the exposed portion. With the exposure method according to the above-described embodiment, therefore, the output image has a barrel shape in which the central parts of the sides of the rectangular expand (the sides of the rectangular curve outward) as illustrated in FIG. 42A.

By contrast, with the exposure method according to the present embodiment, if the image portion has a rectangular periphery, as illustrated in FIG. 42B, the exposed portion has a shape like a thread spool in which the central parts of the lines connecting a plurality of end portions of the image portion disposed adjacent to the non-image portion curve inward around the central part (the central parts of the lines are pinched in) as illustrated in FIG. 42B.

With the exposure method according to the present embodiment, the image pattern includes the exposed portion and the non-exposed portion. The pixels on the positions corresponding to the electric charge diffusion from the exposed pixels are exposed with a constant optical output, whereby the expansion of the latent image charge in the image pattern can be controlled.

That is, with the exposure method according to the present embodiment, the target image pattern can be accurately reproduced and the target image density is achieved, whereby high-quality images with a high-resolution can be output.

In addition, with the exposure method according to the present embodiment, corresponding to the expansion in the central part of the output image, the central part of the image pattern is pinched in. That is, with the exposure method according to the present embodiment, the expansion in the central part of the image pattern is considered regardless of the shape of the target output image (whether the shape is rectangular). As a result, the target image pattern can be accurately reproduced, whereby high-quality images can be output.

Furthermore, with the exposure method according to the present embodiment, if a halftone image having a high screen ruling (e.g., 140 lpi and 212 lpi) is used, which is affected by the beam size in the scanning optical system that generates a small-sized tinted portion or the expansion of the latent image charges, high-quality images with a high-resolution can be output.

Image Forming Method (3)

The following describes, as another embodiment of the image forming method according to the present invention, a process of improving the reproducibility of very small characters.

Character images with a dot density of 1200 dpi (2 points, 3 points, outlined characters) are used in giving furigana to kanji characters, in floor plans, and the like, and legibility is required in such images. A cause of deteriorations of such very small characters is in their latent images, not in the developing process or the processes thereafter.

As described earlier, in the image forming method according to the present invention, the optical output waveform is controlled with the power modulation and the pulse-width modulation, and the photoconductor is exposed with a stronger optical output with a shorter pulse width, being stronger than the target exposure optical output (concentrated exposure). In this manner, with the image forming method according to the present invention, the latent image resolving power can be improved without changing the beam spot size.

Explained below is a process of improving the image quality of very small outlined characters by improving their latent images, using the concentrated exposure technology in the image forming method according to the present invention.

In this embodiment, a process is performed focusing on the number of black dots adjacent to each white dot.

A black dot adjacent to a white dot means a black dot adjacent to the white dot on any one of +a side, −a side, +b side, and −b side.

Figure 43:
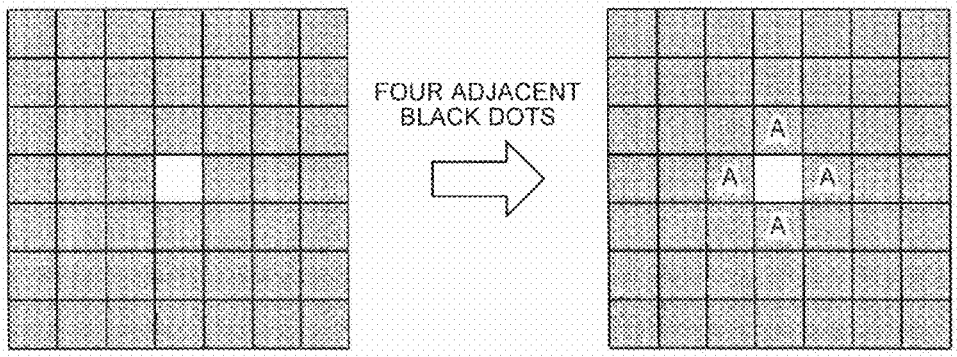
FIG. 43 is a schematic illustrating an example of an image including black dots adjacent to a white dot.

FIG. 43 is a schematic illustrating an example of an image including black dots adjacent to a white dot.

In the embodiment, for example, when the number of black dots adjacent to the white dot is four, as illustrated in FIG. 43, a flag A is set to the black dots adjacent to the white dot.

Figure 44:
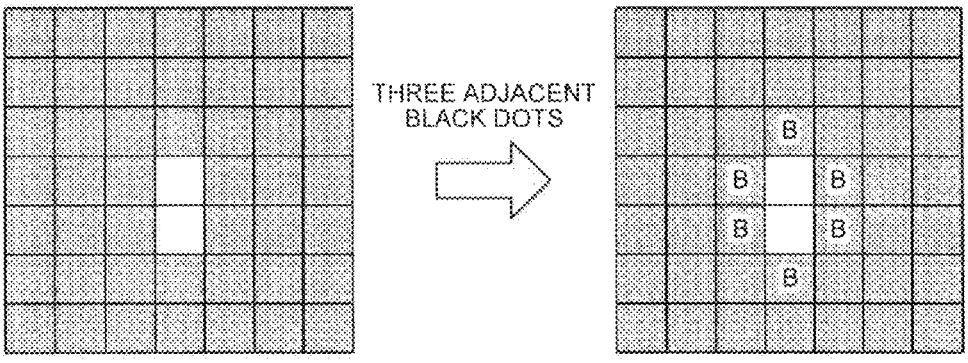
FIG. 44 is a schematic illustrating an image including black dots adjacent to a white dot, with flags set to the black dots.

FIG. 44 is a schematic illustrating another example of an image including black dots adjacent to a white dot.

In the embodiment, for example, when the number of black dots adjacent to the white dot is three, as illustrated in FIG. 44, a flag B is set to the black dots adjacent to the white dot.

Figure 45:
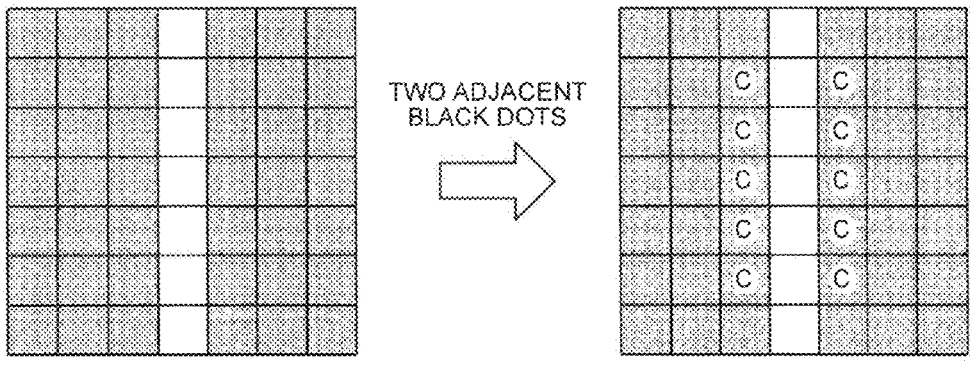
FIG. 45 is a schematic illustrating another example of an image including black dots adjacent to a white dot.

FIG. 45 is a schematic illustrating still another example of an image including black dots adjacent to a white dot.

In the embodiment, for example, when the number of black dots adjacent to the white dot is two, as illustrated in FIG. 45, a flag C is set to the black dots adjacent to the white dot.

In FIG. 45, because the number of adjacent black dots cannot be determined for the white dots at the edges, such dots are disregarded herein.

Figure 46:
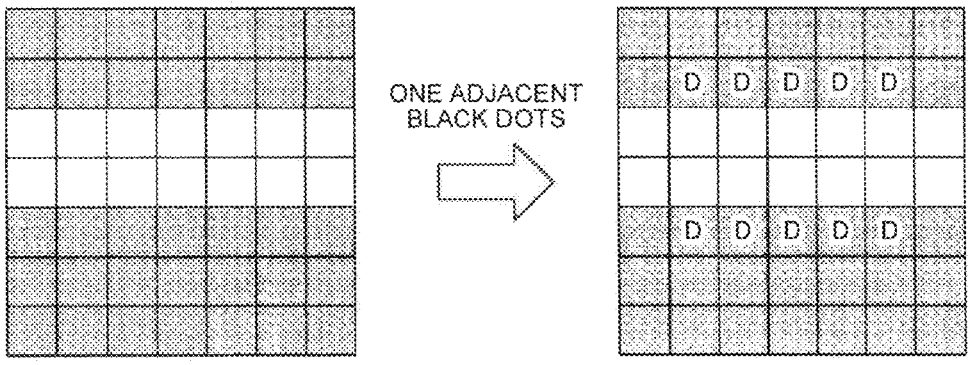
FIG. 46 is a schematic illustrating another example of an image including black dots adjacent to a white dot, with flags set to the black dots.

FIG. 46 is a schematic illustrating another example of an image including black dots adjacent to a white dot.

In the embodiment, for example, when the number of black dots adjacent to the white dot is one, as illustrated in FIG. 46, a flag D is set to the black dots adjacent to the white dot.

Figure 47:
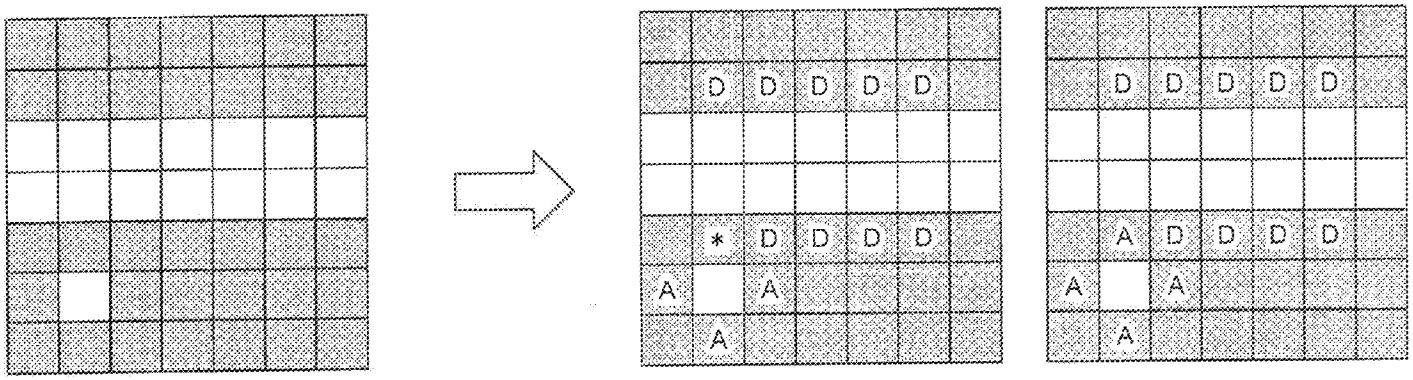
FIG. 47 is a schematic illustrating still another example of an image including black dots adjacent to a white dot.

FIG. 47 is a schematic illustrating still another example of an image including black dots adjacent to a white dot.

In the embodiment, when one black dot is adjacent to two white dots, as illustrated in FIG. 47, the flag D would be set to the black dot focusing on one of the white dots, and the flag A would be set focusing on the other white dot.

As indicated by the dot * in FIG. 47, when different flags are possible for one dot, the white dot with a larger number of adjacent black dots is prioritized, so that the flag A is set to the adjacent black dot.

Figure 48:
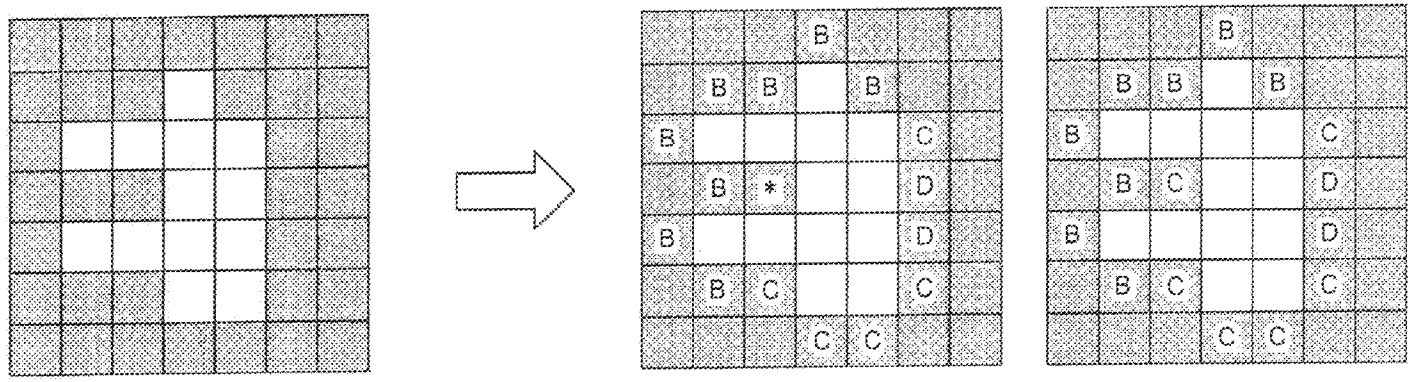
FIG. 48 is a schematic illustrating still another example of an image including black dots adjacent to a white dot.

FIG. 48 is a schematic illustrating another example of an image including black dots adjacent to a white dot.

One black dot may be adjacent to three white dots, as illustrated in FIG. 48. In such a case in which the flag C or the flag D can be set to the adjacent black dot, the white dot with a larger number of adjacent black dots is prioritized, so that the flag C is set to the adjacent black dot.

As explained above, in the process of improving the reproducibility of very small characters according to the embodiment, focusing on the black dots adjacent to a white dot, the number of black dots adjacent to the white dot is counted, and the largest one of the counts (hereinafter, referred to as a "BM value") is selected.

Figure 49:
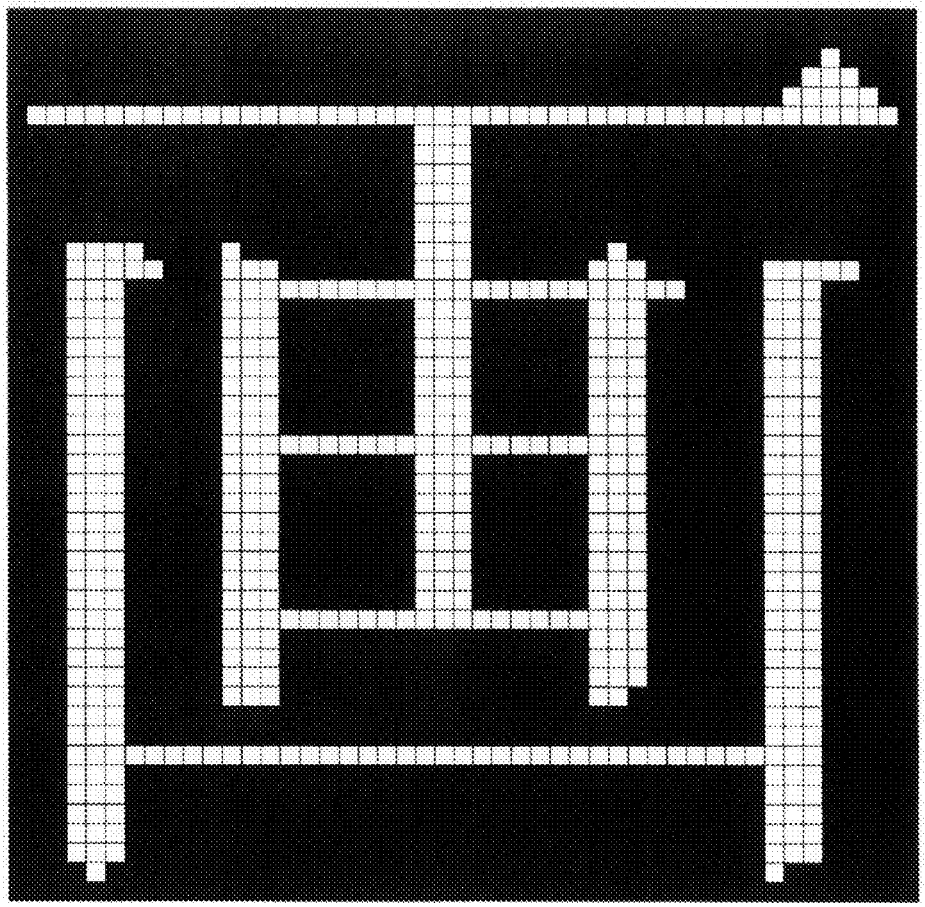
FIG. 49 is a schematic illustrating an example of the image data of an outlined image.

FIG. 49 is a schematic illustrating an example of the image data of an outlined image. In FIG. 49, the outlined image of the character "画" is provided, as an example of outlined image data.

Figure 50:
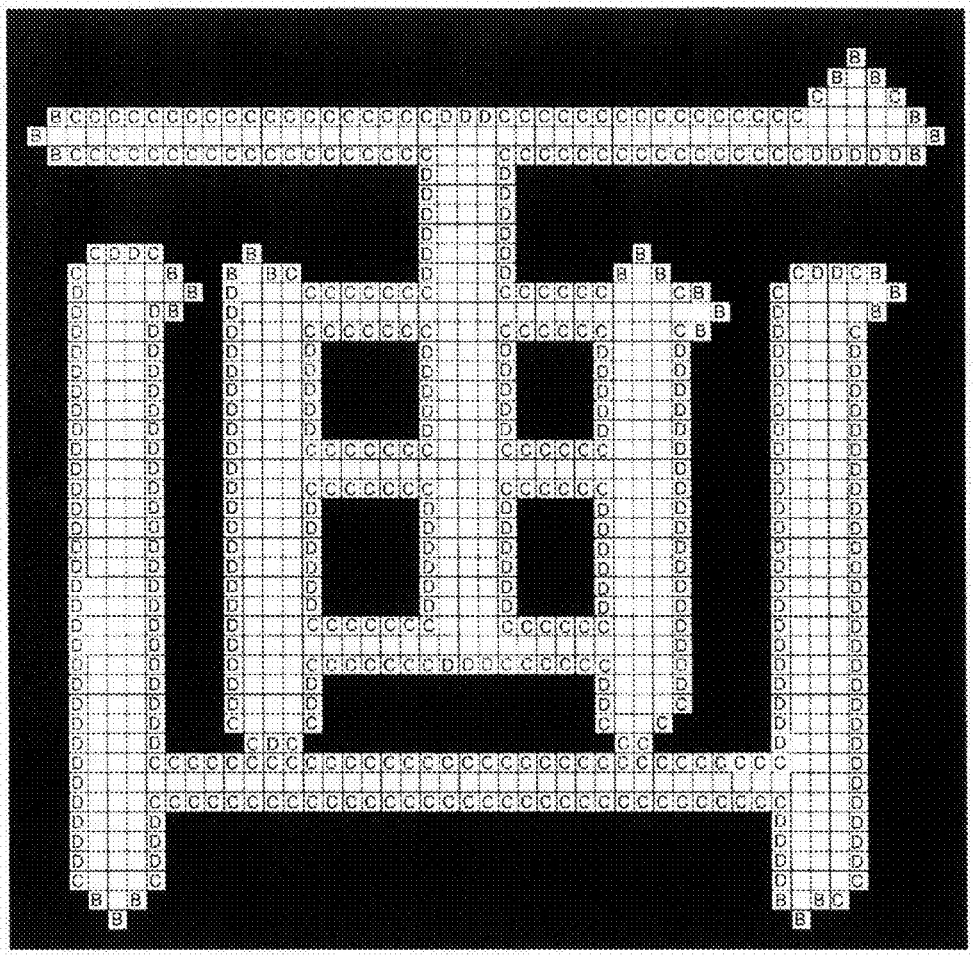
FIG. 50 is a schematic illustrating the result of performing an operation to the exemplary image data of the outlined image illustrated in FIG. 49.
Figure 51:
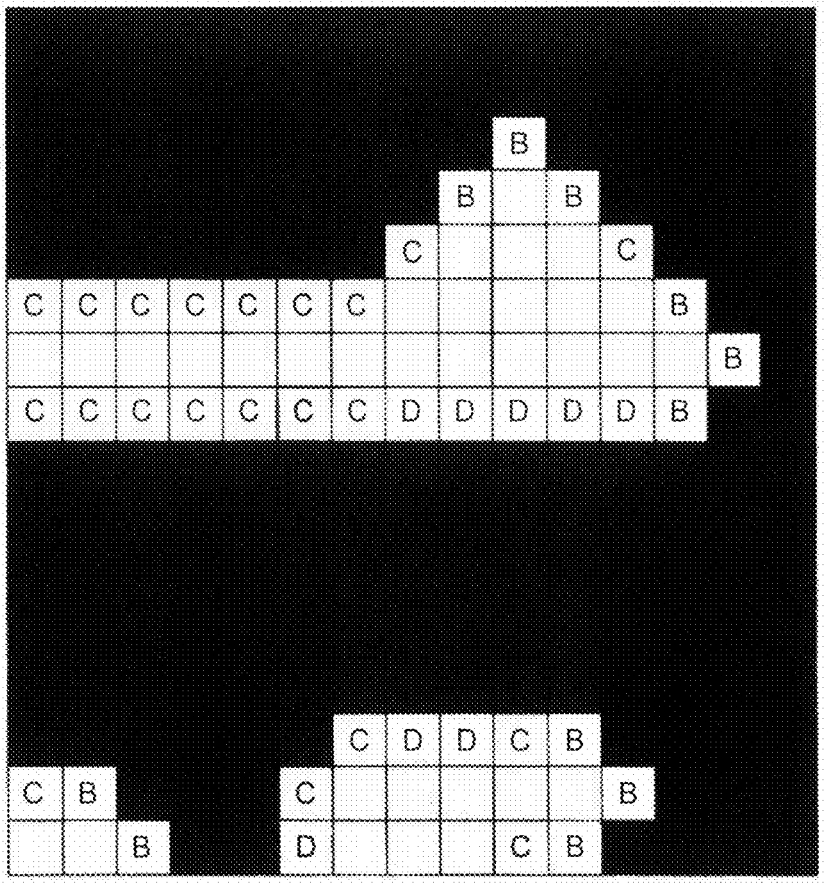
FIG. 51 is a partial enlarged view of the operation result illustrated in FIG. 50.

FIG. 50 is a schematic illustrating the result of performing an operation to the exemplary image data of the outlined image illustrated in FIG. 49. FIG. 51 is a partial enlarged view of the operation result illustrated in FIG. 50.

FIGS. 50 and 51 illustrate flags set to the black dots adjacent to white dots, by performing the process of improving the reproducibility of very small characters to the image data of the outlined image illustrated in FIG. 49.

In the image data of the outlined image illustrated in FIG. 49, the flag D is set to the pixels of which BM value is one, the flag C is set to the pixels of which BM value is two, and the flag B is set to the pixels of which BM value is three.

In the image data of the outlined image illustrated in FIG. 49, because there is no pixel in which the number of black dots adjacent to a white dot is four, there is no pixel of which BM value is four, to which the flag A is to be set.

In other words, according to the embodiment, by setting a flag to a black dot based on the number of black dots adjacent to a white dot, reproducibility of very small characters can be improved without performing any character recognition such as edge processing.

Figure 52:
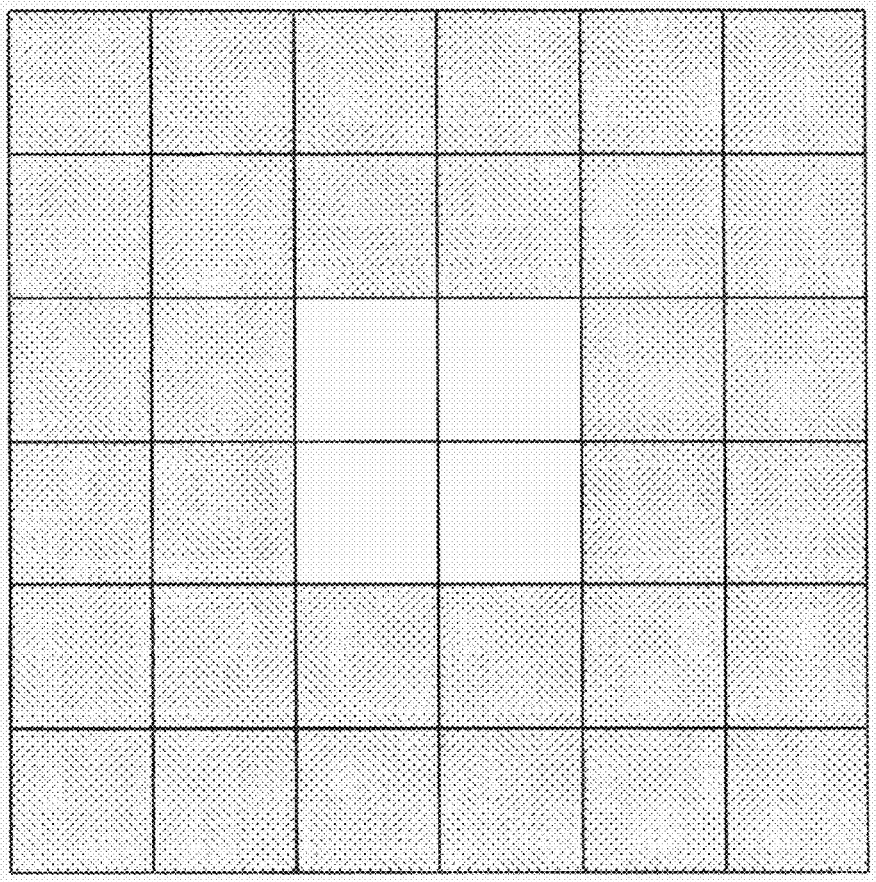
FIG. 52 is a schematic illustrating an example of a two-dot outlined image.

FIG. 52 is a schematic illustrating an example of a two-dot outlined image. The latent image forming conditions for the two-dot outlined image illustrated in FIG. 52 include a charge potential of −500 V, an azo-based organic photoconductor (OPC), a film thickness of 30 micrometers, a laser wavelength of 655 nanometers, and a dot density of 1200 dpi.

In FIG. 52, the part of the two-dot image to be output as outlined illustrated in black is exposed with an amount of light of 100 percent and a duty ratio of 100 percent, while the white portions are not exposed.

Figure 53:
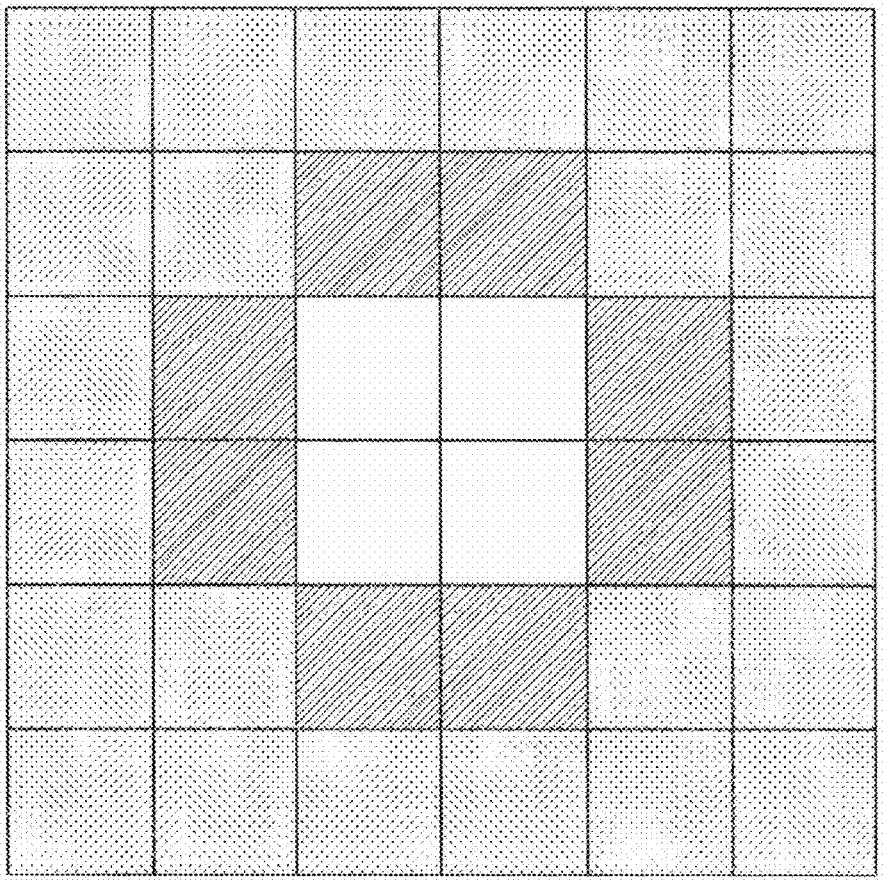
FIG. 53 is a schematic illustrating the pixels to which an optical output setting pattern is set in the two-dot outlined image.

FIG. 53 is a schematic illustrating the pixels to which an optical output setting pattern is set in the two-dot outlined image. In the two-dot outlined image illustrated in FIG. 53, an optical output pattern is set to the eight hatched pixels adjacent to the white dots.

According to the way in which the flags are set based on the BM values described above, the BM value of the hatched pixels is two, and therefore, the flag C is to be set to these pixels. The optical output is then set based on the flag set to these eight pixels.

Figure 54:
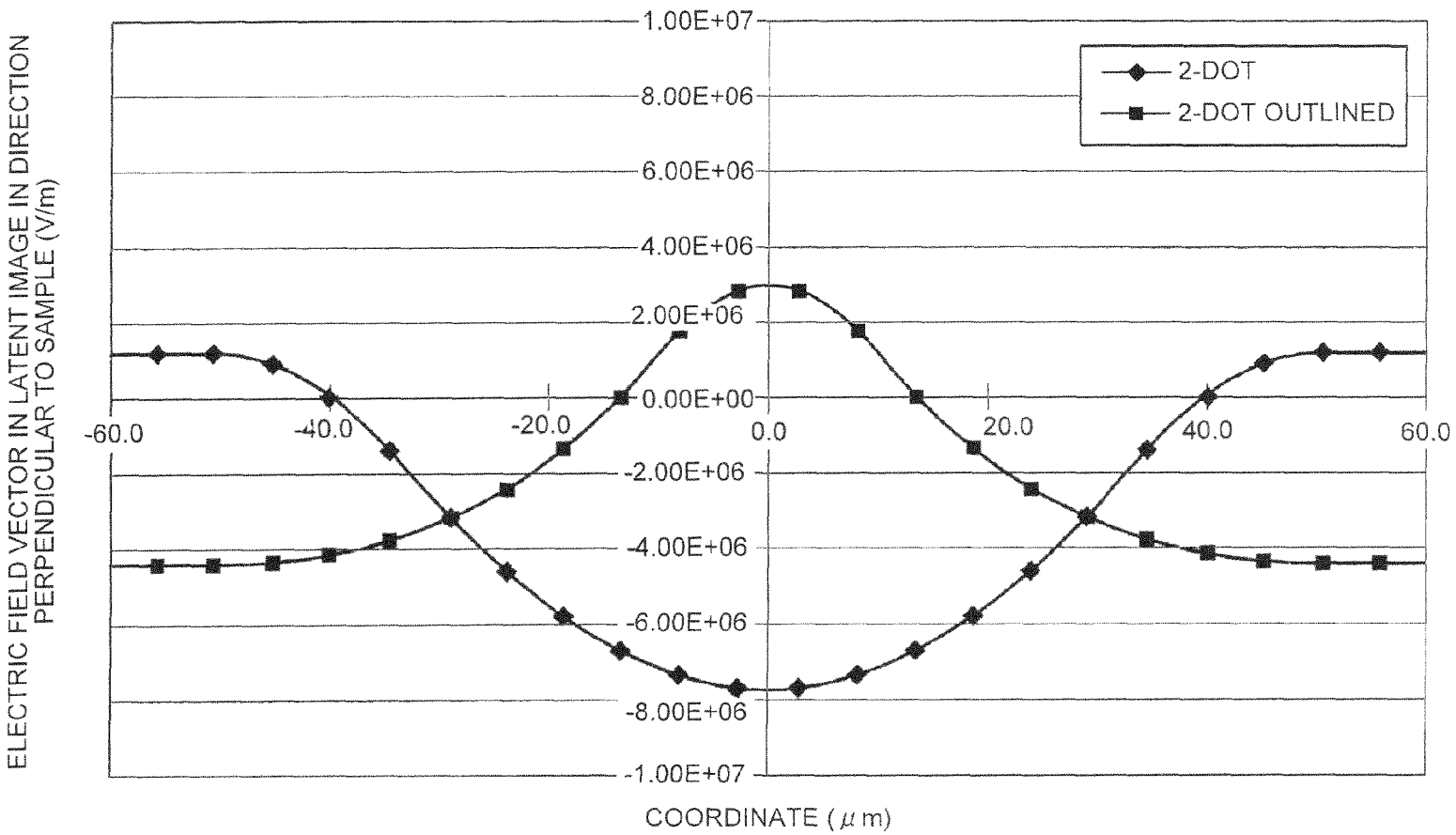
FIG. 54 is a schematic illustrating electric field vectors in the latent images of a two-dot ordinary image and of a two-dot outlined image in the vertical direction of the sample.

FIG. 54 is a schematic illustrating the electric field vectors in the latent images of a two-dot ordinary image and of a two-dot outlined image in the vertical direction of the sample. Illustrated in FIG. 54 are the electric field vectors in the latent images in the vertical direction of the sample when the two-dot ordinary image and the two-dot outlined image are exposed using the standard exposure, with an optical output that is based on the image pattern signal.

As illustrated in FIG. 54, the electric field vector in the latent image of the two-dot outlined image in the vertical direction of the sample is extremely smaller than that in the latent image of the two-dot ordinary image. In other words, the electric field vector in the latent image of the two-dot outlined image in the vertical direction of the sample is not the reversal of the electric field vector in the latent image of the two-dot ordinary image in the vertical direction of the sample.

This extreme difference indicates that a desired output image cannot be achieved when the two-dot outlined image is exposed using the standard exposure with an optical output that is based on the image pattern signal.

In the process of improving the reproducibility of very small characters in the embodiment, it is therefore preferable to set an optical output pattern in such a manner that a larger electric field vector in the latent image is produced accordingly to the scale of the BM value.

In the process of improving the reproducibility of very small characters in this embodiment, the electric field vector resulting from the standard exposure that is based on the image pattern signal represented as E0.

In the process of improving the reproducibility of very small characters in the embodiment, the electric field vector of when the BM value is one is represented as ED, and the electric field vector of when the BM value is two is represented as EC. The electric field vector of when the BM value is three is represented as EB, and the electric field vector of when the BM value is four is represented as EA.

In the process of improving the reproducibility of very small characters in this embodiment, it is preferable to form an electric field vector in the latent image in the vertical direction of the sample to satisfy a relation in Equation (1) below.

$$EA \geq EB \geq EC \geq ED \geq E0 \quad (1)$$

In Equation (1), a larger electric field vector in the latent image indicates a direction in which less toner is attached.

Figure 55:
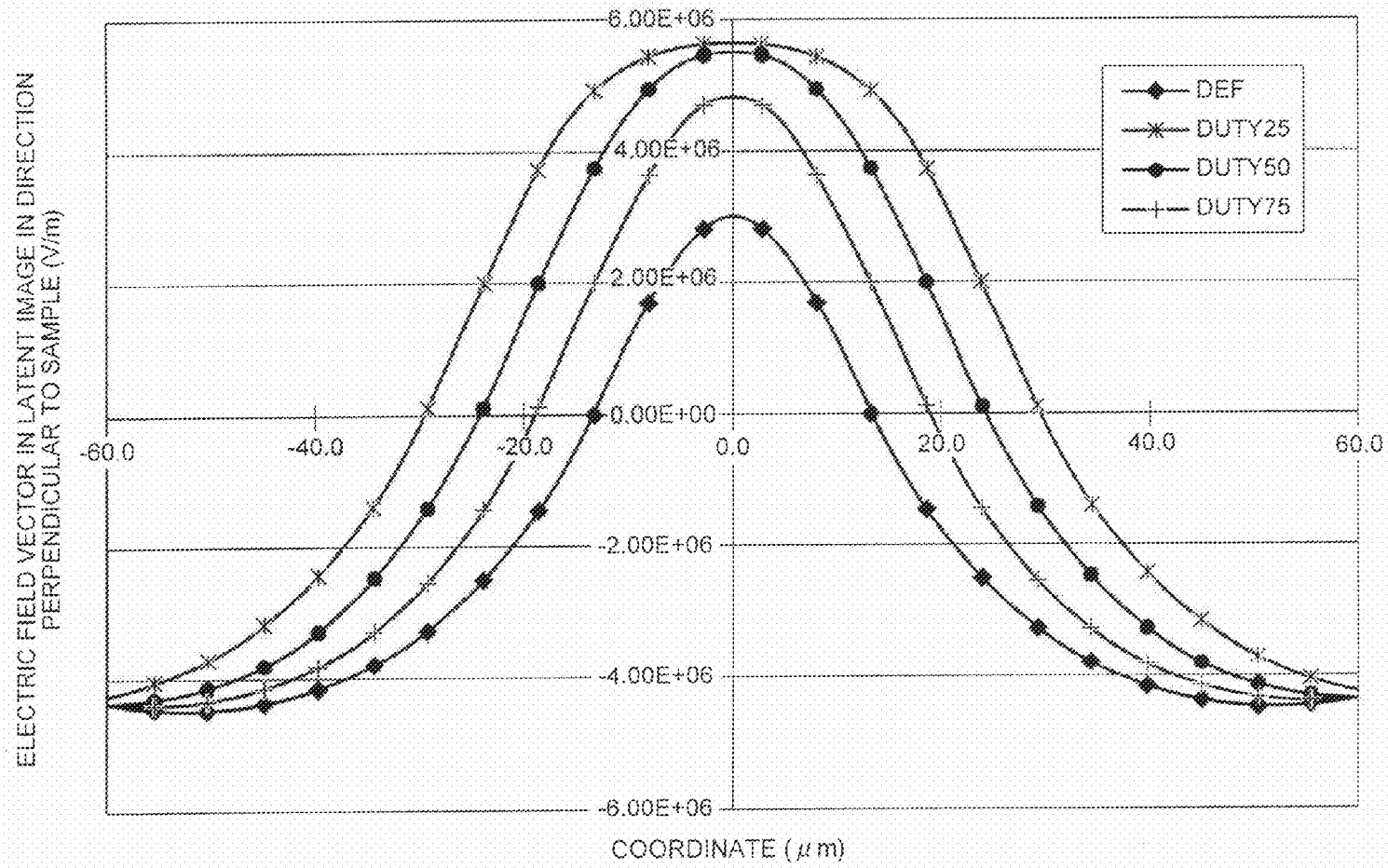
FIG. 55 is a schematic diagram illustrating differences in the electric field vectors in the latent images in the vertical direction of the sample, achieved with different optical outputs based on pulse-width modulation.

FIG. 55 is a schematic illustrating differences in the electric field vectors in the latent images in the vertical direction of the sample, achieved with different optical outputs based on the pulse-width modulations.

In FIG. 55, the electrostatic latent image of the two-dot outlined image is formed while changing only the duty ratio, among the exposure conditions of the black dots adjacent to a white dot, from 75 percent to 50 percent, and to 25 percent with respect to the electric field vector achieved using the standard exposure with the image pattern signal. FIG. 55 illustrates a relation between an intensity of the c-axis electric field and a distance from the center of the electrostatic latent image of the two-dot outlined image, when the electrostatic latent image is formed in the manner described above.

When the exposure condition is set to a duty ratio of less than 100 percent, a black dot is exposed at timing away from a white dot.

With the standard exposure, the intensity of the c-axis electric field at the center of the electrostatic latent image was 2.88×106 V/m. When the duty ratio was set to 75 percent in the concentrated exposure, the intensity of the c-axis electric field at the center of the electrostatic latent image was 4.73×106 V/m. When the duty ratio was set to 50 percent, the intensity of the c-axis electric field at the center of the electrostatic latent image was 5.47×106 V/m, while it was 5.65×106 V/m with a duty ratio of 25 percent.

The exposure condition was changed only for the black dots adjacent to a white dot. In other words, FIGS. 31A and 31B indicate that the intensity of the c-axis electric field in the white dots has changed although the exposure condition for the white dot is not changed. As the duty ratio is reduced, the intensity of the c-axis electric field in the white dots is increased, and therefore, less toner is attached.

As described above, in the process of improving the reproducibility of very small characters in this embodiment, by changing the duty ratio based on the flags set to the black dots adjacent to a white dot, an outlined image in which white dots are clearly delineated can be output.

In the process of improving the reproducibility of very small characters in the embodiment, the duty ratio may be set to zero percent (no illumination) in the black dots set with the flag A. In such a case, the duty ratio is set to 25 percent in the black dot with the flag B, the duty ratio is set to 50 percent in the black dot with the flag C, and the duty ratio is set to 75 percent in the black dot with the flag D. In such a case as well, because the relation EA≥EB≥EC≥ED is satisfied, it is possible to output an outlined image in which the white dots are clearly delineated.

Although the settings of the duty ratio may be fixed, it is more preferable to find appropriate settings for the actual device through experiments or the like, because the optimal settings of the duty ratio differ depending on devices.

Figure 56:
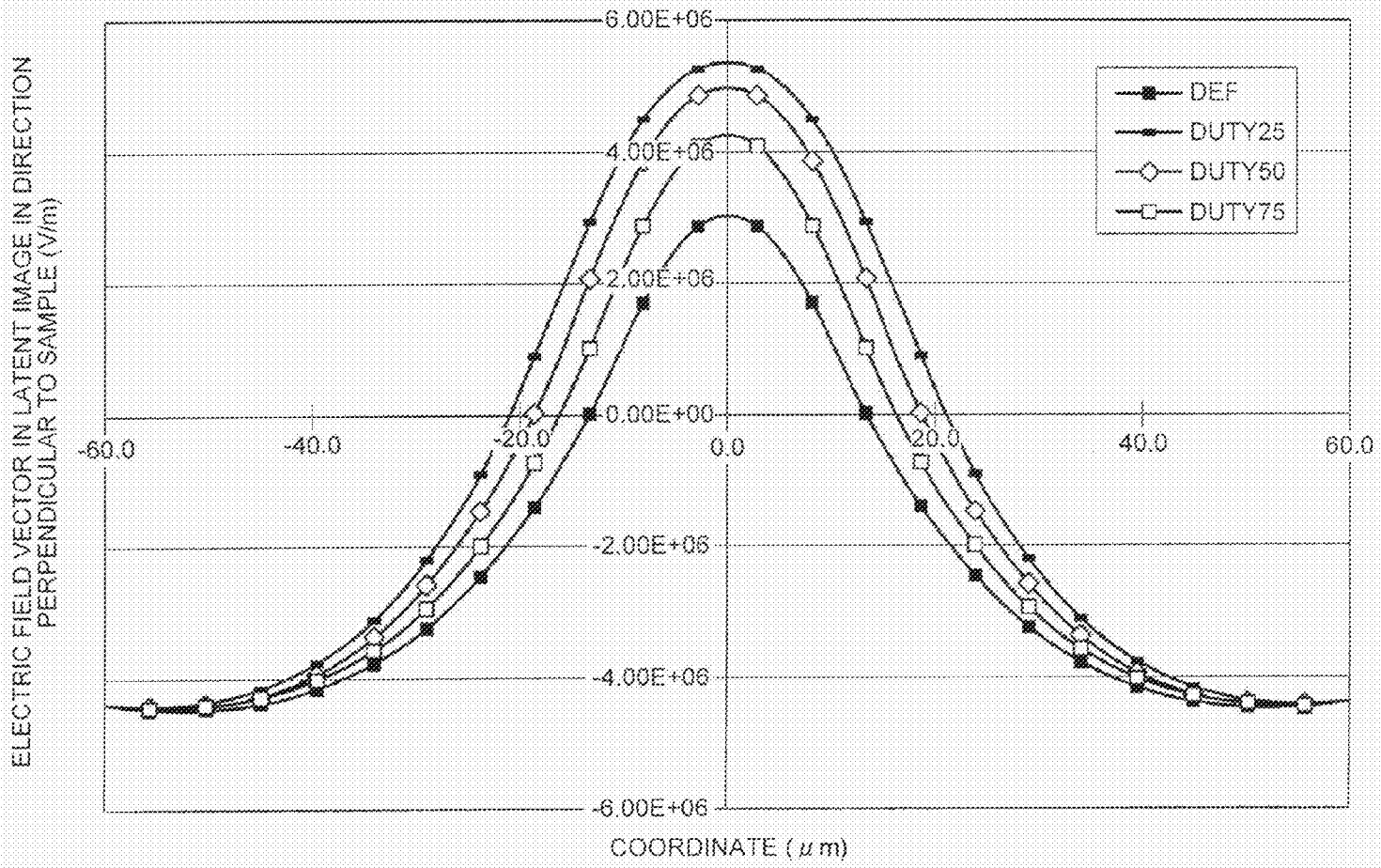
FIG. 56 is a schematic illustrating differences in the electric field vectors in the latent images in the vertical direction of the sample, achieved with different optical outputs based on PW and PWM modulations.
Figure 57:
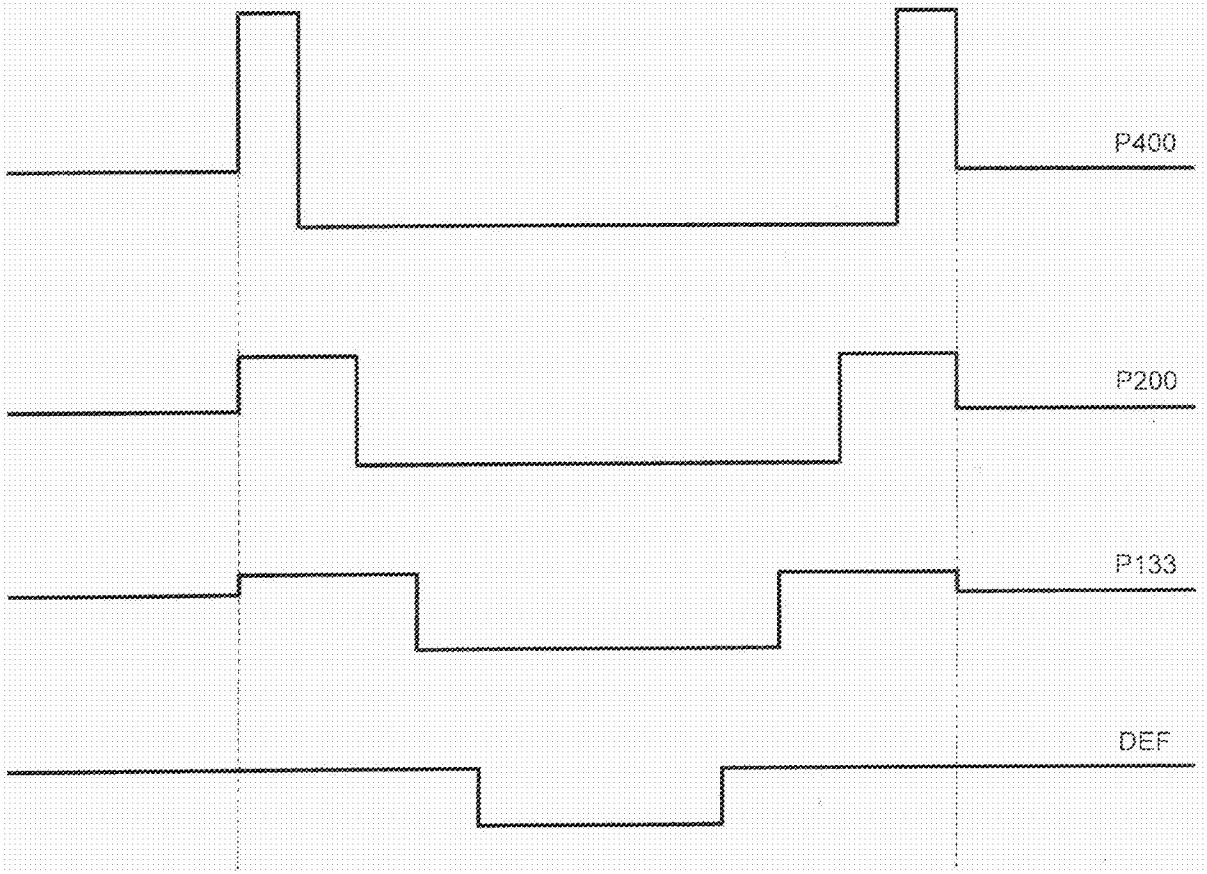
FIG. 57 is a schematic illustrating differences in the amounts of optical output dispersion, achieved with different levels of optical outputs based on the PW modulation and the PWM modulation.

FIG. 56 is a schematic illustrating differences in the electric field vectors in the latent image in the vertical direction of the sample, achieved with different optical outputs based on the PW modulation and the PWM modulation. FIG. 57 is a schematic illustrating differences in the amounts of optical output dispersion, achieved with different levels of optical outputs based on the PW modulation and the PWM modulation.

FIGS. 56 and 57 indicate a relation between an intensity of the c-axis electric field and a distance from the center of the electrostatic latent image of a two-dot outlined image, when such a latent image is formed by changing the optical outputs while reducing the length of the ON time, among the exposure conditions for the black dots adjacent to a white dot, in such a manner that the integral amount of light is kept constant.

In FIGS. 56 and 57, the outlined image is exposed (concentrated-exposed) with higher optical outputs than that used in an ordinary black solid image, with the highest at 400 percent of that in the standard exposure, denoted by P400, and 200 percent denoted by P200, and 133 percent denoted by P133.

With the concentrated exposure according to the embodiment, the latent image is exposed with a stronger optical output over a shorter ON time, that is, exposed in a concentrated fashion, being concentrated with respect to time. Therefore, according to the embodiment, the electric field of the latent image can be brought up (increased) in an outlined image portion, so that the latent image resolving power can be improved while maintaining the density of the black pixels.

A prominent characteristic of the concentrated exposure is in that the overall image density remains substantially the same because the integral amount of light remains the same.

Furthermore, with the concentrated exposure, because the range of the c-axis electric field intensity is narrow, compared with the method in which the duty ratio or the modulation current is changed based on the BM values, the resolving power is maintained while the intensity of the c-axis electric field is increased.

Furthermore, the concentrated exposure has some outstanding advantages, e.g., images are less degraded, and developing γ is stored, and halftone images are more likely to be supported. In other words, in the process of improving the reproducibility of very small characters in the image forming method according to the present invention, it is more effective in adjustment of the exposure conditions by combining the PM modulation and the PWM modulation.

Light Source Driving Unit

The following describes a light source driving unit for the image forming apparatus according to the present invention executing the image forming method according to the present invention.

Figure 58:
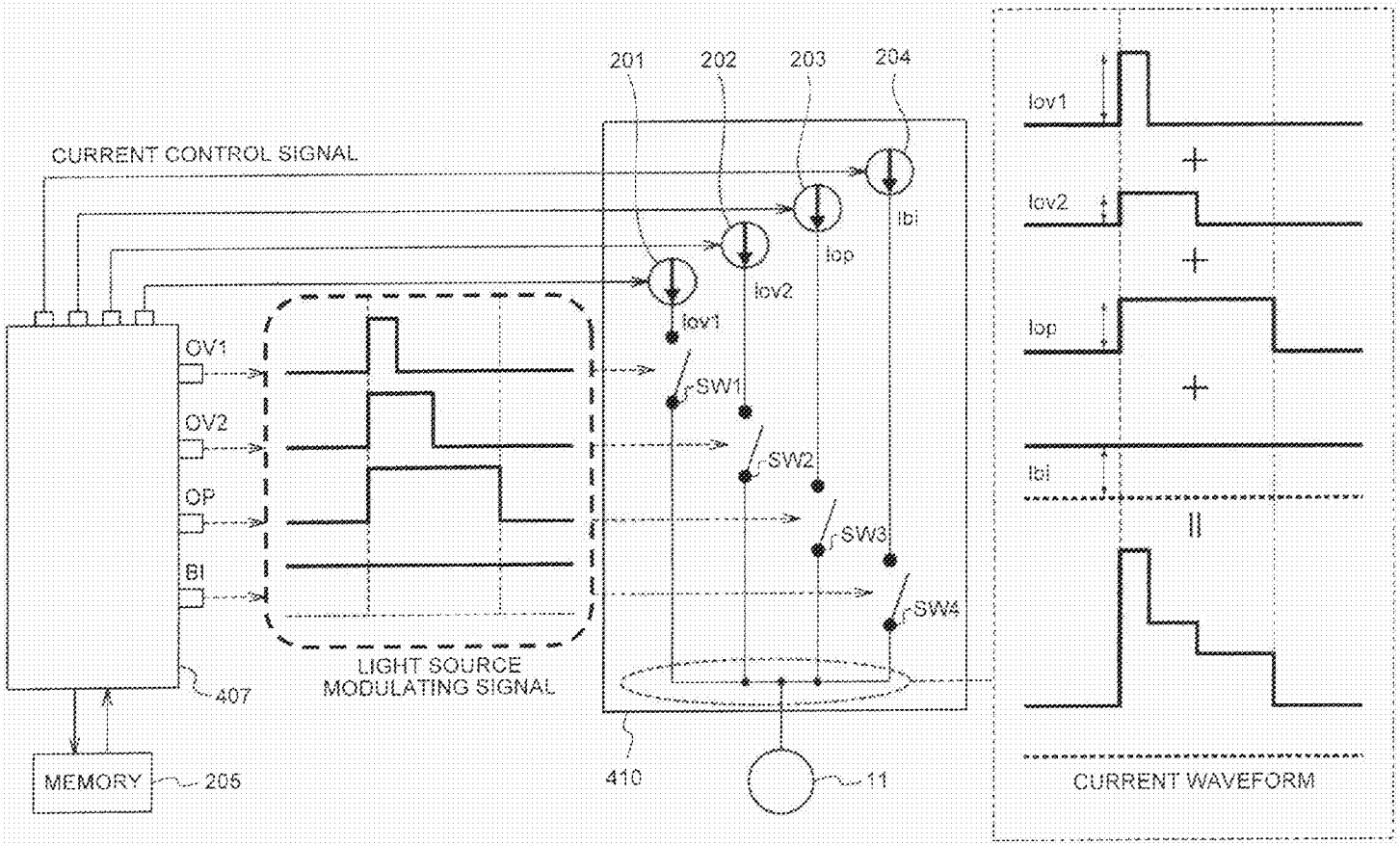
FIG. 58 is a circuit diagram of a light source driving unit constituting the image forming apparatus illustrated in FIG. 1.

FIG. 58 is a circuit diagram of the light source driving unit constituting the image forming apparatus illustrated in FIG. 1. As illustrated in FIG. 58, this light source driving unit 410 includes current sources 201 to 204, switches SW1 to SW4, and a memory 205. The light source driving unit 410 is connected to an image processing circuit 407.

The image forming apparatus according to the present invention executing the image forming method according to the present invention allows the photoconductor to be exposed while changing the optical outputs based on the positions in an image portion in the main-scanning direction (correspondingly to the time elapsed from when the image portion is started being exposed). With the configuration illustrated in FIG. 58, the light source driving unit 410 can generate a light source driving current by performing the pulse width modulation and the light amount modulation (the PWM modulation and the PW modulation) simultaneously.

Generally, a current waveform is generated by adding a bias current (Ibi), a basic pattern current (Iop), and overshoot currents (Iov1, Iov2).

The current source 201 generates the overshoot current Iov1. The current source 202 generates the overshoot current Iov2. The current source 203 generates the basic pattern current Iop. The current 204 generates the bias current Ibi.

The current generated by the light source driving unit 410 is determined by causing the current sources 201 to 204 to be controlled by the current control signals output from the image processing circuit 407.

The switches SW1 to SW4 are provided correspondingly to the respective current sources 201 to 204. The switches SW1 to SW4 are controlled by light source modulation signals output from the image processing circuit 407. The switches SW1 to SW4 control the flow of currents from the current source 201 to 204, thereby generating a pattern of a pulse to be generated by the light source driving unit 410.

The memory 205 corresponds to a storage unit, and stores therein information required in generating a light source driving current. The image processing circuit 407 refers to the information stored in the memory 205.

Because the light source driving unit 410 can convert a light source modulation signal acquired from a piece of light source modulation data into a current, the image forming apparatus according to the present invention can generate a PM- and PWM-modulated light source driving current capable of controlling the optical output and the ON time.

Figure 59:
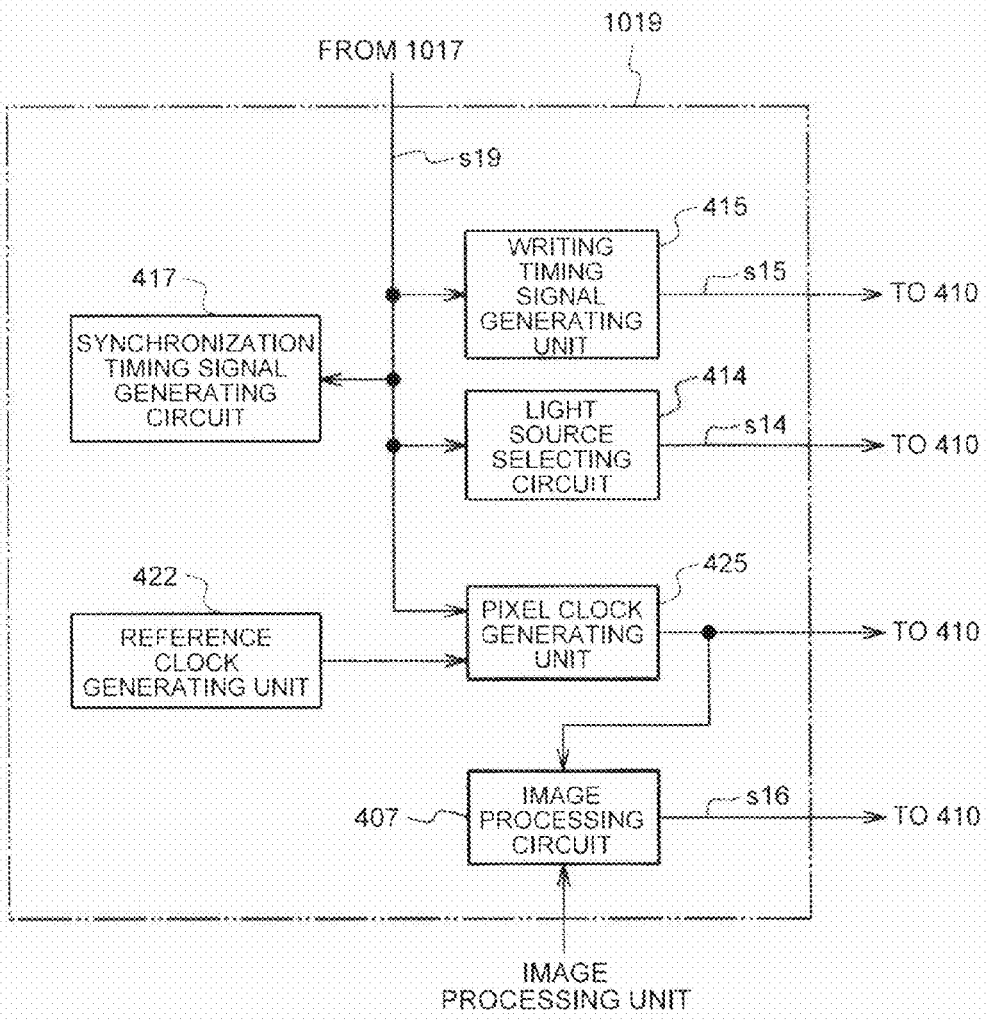
FIG. 59 is a block diagram illustrating a light source drive control unit provided to the light source driving unit illustrated in FIG. 58.

FIG. 59 is a block diagram illustrating a light source drive control unit in FIG. 58. As illustrated in FIG. 59, this light source drive control unit 1019 includes a reference clock generating unit 422 and a pixel clock generating unit 425. The light source drive control unit 1019 includes the image processing circuit 407, a light source selecting circuit 414, a writing timing signal generating unit 415, and a synchronization timing signal generating circuit 417.

The flows of representative signals or information are indicated by the arrows in FIG. 59, but these arrows do not represent every connection between the blocks.

The reference clock generating unit 422 generates a high frequency clock signal that is used as a reference in the entire light source drive control unit 1019.

The main component of the pixel clock generating unit 425 is a phase-locked loop (PLL) circuit. The pixel clock generating unit 425 generates a pixel clock signal based on the synchronization signal s19 and the high frequency clock signal from the reference clock generating unit 422.

The pixel clock signal has the same frequency as the high frequency clock signal, and the phase of the pixel clock signal is matched with the phase of the synchronization signal s19.

The pixel clock generating unit 425 can therefore control the writing position for each scan, by synchronizing the image data to the pixel clock signal.

The pixel clock generating unit 425 supplies the generated pixel clock signal to the light source driving unit 410 as a piece of driving information, and to the image processing circuit 407. The pixel clock signal supplied to the image processing circuit 407 is used as a clock signal for write data s16.

The light source selecting circuit 414 is a circuit used when the light source is provided in plurality, and outputs a signal for designating a selected light-emitting element. This output signal s14 from the light source selecting circuit 414 is supplied to the light source driving unit 410 as a piece of driving information.

Figure 60:
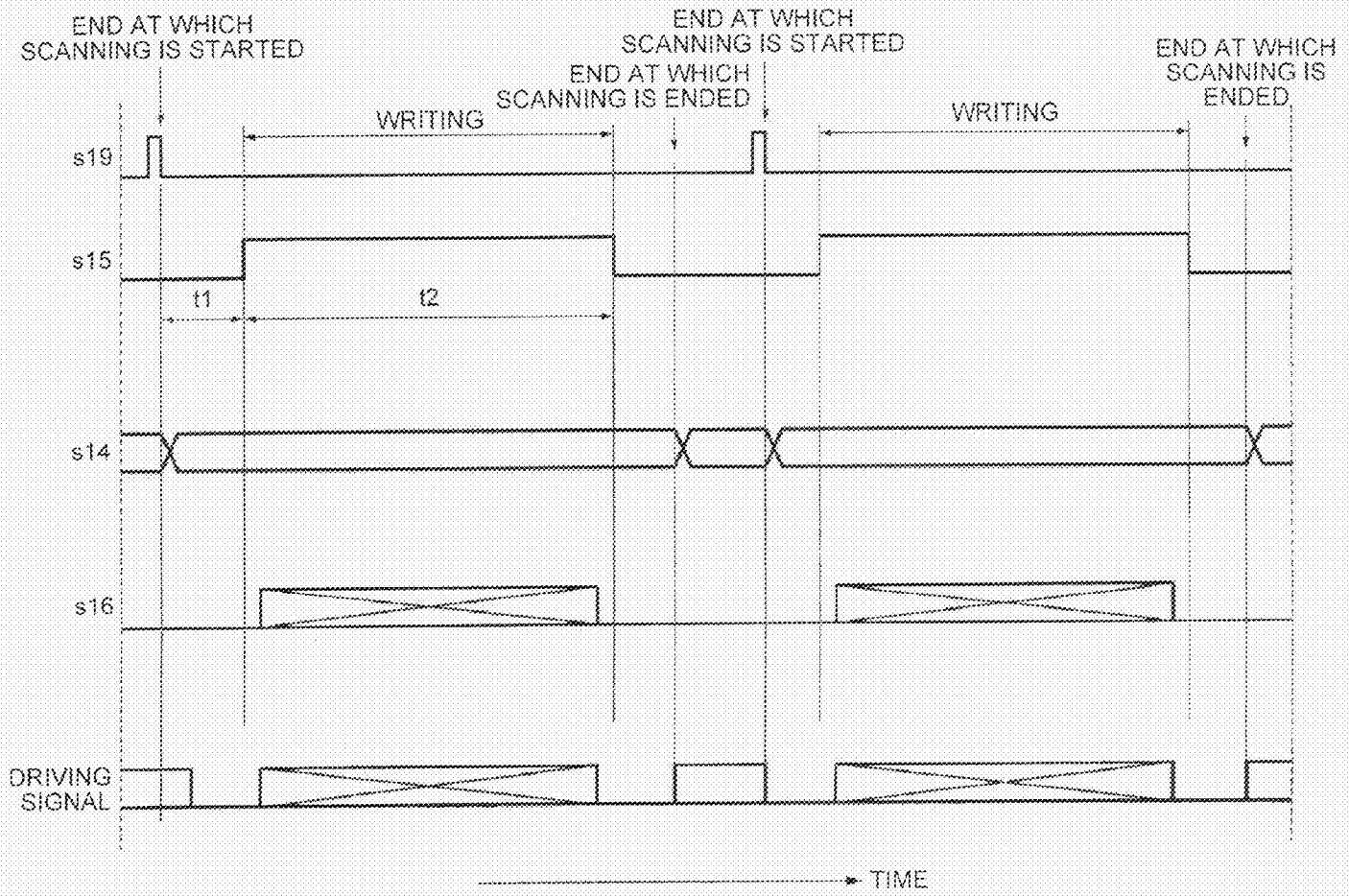
FIG. 60 is a timing chart illustrating the timing at which each of the units in the image forming apparatus operates illustrated in FIG. 1.

FIG. 60 is a timing chart illustrating the timing at which each of the units in the image forming apparatus in FIG. 1 operates. In FIG. 60, s19 denotes an output signal (synchronization signal) from a synchronization detection sensor 26; s15 denotes an output signal (LGATE signal) from the writing timing signal generating unit 415; s14 denotes an output signal from the light source selecting circuit 414, and s16 denotes write data that is an output from the image processing circuit 407.

The image processing circuit 407 creates a piece of write data s16 for each of the light-emitting elements based on the image information received from the IPU or the like. The write data s16 is supplied to the light source driving unit 410, as a piece of driving information, at the timing of the pixel clock signal.

Structure of Electrostatic Latent Image Measurement Apparatus

The following describes a structure of an electrostatic latent image measurement apparatus.

Figure 61:
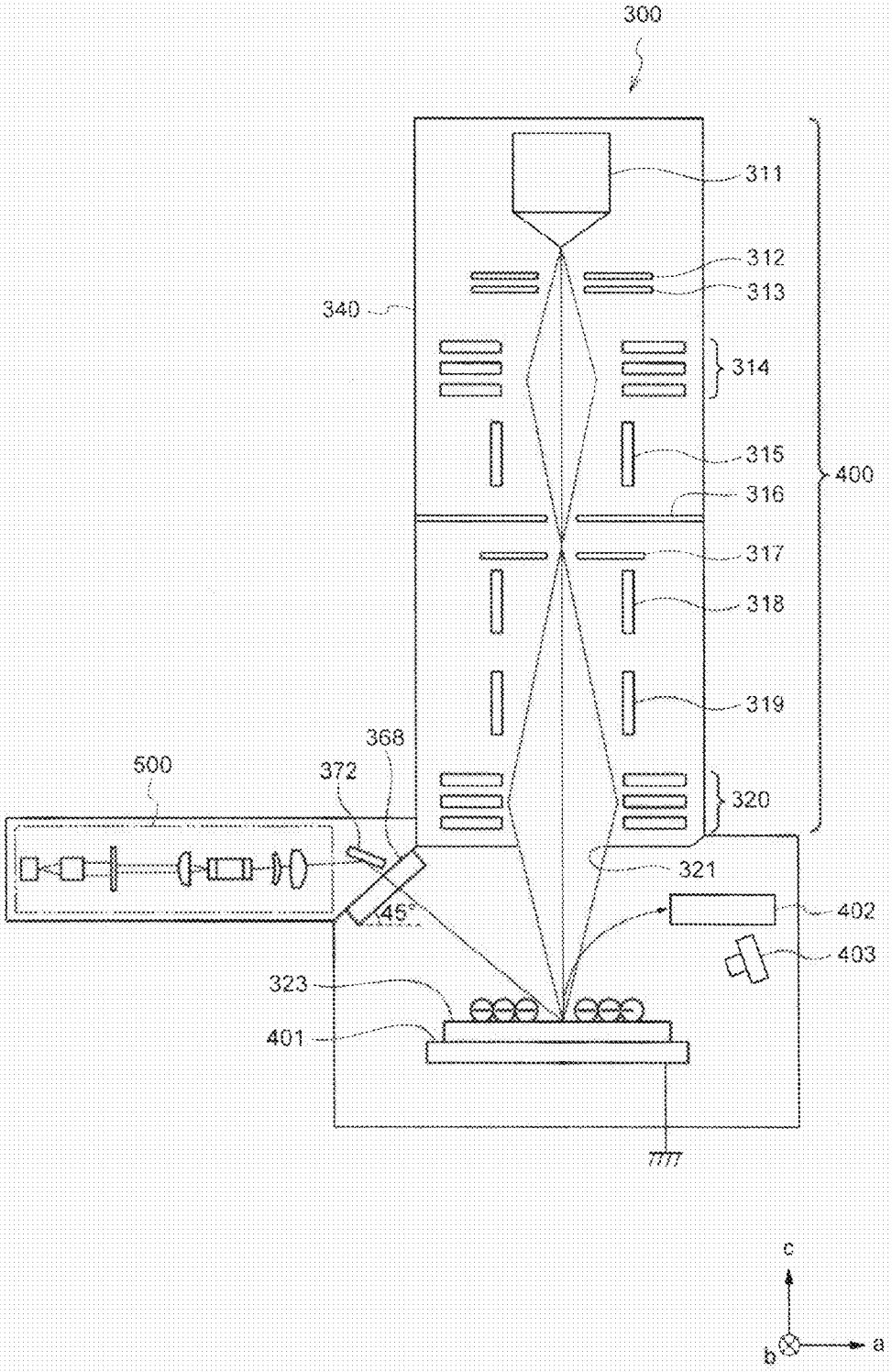
FIG. 61 is a cross-sectional view across the center of an electrostatic latent image measurement apparatus.

FIG. 61 is a cross-sectional view across the center of an electrostatic latent image measurement apparatus.

This electrostatic latent image measurement apparatus 300 includes a charged particle output system 400, an optical scanning device 1010, a platform 401, a detector 402, and an LED 403, and a control system, a discharge system, and a driving power supply not illustrated.

The charged particle output system 400 is placed inside of a vacuum chamber 340. The charged particle output system 400 includes an electron gun 311, an extraction electrode 312, an accelerating electrode 313, condenser lenses 314, a beam blanker 315, and a partitioning plate 316. The charged particle output system 400 also includes a movable aperture 317, a stigmator 318, a scanning lens 319, and objective lenses 320.

In the explanation hereunder, the direction of the optical axis of the lenses is referred to as a c-axial direction, and two directions that are perpendicular to each other on a plane perpendicular to the c-axial direction are referred to as an a-axial direction and a b-axial direction, respectively.

The electron gun 311 generates an electron beam as a charged particle beam.

The extraction electrode 312 is positioned on the −c side of the electron gun 311, and controls the electron beam generated by the electron gun 311.

The accelerating electrode 313 is positioned on the −c side of the extraction electrode 312, and controls the energy of the electron beam.

The condenser lenses 314 are positioned on the −c side of the accelerating electrode 313, and condense the electron beam.

The beam blanker 315 is positioned on the −c side of the condenser lenses 314, and turns ON or OFF the electron beam.

The partitioning plate 316 is positioned on the −c side of the beam blanker 315, and has an opening at the center.

The movable aperture 317 is positioned on the −c side of the partitioning plate 316, and adjusts the beam diameter of the electron beam passed through the opening of the partitioning plate 316.

The stigmator 318 is positioned on the −c side of the movable aperture 317, and corrects the astigmatism.

The scanning lens 319 is positioned on the −c side of the stigmator 318, and deflects the electron beam passed through the stigmator 318 on the a-b plane.

The objective lenses 320 are positioned on the −c side of the scanning lens 319, and converge the electron beam passed through the scanning lens 319. The electron beam passed through the objective lenses 320 passes through a beam output opening 321, the beam with which the surface of a sample 323 is irradiated.

The driving power supply not illustrated is connected to the lenses and the like.

Charged particles are particles that are affected by an electric field or a magnetic field. The beam in which the charged particles are output may be an ion beam, for example, instead of an electron beam. In such a case, a liquid-metal ion gun, for example, is used instead of the electron gun.

The sample 323 is a photoconductor, and has a conductive supporting member, a charge generation layer (CGL), and a charge transport layer (CTL).

The CGL contains a charge generation material (CGM), and formed on the +c-side surface of the conductive supporting member. The CTL is formed on the +c-side surface of the CGL.

When the sample 323 of which surface (+c side surface) is charged is exposed, the light is absorbed by the CGM in the CGL, and bipolar charge carriers, that is, positive charge carriers and negative charge carriers, are generated. One of the carriers is injected on the CTL by an electric field, and the other is injected on the conductive supporting member.

The electric field moves the carriers injected on the CTL to the surface of the CTL, and the carriers become coupled to the charges on the surface and disappear. Through this process, a charge distribution, that is, an electrostatic latent image is formed on the surface (+c side surface) of the sample 323.

The optical scanning device 1010 includes a light source, a coupling lens, an aperture plate, a cylindrical lens, a polygon mirror, and a scanning optical system. The optical scanning device 1010 also includes a scanning mechanism (not illustrated) for scanning light in a direction in parallel with the rotating shaft of the polygon mirror.

The light output from the optical scanning device 1010 is reflected on a reflecting mirror 372 and passes through a glass window 368, and the surface of the sample 323 is irradiated with the light.

The position irradiated with the light output from the optical scanning device 1010 moves across the surface of the sample 323, in two directions that are perpendicular to each other on a plane orthogonal to the c-axial direction, depending on how the light is deflected on the polygon mirror and the scanning mechanism. The irradiated position moves in the main-scanning direction as the light is deflected on the polygon mirror, and moves in the sub-scanning direction as the light deflected in the scanning mechanism. In this example, the a-axial direction is set to the main-scanning direction, and the b-axial direction is set to the sub-scanning direction.

In this manner, the electrostatic latent image measurement apparatus 300 can scan the surface of the sample 323 two-dimensionally, with the light output from the optical scanning device 1010. In other words, the electrostatic latent image measurement apparatus 300 can form a two-dimensional electrostatic latent image on the surface of the sample 323.

The optical scanning device 1010 is installed outside of the vacuum chamber 340 so that the trajectory of the electron beam is not affected by the vibrations caused by the driving motor for the polygon mirror, or electromagnetic waves. In this manner, the effects of disturbance on the measurement results can be reduced.

The detector 402 is positioned near the sample 323, and detects the secondary electrons from the sample 323.

The LED 403 is positioned near the sample 323, and outputs the light for illuminating the sample 323. The LED 403 is used in neutralizing the remaining charges on the surface of the sample 323, after a measurement is conducted.

The optical housing for supporting the scanning optical system may cover the entire scanning optical system so that the external light (harmful light) is blocked before entering the vacuum chamber.

In the scanning optical system, the scanning lens has fθ characteristics, and is configured in such a manner that the beam moves at a uniform velocity with respect to the image plane while the polarizer is rotating at a constant velocity. The scanning optical system is also capable of scanning while keeping the beam spot size almost constant.

In the electrostatic latent image measurement apparatus 300, because the scanning optical system is positioned away from the vacuum chamber, the measurements are less affected by the vibration generated in driving the optical deflectors, such as a polygon scanner, directly communicated to the vacuum chamber 340.

By vibration-proofing the structure not illustrated for supporting the scanning optical system, higher vibration-proofing can be achieved.

By providing the scanning optical system to the electrostatic latent image measurement apparatus 300, any latent image pattern including a line pattern can be formed in the longitudinal direction of the photoconductor.

A synchronization detection sensor 26 for detecting a scanning beam from the optical deflector may be provided to form a latent image pattern at a given position.

The surface of the sample may be flat or curved.

Method of Measuring Electrostatic Latent Image

The following describes a method of measuring an electrostatic latent image.

Figure 62:
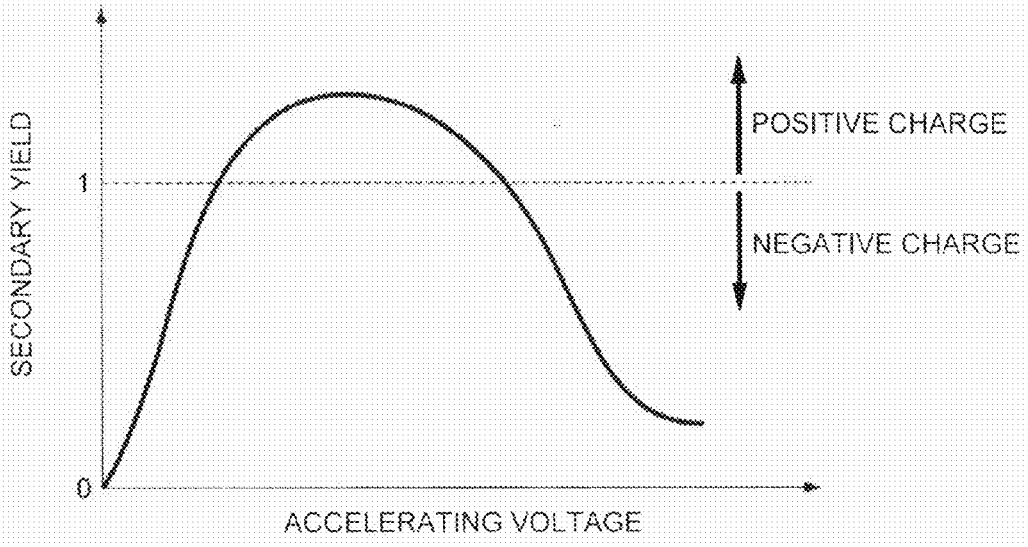
FIG. 62 is a schematic illustrating a relation between an accelerating voltage and a charge.

FIG. 62 is a schematic illustrating a relation between an accelerating voltage and a charge. Before measuring any electrostatic latent image, a sample 323 of a photoconductor is irradiated with an electron beam in the electrostatic latent image measurement apparatus 300.

As illustrated in FIG. 62, as an accelerating voltage |Vacc| that is a voltage applied to the accelerating electrode 313 is set higher than the level resulting in a secondary yield of the sample 323 of one. By setting the accelerating voltage in this manner, the amount of incident electrons exceeds the amount of ejected electrons, thereby allowing the electrons to be accumulated in the sample 323 and causing charge-up. As a result, the electrostatic latent image measurement apparatus 300 can uniformly charge the surface of the sample 323 with the negative charge.

Figure 63:
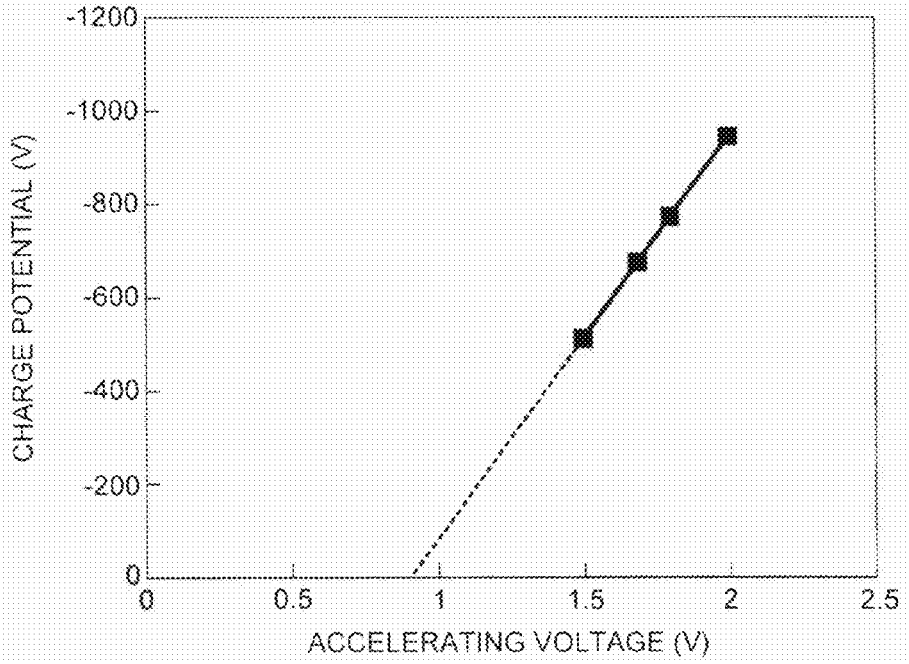
FIG. 63 is a graph illustrating a relation between the accelerating voltage and a charge potential.

FIG. 63 is a graph illustrating a relation between the accelerating voltage and the charge potential. As illustrated in FIG. 63, a constant relation is established between the accelerating voltage and the charge potential. In the electrostatic latent image measurement apparatus 300, therefore, by setting the accelerating voltage and irradiation time appropriately, a charge potential that is the same as that on the photosensitive drum 1030 in the image forming apparatus 1000 can be formed on the surface of the sample 323.

Because a higher irradiation current can achieve the target charge potential in a shorter time period, the irradiation current is set to a few nanoamperes (nA), in this example.

In the electrostatic latent image measurement apparatus 300, the amount of electrons incident on the sample 323 is adjusted to 1/100 times or 1/1000 times so that the electrostatic latent image can be observed.

In the electrostatic latent image measurement apparatus 300, the optical scanning device 500 is controlled to scan the surface of the sample 323 two-dimensionally, thereby forming an electrostatic latent image on the sample 323. The optical scanning device 500 is adjusted so that the beam spot with a desired beam diameter and beam profile is formed on the surface of the sample 323.

The exposure energy required for forming an electrostatic latent image is usually 2 to 10 $mJ/m^2$ or so, depending on the sensitivity characteristics of the sample. For less sensitive samples, exposure energy of 10 $mJ/m^2$ or more may be required. In other words, the charge potential and the exposure energy required are set depending on the photosensitivity characteristics of the sample and the processing conditions. The exposure conditions in the electrostatic latent image measurement apparatus 300 are set to the same exposure conditions suitable for the image forming apparatus 1000.

Figure 64:
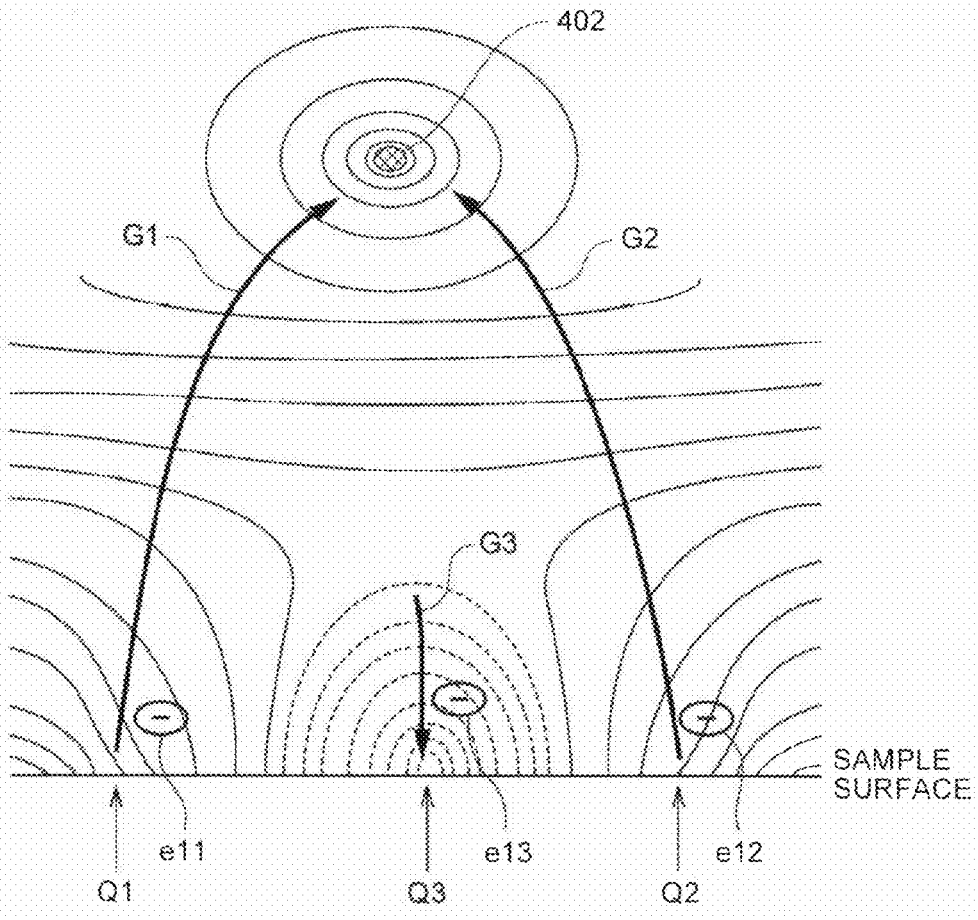
FIG. 64 is a schematic illustrating an electric potential distribution formed by secondary electrons above the sample surface.

FIG. 64 is a schematic illustrating an electric potential distribution formed by the secondary electrons above the sample surface. In FIG. 64, the distribution of the electric potential in the space between the detector 402 capturing the charged particles and the sample 323 is represented as a contour map, for the purpose of explanation.

While the surface of the sample 323 is uniformly charged to the negative polarity except for the part where the electric potential is attenuated due to the optical attenuation, the detector 402 is applied with a positive electric potential. The electric potential represented by the contour in solid lines is therefore higher at positions nearer to the detector 402 and further away from the surface of the sample 323.

In FIG. 64, therefore, secondary electrons e11 and e12 respectively generated at a point Q1 and a point Q2 both of which are uniformly charged to the negative polarity are attracted by the positive electric potential of the detector 402, and displaced in directions indicated by the arrow G1 and the arrow G2, respectively, and are captured by the detector 402.

By contrast, a point Q3 in FIG. 64 is a part having irradiated with the beam so that the negative electric potential of this part is attenuated. Near the point Q3, a series of electric potential contour lines spread like semi-circular "ripples" with the center at the point Q3, as illustrated in dotted lines. The ripple-like electric potential distribution represents higher electric potential at positions nearer to the point Q3.

In other words, an electrical force in the direction holding back a secondary electron toward the sample 323 acts on the secondary electron e13 generated near the point Q3, as indicated by the arrow G3. The secondary electrons e13 is so captured in a potential hole represented by the electric potential contour lines in dotted lines, and becomes incapable of traveling toward the detector 402.

Figure 65:
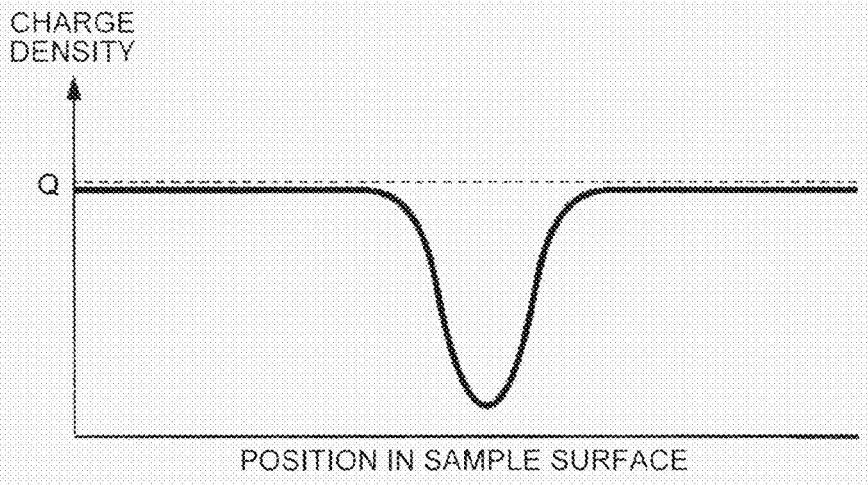
FIG. 65 is a schematic illustrating a charge distribution formed by the secondary electrons above the sample surface.

FIG. 65 is a schematic illustrating a charge distribution formed by the secondary electrons above the sample surface. In FIG. 65, the potential hole is schematically illustrated.

In other words, the portion where the detector 402 detects a higher secondary electron intensity (a larger number of secondary electrons) corresponds to the background of the electrostatic latent image (the part uniformly charged negatively, the part represented by the points Q1 and Q2 in FIG. 47). The portion where the detector 402 detects lower secondary electron intensity (a smaller number of secondary electrons) corresponds to the image portion of the electrostatic latent image (the portion irradiated with the beam, the portion represented by the point Q3 in FIG. 47).

By sampling the electrical signal output from the detector 402 at appropriate sampling intervals, a surface potential distribution (electric potential contrast image) V(a, b) can be identified for each "very small area corresponding to the sampling interval", having the sampling time T as a parameter.

The surface potential distribution V(a, b) may be acquired as two-dimensional image data, and displayed on a display device not illustrated or printed with a printer not illustrated, so that the electrostatic latent image as a visual image can be provided.

An electrostatic latent image can be output as a shading image based on the surface charge distribution, for example, by representing the intensity of captured secondary electrons as a range of light and dark shades, contrasting an image portion of the electrostatic latent image represented dark with a background portion represented light. If the surface potential distribution of an electrostatic latent image can be recognized, the surface charge distribution can also be recognized.

By acquiring the profile of the surface charge distribution or the surface potential distribution of an electrostatic latent image, the electrostatic latent image can be measured more precisely.

Figure 66:
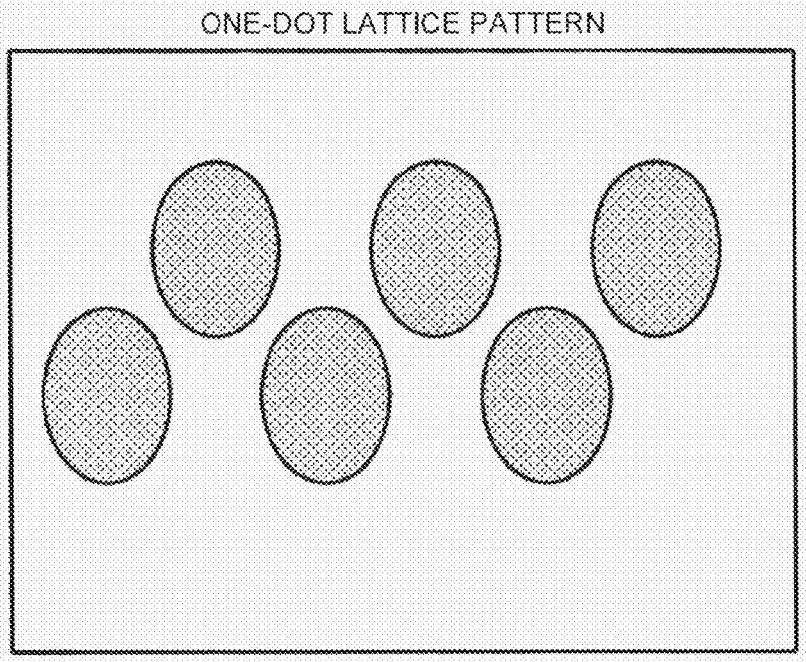
FIG. 66 is a schematic illustrating an exemplary latent image pattern formed with the optical scanning device illustrated in FIG. 4.

FIG. 66 is a schematic illustrating an exemplary latent image pattern formed with the optical scanning device illustrated in FIG. 4. An exemplary latent image pattern formed with the optical scanning device includes what is called a one-isolated dot pattern or lattice dot pattern illustrated in FIG. 66.

Figure 67:
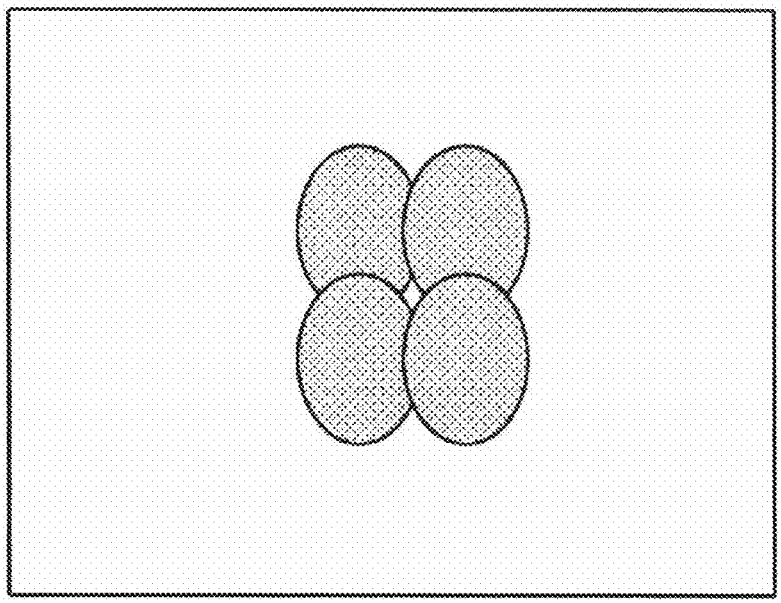
FIG. 67 is a schematic illustrating another exemplary latent image pattern formed with the optical scanning device illustrated in FIG. 4.

FIG. 67 is a schematic illustrating another exemplary latent image pattern formed with the optical scanning device illustrated in FIG. 4. Another exemplary latent image pattern formed with the optical scanning device includes what is called a two-isolated dot pattern illustrated in FIG. 67.

Figure 68:
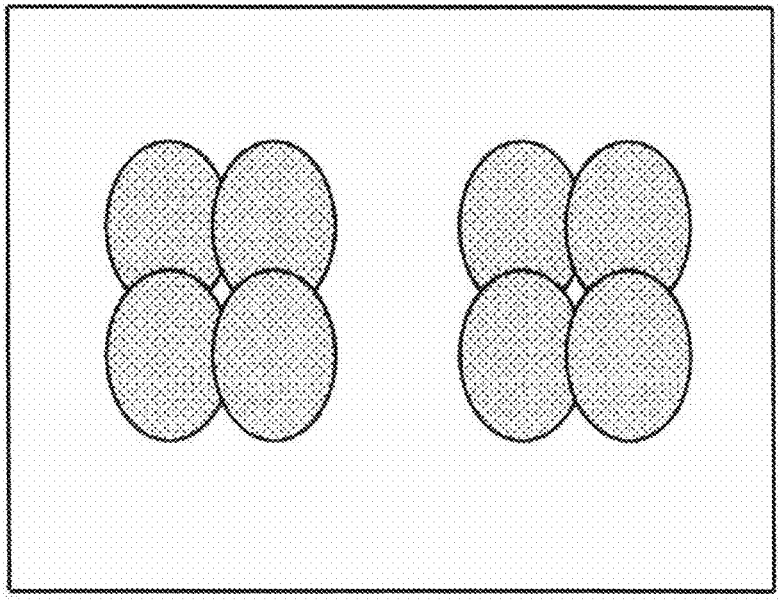
FIG. 68 is a schematic illustrating still another exemplary latent image pattern formed with the optical scanning device illustrated in FIG. 4.

FIG. 68 is a schematic illustrating still another exemplary latent image pattern formed with the optical scanning device illustrated in FIG. 4. Another exemplary latent image pattern formed with the optical scanning device includes what is called a two-by-two pattern illustrated in FIG. 68.

Figure 69:
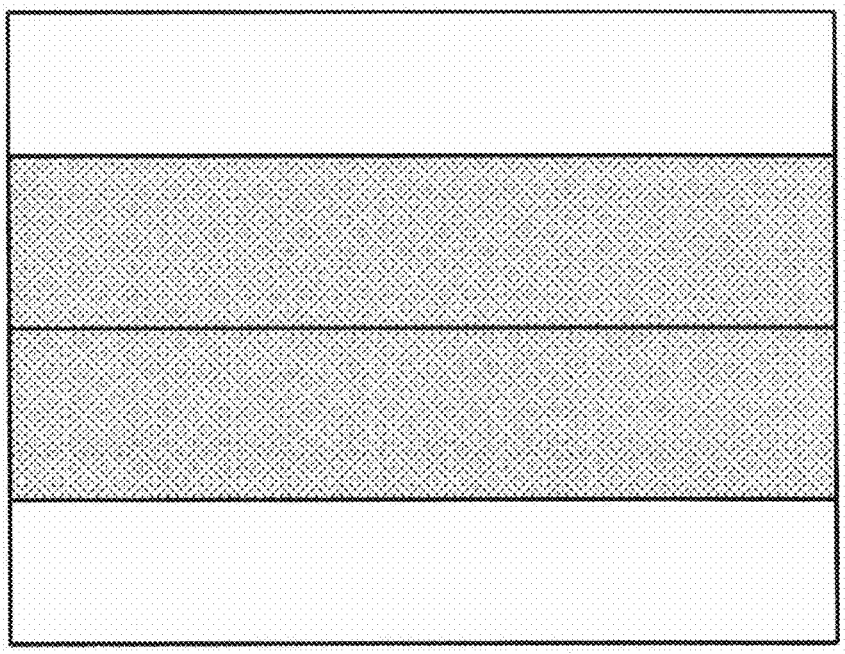
FIG. 69 is a schematic illustrating still another exemplary latent image pattern formed with the optical scanning device illustrated in FIG. 4.

FIG. 69 is a schematic illustrating still another exemplary latent image pattern formed with the optical scanning device illustrated in FIG. 4. Another exemplary latent image pattern formed with the optical scanning device includes what is called a two-dot line pattern, as illustrated in FIG. 69.

The optical scanning device may form latent images in various patterns, without limitation to those described above.

The target of detection by the detector 402 is not limited to the secondary electrons from the sample 323. The detector 402 may also detect, for example, the electrons repelled near the surface of the sample 323 before the electron beam becomes incident on the surface of the sample 323 (hereinafter, also referred to as "primary repulsive electrons").

Figure 70:
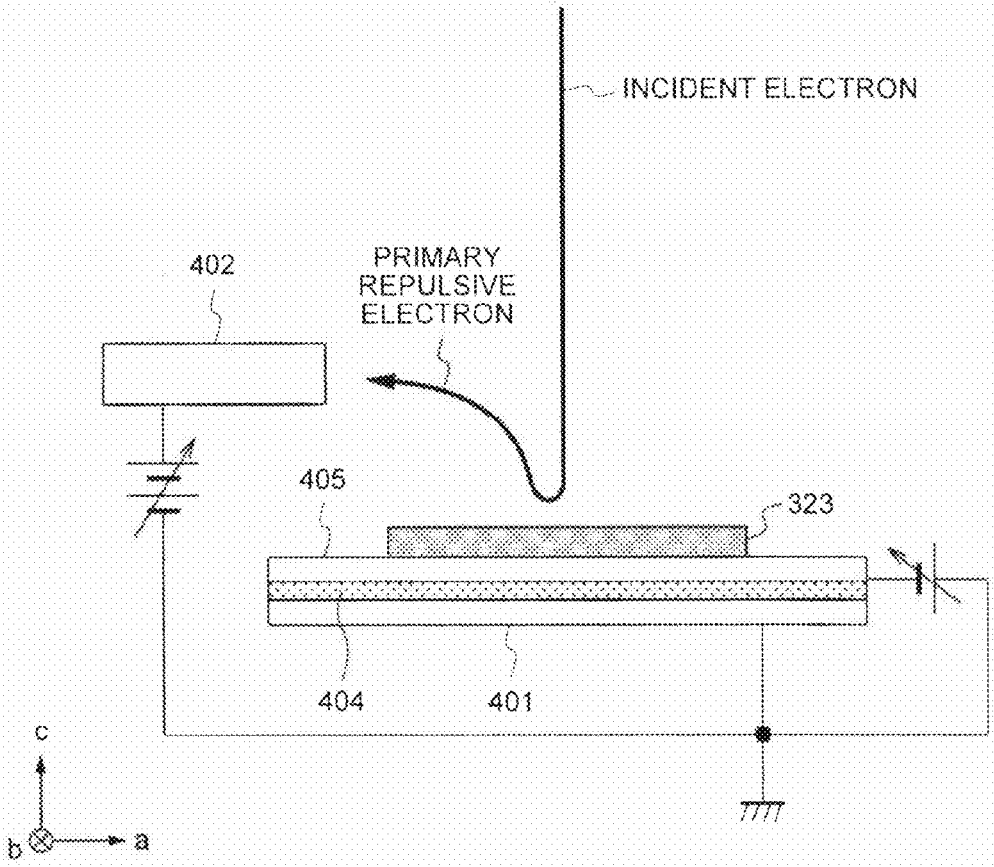
FIG. 70 is a cross-sectional view across the center in a measurement example with a grid-mesh arrangement.

FIG. 70 is a cross-sectional view across the center in a measurement example with a grid-mesh arrangement. As illustrated in FIG. 70, in this measurement example with the grid-mesh arrangement, an insulating member 404 and a conductive member 405 are provided between the platform 401 and the sample 323, and a ±Vsub voltage is applied to the conductive member 405.

This configuration allows the detector 402 to detect the primary repulsive electrons.

The detector 402 may be provided with a conductive plate facing the detector 402.

Despite the accelerating voltage is generally expressed as positive, the accelerating voltage is herein expressed as negative (Vacc<0) because Vacc is negative.

The electric potential of the sample 323 is denoted by Vp (<0).

Because an electric potential is the electrical potential energy per unit charge, the incident electrons at an electric potential of 0 (V) move at the speed of the accelerating voltage Vacc.

In other words, denoting the amount of charge of the electrons by e and denoting the mass of the electrons as m, the initial speed of electrons v0 can be expressed as mv02/2=e×|Vacc|. In the vacuum, the electrons move at a constant velocity in an area not affected by the accelerating voltage, due to the energy conservation law.

As the electrons approach the sample 323, the electric potential increases, and the electrons are repelled by the charge of the sample 323 due to the Coulomb repulsion, and become decelerated. As a result, a phenomenon described below generally occurs.

Figure 71:
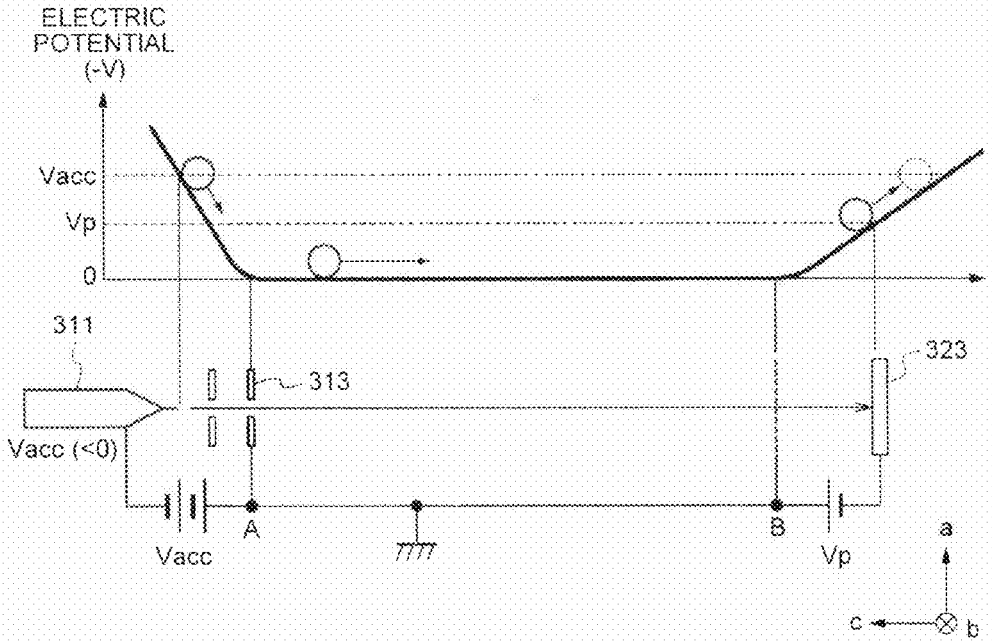
FIG. 71 is a schematic illustrating behavior of incident electrons when $|Vacc| \geq |Vp|$.

FIG. 71 is a schematic illustrating the behavior of the incident electrons when |Vacc|≥|Vp|. As illustrated in FIG. 71, when |Vacc|≥|Vp|, the incident electrons reach the sample 323 despite the incident electrons become decelerated.

Figure 72:
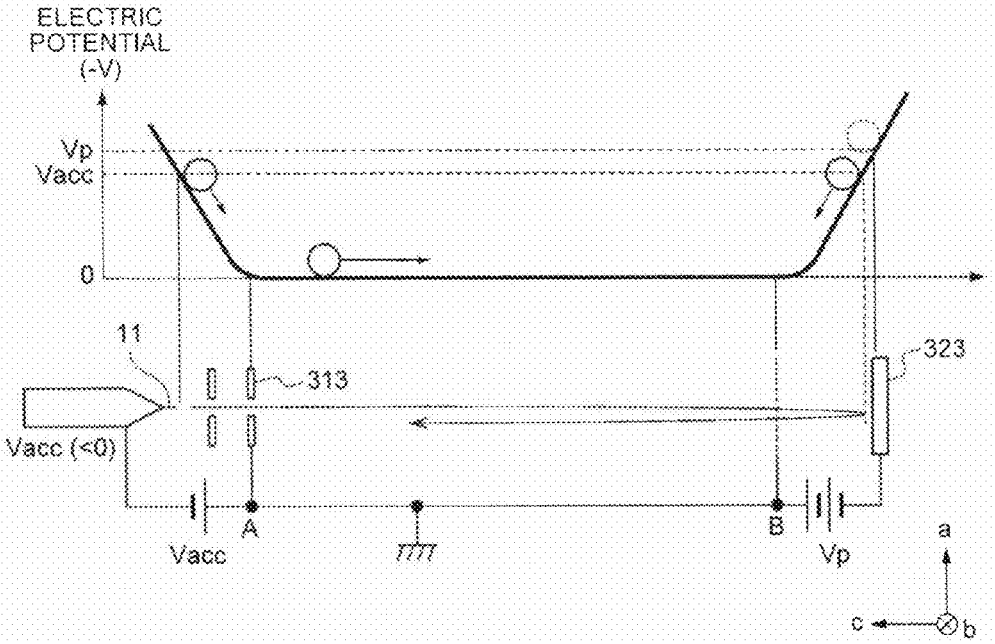
FIG. 72 is a schematic illustrating the behavior of the incident electrons when $|Vacc| < |Vp|$.

FIG. 72 is a schematic illustrating the behavior of the incident electrons when |Vacc|<|Vp|. As illustrated in FIG. 72, when |Vacc|<|Vp|, the incident electrons become decelerated by being affected by the electric potential of the sample 323. The incident electrons then decelerates to zero speed before reaching the sample 323, and then move back in the opposite direction.

In the vacuum with no resistance of the air, the energy conservation law is almost completely established. Therefore, by measuring the conditions in which the energy of the electrons being incident on the surface of the sample 323 becomes zero, that is, in which the landing energy of the incident electrons becomes zero, while changing the energy of the incident electrons, it becomes possible to measure the electric potential on the surface of the sample 323.

Because the amount of electrons reaching the detector 402 is quite different between the secondary electrons generated as the incident electrons hit the sample 323, and the primary repulsive electrons, the electric potential of the sample surface can be identified from the border between the dark and light contrast.

Some scanning electron microscopes include detectors of reflected electrons. The reflected electrons herein generally mean the incident electrons entering the sample and reflected (scattered) on the rear side on the back due to the interaction with the sample material, and emitted again from the sample surface.

The energy of the reflected electrons comes near the energy of the incident electrons. The velocity vector of the reflected electrons is generally said to be larger when the atomic number of the sample is larger. The reflected electrons are used in detecting a difference in the compositions of a sample, or irregularity of the sample surface.

By contrast, the primary repulsive electrons are those that are reverted before reaching the sample surface because such electrons are affected by the electric potential distribution of the sample surface, and are completely different from the reflected electrons.

Figure 73:
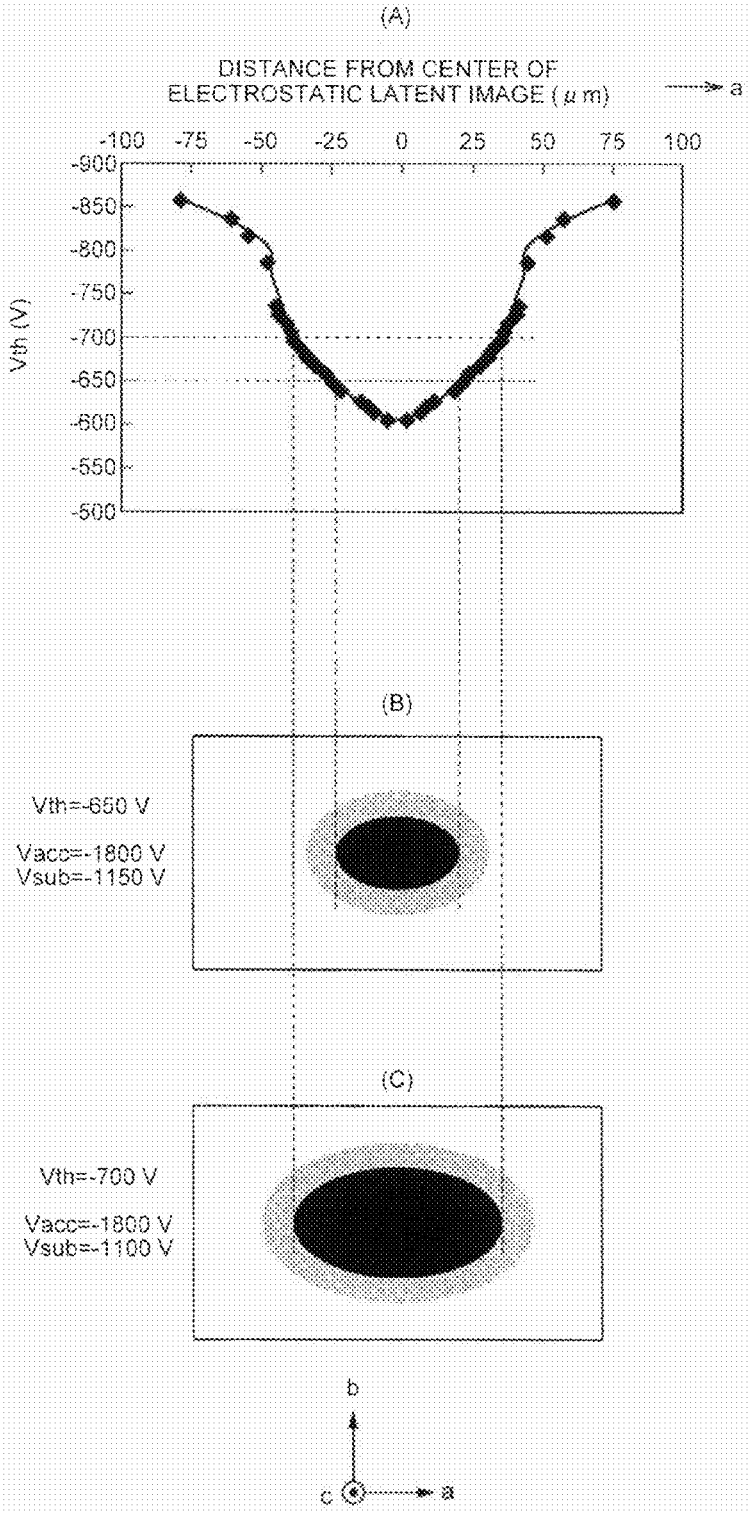
FIG. 73 is schematics illustrating exemplary measurement results of latent image depths.

FIG. 73 is schematics illustrating exemplary measurement results of latent image depths. FIG. 73 provides exemplary results of the measurements of an electrostatic latent image. In FIG. 73, Vth denotes the difference between Vacc and Vsub (=Vacc−Vsub).

The electric potential distribution V(a, b) can be acquired from Vth(a, b) of when the landing energy becomes almost zero at each scanned position (a, b). Vth(a, b) has a unique correspondence to an electric potential distribution V(a, b), and when the charge distribution is smooth, Vth(a, b) is approximate equivalent of the electric potential distribution V(a, b).

The curve representing a relation between Vth and a distance from the center of the electrostatic latent image in FIG. 73(A) provides an example of the distribution of a surface potential generated by the charge distribution of the sample surface.

In this example, Vacc is set to −1800 volts. The electric potential at the center of the electrostatic latent image is approximately −600 volts. As the position moves away from the center of the electrostatic latent image, the electric potential increases to the negative side. The electric potential of the peripheral area away from the micrometercenter of the electrostatic latent image by 75 s or more is approximately −850 volts.

FIG. 73(B) is a visualized image of an output from the detector 402 when Vsub is set to −1150 volts. At this time, Vth=−650 volts.

FIG. 73(C) is a visualized image of an output from the detector 402 when Vsub is set to −1100 volts. At this time, Vth=−700V.

In the method of acquiring the profile of an electrostatic latent image by detecting the primary repulsive electrons, by scanning the sample surface with the electron beam while changing Vacc or Vsub and measuring the resultant Vth(a, b), the surface potential information of the sample can be acquired. By using this method of acquiring the profile of an electrostatic latent image by detecting the primary repulsive electrons, the profile of the electrostatic latent image can be visualized in the micron order, while such visualization has been conventionally difficult.

In the method of acquiring the profile of an electrostatic latent image by detecting the primary repulsive electrons, because the energy of the incident electrons changes extremely, the trajectory of the incident electrons might be out of its course, thereby causing the scanning magnification to change or lens distortion to occur.

In such a case, the electrostatic field environment or the trajectory of electrons may be calculated in advance, and the detection results may be corrected based on the calculation result, so that the profile of an electrostatic latent image can be calculated highly precisely.

As explained above, with the electrostatic latent image measurement apparatus 300, a charge distribution, a surface potential distribution, an electric field intensity distribution of an electrostatic latent image, and an electric field intensity in the direction perpendicular to the sample surface can be measured highly precisely.

According to the present embodiments, high-quality images of image patterns including image portions having very small pixels and non-image portions can be formed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming method for forming an electrostatic latent image corresponding to an image pattern including an image portion and a non-image portion, the image forming method comprising:

exposing a surface of an image bearer with light based on the image pattern, the image portion having a plurality of pixels, and pixels constituting the image portion but not adjacent to at least the non-image portion are exposed with a first optical output that is higher than a given optical output obtained when the entire pixels corresponding to the image portion are exposed over a given time period.

2. The image forming method according to claim 1, wherein pixels that are adjacent to the non-image portion are not exposed.

3. The image forming method according to claim 1, wherein pixels constituting the image portion but not exposed with the first optical output are not exposed.

4. The image forming method according to claim 1, wherein the pixels exposed with the first optical output are exposed for a time period shorter than the given time period.

5. The image forming method according to claim 1, wherein an integral amount of light on the pixels exposed with the first optical output is equal to an integral amount of light on the entire pixels corresponding to the image portion exposed with the given optical output over the given time period.

6. The image forming method according to claim 1, wherein the pixels exposed with the first optical output are positioned corresponding to diffusion of electric charges on exposed pixels.

7. The image forming method according to claim 1, herein pixels exposed with the first optical output and provided adjacent to non-exposed pixels are disposed so that lines connecting a plurality of end portions and a central part of the image portion curve around the central part.

8. An image forming apparatus for forming an electrostatic latent image corresponding to an image pattern including an image portion and a non-image portion by exposing a surface of an image bearer with light based on the image pattern, the image forming apparatus comprising:

alight source that outputs the light;

light source driving circuitry that generates a light source driving current for driving the light source; and an optical system that guides the light output from the light source to the image bearer, wherein the image portion has a plurality of pixels, and the light source driving circuitry exposes pixels constituting the image portion but not adjacent to at least the non-image portion with a first optical output that is higher than a given optical output obtained when the entire pixels corresponding to the image portion are exposed over a given time period.

9. The image forming apparatus according to claim 8, wherein pixels that are adjacent to the non-image portion are not exposed.

10. The image forming apparatus according to claim 8, wherein pixels constituting the image portion but not exposed with the first optical output are not exposed.

11. The image forming apparatus according to claim 8, wherein the pixels exposed with the first optical output are exposed for a time period shorter than the given time period.

12. The image forming apparatus according to claim 8, wherein an integral amount of light on the pixels exposed with the first optical output is equal to an integral amount of light on the entire pixels corresponding to the image portion exposed with the given optical output over the given time period.

13. The image forming apparatus according to claim 8, wherein the pixels exposed with the first optical output are positioned corresponding to diffusion of electric charges on exposed pixels.

14. The image forming apparatus according to claim 8, wherein pixels exposed with the first optical output and provided adjacent to non-exposed pixels are disposed so that lines connecting a plurality of end portions and a central part of the image portion curve around the central part.

15. A method for manufacturing a printed matter, the method comprising:

forming an electrostatic latent image corresponding to an image pattern including an image portion and a non-image portion by exposing a surface of an image bearer with light based on the image pattern, wherein the image portion has a plurality of pixels, and at the forming of the electrostatic latent image, pixels constituting the image portion but not adjacent to at least the non-image portion are exposed with a first optical output that is higher than a given optical output obtained when the entire pixels corresponding to the image portion are exposed over a given time period.

* * * * *